US008413644B2

(12) United States Patent
Masse

(10) Patent No.: US 8,413,644 B2
(45) **Date of Patent: *Apr. 9, 2013**

(54) COMPRESSED GAS GUN HAVING REDUCED BREAKAWAY-FRICTION AND HIGH PRESSURE DYNAMIC SEPARABLE SEAL AND FLOW CONTROL AND VALVING DEVICE

(75) Inventor: Robert K. Masse, Redmond, WA (US)

(73) Assignee: KEE Action Sports I LLC, Sewell, NJ (US)

( * ) Notice: Subject to any disclaimer, the term of this patent is extended or adjusted under 35 U.S.C. 154(b) by 723 days.

This patent is subject to a terminal disclaimer.

(21) Appl. No.: 12/358,184

(22) Filed: Jan. 22, 2009

(65) Prior Publication Data

US 2009/0241931 A1 Oct. 1, 2009

Related U.S. Application Data

(63) Continuation-in-part of application No. 11/347,964, filed on Feb. 6, 2006, now Pat. No. 7,886,731, which is a continuation-in-part of application No. 10/656,307, filed on Sep. 5, 2003, now Pat. No. 7,237,545, which is a continuation-in-part of application No. 10/090,810, filed on Mar. 6, 2002, now Pat. No. 6,708, 685.

(60) Provisional application No. 60/650,388, filed on Feb. 4, 2005, provisional application No. 61/011,959, filed on Jan. 22, 2008.

(51) Int. Cl.
*F41B 11/32* (2006.01)
*F41B 11/34* (2006.01)

(52) U.S. Cl. ..... 124/76; 124/73; 124/77

(58) Field of Classification Search ..... 124/73, 124/76, 77
See application file for complete search history.

(56) References Cited

U.S. PATENT DOCUMENTS

| | | | |
|---|---|---|---|
| 495,767 | A | 4/1893 | Winans |
| 645,932 | A | 3/1900 | Beck et al. |
| 1,441,975 | A | 1/1923 | Edelin |
| 2,116,860 | A | 5/1938 | Blaylock et al. |
| 2,123,324 | A | 7/1938 | Webby |
| 2,147,003 | A | 2/1939 | Kozurik |
| 2,252,754 | A | 8/1941 | Browning |
| 2,357,951 | A | 9/1944 | Hale |
| 2,360,734 | A | 10/1944 | Smith |

(Continued)

FOREIGN PATENT DOCUMENTS

| | | |
|---|---|---|
| EP | 0772022 | 7/1997 |
| GB | 570178 | 6/1945 |

(Continued)

OTHER PUBLICATIONS

SuperNova from Air Star Owners Manual.

(Continued)

*Primary Examiner* — Bret Hayes
(74) *Attorney, Agent, or Firm* — Volpe and Koenig, P.C.

(57) ABSTRACT

A reduced breakaway-friction flow control and valving device for a compressed gas-powered projectile accelerator is disclosed having an improved means of reducing break-away friction, an improved sealing arrangement, and self-contained modular components to improve efficiency, manufacturability, and reduce size and weight.

7 Claims, 58 Drawing Sheets

U.S. PATENT DOCUMENTS

| | | | | |
|---|---|---|---|---|
| 2,568,432 | A | 9/1951 | Cook | |
| 2,594,240 | A | 4/1952 | Wells | |
| 2,618,254 | A | 11/1952 | Wells | |
| 2,809,624 | A | 10/1957 | Becher et al. | |
| 2,817,328 | A | 12/1957 | Gale | |
| 2,881,752 | A | 4/1959 | Blahnik | |
| 3,000,371 | A | 9/1961 | Hyde | |
| 3,170,487 | A | 2/1965 | Juilfs et al. | |
| 3,204,625 | A | 9/1965 | Shepherd | |
| 3,308,803 | A | 3/1967 | Walther | |
| 3,333,508 | A | 8/1967 | Kruzell | |
| 3,342,171 | A | 9/1967 | Ryan et al. | |
| 3,420,220 | A | 1/1969 | Ferrando | |
| 3,421,549 | A * | 1/1969 | Charlton et al. | 137/624.14 |
| 3,465,742 | A | 9/1969 | Herr | |
| 3,552,714 | A | 1/1971 | Manville | |
| 3,556,472 | A | 1/1971 | Grove et al. | |
| 3,572,310 | A | 3/1971 | Chiba | |
| 3,612,026 | A | 10/1971 | Vadas | |
| 3,612,379 | A | 10/1971 | Panock | |
| 3,624,802 | A | 11/1971 | Ripert | |
| 3,633,606 | A | 1/1972 | Hay et al. | |
| 3,653,538 | A | 4/1972 | Lamar | |
| 3,675,534 | A | 7/1972 | Beretta | |
| 3,706,325 | A | 12/1972 | Pauliukonis | |
| 3,707,981 | A | 1/1973 | Sadler et al. | |
| 3,741,189 | A | 6/1973 | Kester et al. | |
| 3,765,396 | A | 10/1973 | Kienholz et al. | |
| 3,788,298 | A | 1/1974 | Hale | |
| 3,921,614 | A | 11/1975 | Fogelgren | |
| 3,951,038 | A | 4/1976 | Van Langenhoven | |
| 3,985,337 | A | 10/1976 | Gripe et al. | |
| 4,004,566 | A | 1/1977 | Fischer | |
| 4,037,995 | A | 7/1977 | Graham | |
| 4,083,349 | A | 4/1978 | Clifford | |
| 4,148,245 | A | 4/1979 | Steffanus et al. | |
| 4,240,467 | A | 12/1980 | Blatt et al. | |
| 4,362,145 | A | 12/1982 | Stelcher | |
| 4,406,383 | A | 9/1983 | Duncan | |
| 4,446,559 | A | 5/1984 | von Bieren | |
| 4,531,503 | A | 7/1985 | Shepherd | |
| 4,616,622 | A | 10/1986 | Milliman | |
| 4,637,463 | A | 1/1987 | McCoy | |
| 4,645,179 | A | 2/1987 | Ali | |
| 4,747,338 | A | 5/1988 | Crutcher | |
| 4,750,583 | A | 6/1988 | Wolf | |
| 4,770,153 | A | 9/1988 | Edelman | |
| 4,819,609 | A | 4/1989 | Tippmann | |
| 4,819,610 | A | 4/1989 | Lacam et al. | |
| 4,850,330 | A | 7/1989 | Nagayoshi | |
| 4,899,717 | A | 2/1990 | Rutten et al. | |
| 4,936,282 | A | 6/1990 | Dobbins et al. | |
| 4,951,644 | A | 8/1990 | Bon | |
| 5,063,905 | A | 11/1991 | Farrell | |
| 5,078,118 | A | 1/1992 | Perrone | |
| 5,230,324 | A | 7/1993 | Van Horssen et al. | |
| 5,257,614 | A | 11/1993 | Sullivan | |
| 5,280,778 | A | 1/1994 | Kotsiopoulos | |
| 5,299,813 | A | 4/1994 | McKenna | |
| 5,333,594 | A | 8/1994 | Robinson | |
| 5,337,726 | A | 8/1994 | Wood | |
| 5,339,791 | A | 8/1994 | Sullivan | |
| 5,349,938 | A | 9/1994 | Farrell | |
| 5,349,939 | A | 9/1994 | Perrone | |
| 5,383,442 | A | 1/1995 | Tippmann | |
| 5,429,108 | A | 7/1995 | Hsieh | |
| 5,462,042 | A | 10/1995 | Greenwell | |
| 5,477,843 | A | 12/1995 | Kunimoto | |
| 5,494,024 | A | 2/1996 | Scott | |
| 5,497,758 | A | 3/1996 | Dobbins et al. | |
| 5,515,838 | A | 5/1996 | Anderson | |
| 5,520,172 | A | 5/1996 | Obermayer | |
| 5,572,982 | A | 11/1996 | Williams | |
| 5,613,483 | A | 3/1997 | Lukas et al. | |
| 5,634,456 | A | 6/1997 | Perrone | |
| 5,646,910 | A | 7/1997 | Bouyoucos | |
| 5,669,369 | A | 9/1997 | Scott | |
| 5,704,342 | A | 1/1998 | Gibson et al. | |
| 5,727,538 | A | 3/1998 | Ellis | |
| 5,769,066 | A | 6/1998 | Schneider | |
| 5,771,875 | A | 6/1998 | Sullivan | |
| 5,778,868 | A | 7/1998 | Shepherd | |
| 5,881,707 | A | 3/1999 | Gardner, Jr. | |
| 5,904,133 | A | 5/1999 | Alexander et al. | |
| 5,908,024 | A | 6/1999 | Staev | |
| 5,913,303 | A | 6/1999 | Kotsiopoulos | |
| 5,967,133 | A | 10/1999 | Gardner, Jr. | |
| 6,003,504 | A | 12/1999 | Rice et al. | |
| 6,003,547 | A | 12/1999 | Tippmann, Jr. | |
| 6,024,077 | A | 2/2000 | Kiosiopoulos | |
| 6,035,843 | A | 3/2000 | Smith et al. | |
| 6,065,460 | A | 5/2000 | Lotuaco, III | |
| 6,125,834 | A | 10/2000 | Ciccarelli et al. | |
| 6,138,656 | A | 10/2000 | Rice et al. | |
| 6,158,424 | A | 12/2000 | Kunimoto | |
| 6,276,354 | B1 | 8/2001 | Dillon | |
| 6,311,682 | B1 | 11/2001 | Rice et al. | |
| 6,343,599 | B1 | 2/2002 | Perrone | |
| 6,349,711 | B1 | 2/2002 | Perry et al. | |
| 6,425,834 | B1 | 7/2002 | Nozato | |
| 6,467,751 | B1 | 10/2002 | Korpanty et al. | |
| 6,474,326 | B1 | 11/2002 | Smith et al. | |
| 6,516,791 | B2 | 2/2003 | Perone | |
| 6,520,171 | B2 | 2/2003 | Reible | |
| 6,520,172 | B2 | 2/2003 | Perrone | |
| 6,550,468 | B1 | 4/2003 | Tippmann, Jr. | |
| 6,553,983 | B1 | 4/2003 | Li | |
| 6,557,542 | B1 | 5/2003 | Orr | |
| 6,561,176 | B1 | 5/2003 | Fujimoto et al. | |
| 6,564,788 | B1 | 5/2003 | Hu | |
| 6,601,780 | B1 | 8/2003 | Sheng | |
| 6,637,421 | B2 | 10/2003 | Smith et al. | |
| 6,644,295 | B2 | 11/2003 | Jones | |
| 6,701,909 | B2 | 3/2004 | Tiberius et al. | |
| 6,708,685 | B2 * | 3/2004 | Masse | 124/75 |
| 6,832,605 | B2 | 12/2004 | Farrell | |
| 6,986,343 | B2 | 1/2006 | Carnall et al. | |
| 7,004,192 | B2 | 2/2006 | Gabrel | |
| 7,044,119 | B2 | 5/2006 | Jones | |
| 7,073,284 | B2 | 7/2006 | Monks et al. | |
| 7,185,646 | B2 | 3/2007 | Jones | |
| 7,210,473 | B2 | 5/2007 | Jong | |
| 7,237,545 | B2 * | 7/2007 | Masse | 124/75 |
| 7,398,777 | B2 | 7/2008 | Carnall et al. | |
| 7,461,646 | B2 | 12/2008 | Jones | |
| 7,533,664 | B2 | 5/2009 | Carnall | |
| 7,556,032 | B2 | 7/2009 | Jones et al. | |
| 7,591,262 | B2 | 9/2009 | Jones et al. | |
| 7,617,819 | B2 | 11/2009 | Jones | |
| 7,617,820 | B2 | 11/2009 | Jones | |
| 7,624,723 | B2 | 12/2009 | Gardner, Jr. et al. | |
| 7,640,925 | B2 | 1/2010 | Jones | |
| 7,640,926 | B2 | 1/2010 | Jones | |
| 7,686,005 | B2 | 3/2010 | Adams | |
| 7,886,731 | B2 * | 2/2011 | Masse | 124/73 |
| 2001/0042543 | A1 | 11/2001 | Perrone | |
| 2002/0088449 | A1 | 7/2002 | Perrone | |
| 2002/0096164 | A1 | 7/2002 | Perrone | |
| 2002/0170551 | A1 | 11/2002 | Kotsiopoulos et al. | |
| 2003/0005918 | A1 | 1/2003 | Jones | |
| 2003/0024520 | A1 | 2/2003 | Dobbins | |
| 2003/0024521 | A1 | 2/2003 | Smith et al. | |
| 2003/0047174 | A1 | 3/2003 | Tiberius et al. | |
| 2003/0047175 | A1 | 3/2003 | Farrell | |
| 2003/0079731 | A1 | 5/2003 | Dobbins | |
| 2003/0168052 | A1 | 9/2003 | Masse | |
| 2003/0226555 | A1 | 12/2003 | Reible | |
| 2004/0216728 | A1 | 11/2004 | Jong | |
| 2004/0255923 | A1 | 12/2004 | Carnall et al. | |
| 2005/0115551 | A1 | 6/2005 | Carnall et al. | |
| 2005/0121014 | A1 | 6/2005 | Monks | |
| 2006/0162715 | A1 | 7/2006 | Jones | |
| 2007/0068502 | A1 | 3/2007 | Jones et al. | |
| 2007/0186916 | A1 | 8/2007 | Jones | |
| 2007/0209649 | A1 | 9/2007 | Jones | |

FOREIGN PATENT DOCUMENTS

| | | |
|---|---|---|
| GB | 614740 | 12/1948 |
| GB | 1017397 | 7/1966 |
| GB | 1223675 | 3/1971 |
| GB | 2188714 | 10/1987 |
| GB | 2193797 | 2/1988 |
| GB | 2198818 | 6/1988 |
| GB | 2228067 | 8/1990 |
| GB | 2258913 | 2/1993 |
| GB | 2313655 | 3/1997 |
| JP | 1285798 | 11/1898 |
| JP | 11173792 | 7/1989 |
| JP | 74892 | 1/1995 |
| WO | 88/05895 | 8/1988 |
| WO | 98/13660 | 4/1998 |
| WO | 00/75594 | 12/2000 |

OTHER PUBLICATIONS

WARPIG—World and Regional Paintball Information Guide http:/www.warpig.com/paintball/technical/paintguns/nova/novafaq.shtml Air Star Nova FAQ Copyright 1999 by Bill Mills (5 pages).

WARPIG—World and Regional Paintball Information Guide http:/www.warpig.com/paintball/technical/paintguns/supernovaET/index.shtml Air Star Super Nova ET by Bill Mills (7 pages).

Action Pursuit Games, Jan. 2001, pp. 88-92, Inside Air Star's Supernova ET by James R. "Mad Dog" Morgan, Sr.

Paintball Magazine, Feb. 2000, pp. 33-36, Staff Report E.T. Super Nova.

Paintball 2-Xtremes Magazine, Sep. 1999, pp. 30 and 94-95, Product Profile Air Star's Supernova E.T.

Mar. 21, 2007 Non-Final Office Action from related co-pending U.S. Appl. No. 11/654,721.

Nov. 3, 2008 Notice of Allowance from related co-pending U.S. Appl. No. 11/654,721.

Aug. 19, 2009 Non-Final Office Action from related co-pending U.S. Appl. No. 11/654,721.

Jun. 9, 2010 Final Office Action from related co-pending U.S. Appl. No. 11/654,721.

Mar. 25, 2011 Notice of Allowance from related co-pending U.S. Appl. No. 11/654,721.

Sep. 28, 2011 Notice of Allowance from related co-pending U.S. Appl. No. 11/654,721.

Jun. 25, 2010 Non-Final Office Action from related co-pending U.S. Appl. No. 11/747,107.

Mar. 21, 2011 Non-Final Office Action from related co-pending U.S. Appl. No. 11/747,107.

Nov. 9, 2011 Notice of Allowance from related co-pending U.S. Appl. No. 11/747,107.

Oct. 6, 2010 Non-Final Office Action from related co-pending U.S. Appl. No. 12/503,504.

Jul. 21, 2011 Non-Final Office Action from related co-pending U.S. Appl. No. 12/503,504.

* cited by examiner

Side Sectional View

Side Sectional View

Side Sectional View

Side Sectional View

Rear Sectional View

Rear Sectional View

Rear Sectional View

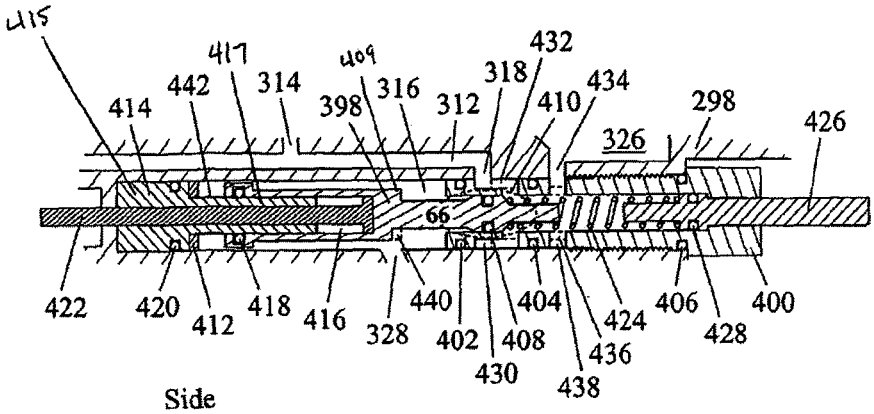
Side Sectional View
FIG. 65A
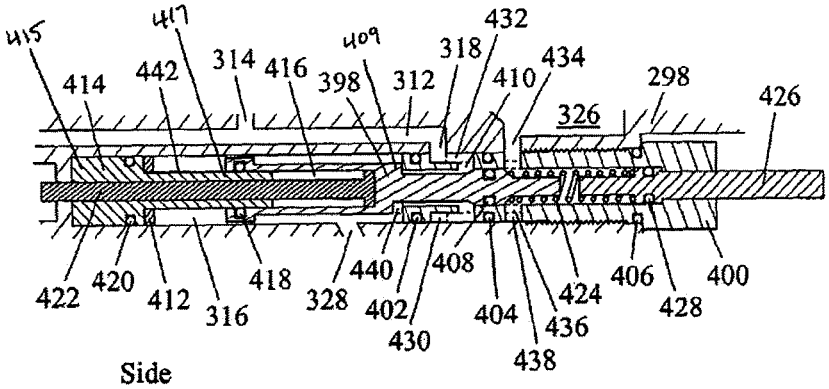
Side Sectional View
FIG. 65B
FIG. 66
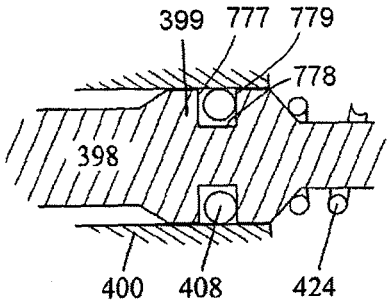
Side Sectional View Side Sectional View Side Sectional View Side Sectional View Side Sectional View Side Sectional View Side Sectional View Side Sectional View Side Sectional View Side Sectional View Side Sectional View

COMPRESSED GAS GUN HAVING REDUCED BREAKAWAY-FRICTION AND HIGH PRESSURE DYNAMIC SEPARABLE SEAL AND FLOW CONTROL AND VALVING DEVICE

CROSS REFERENCE TO RELATED APPLICATIONS

This application is a continuation-in-part of U.S. patent application Ser. No. 11/347,964, filed Feb. 6, 2006, now U.S. Pat. No. 7,886,731, issued Feb. 15, 2011, which is a non-provisional application of and claims the benefit of provisional application U.S. Provisional Patent Application No. 60/650,388, filed Feb. 4, 2005, which is a continuation-in-part of U.S. patent application Ser. No. 10/656,307, filed Sep. 5, 2003 now U.S. Pat. No. 7,237,545, issued Jul. 3, 2007, which is a continuation-in-part of U.S. patent application Ser. No. 10/090,810, filed Mar. 6, 2002, now U.S. Pat. No. 6,708,685, issued Mar. 23, 2004, and is also is a non-provisional application of and claims the benefit of U.S. Provisional Patent Application No. 61/011,959, filed Jan. 22, 2008, the entire contents of which are incorporated by reference in their entireties as if fully set forth herein.

FIELD OF THE INVENTION

This invention relates, in general, to compressed gas-powered projectile accelerators, generally known as "air-guns" irrespective of the type of projectile, gas employed, scale, or purpose of the device.

BACKGROUND

Compressed gas-powered projectile accelerators have been used extensively to propel a wide variety of projectiles. Typical applications include weaponry, hunting, target shooting, and recreational (non-lethal) combat. In recent years, a large degree of development and invention has centered around recreational combat, where air-guns are employed to launch non-lethal projectiles which simply mark, rather than significantly injure or damage the target. Such air-guns are commonly referred to as "paintball markers" or "markers" and fire frangible paintballs which are generally gelatin capsule filled with a non-toxic marking paint or dye. Between launching projectiles such air-guns are generally loaded and reset to fire when the trigger is pulled, generally referred to as "re-cocking" either by an additional manual action by the operator, or pneumatically, as part of each projectile-accelerating event or "cycle". These devices may be divided into two categories—those that are "non-regulated" or "inertially-regulated", and those that are "statically-regulated".

Non-regulated or inertially-regulated air-guns direct gas from a single storage reservoir, or set of reservoirs that are continuously connected without provision to maintain a static (zero-gas flow) pressure differential between them, to accelerate a projectile through and out of a tube or "barrel". The projectile velocity is typically controlled by mechanically or pneumatically controlling the open time of a valve isolating the source gas, which is determined by the inertia and typically spring force exerted on moving parts. Examples of manually re-cocked non-regulated or inertially-regulated projectile accelerators are the inventions of Perrone, U.S. Pat. No. 5,078,118; and Tippmann, U.S. Pat. No. 5,383,442. Examples of pneumatically re-cocked non-regulated or inertially-regulated projectile accelerators (this type of projectile accelerator being the most commonly used in recreational combat) are the inventions of Tippman, U.S. Pat. No. 4,819,609; Sullivan, U.S. Pat. No. 5,257,614; Perrone, U.S. Pat. Nos. 5,349,939 and 5,634,456; and Dobbins et al., U.S. Pat. No. 5,497,758.

Statically-regulated air-guns transfer gas from a storage reservoir to an intermediate reservoir, through a valve which regulates pressure within the intermediate reservoir to a controlled design level, or "set pressure", providing sufficient gas remains within the storage reservoir with pressure in excess of the intermediate reservoir set pressure. This type of air-gun directs the controlled quantity of gas within said intermediate reservoir in such a way as to accelerate a projectile through and out of a barrel. Thus, for purposes of discussion, the operating sequence or "projectile accelerating cycle" or "cycle" can be divided into a first step where said intermediate reservoir automatically fills to the set pressure, and a second step, initiated by the operator, where the gas from said intermediate reservoir is directed to accelerate a projectile. The projectile velocity is typically controlled by controlling the intermediate reservoir set pressure. Examples of statically regulated projectile accelerators are the inventions of Milliman, U.S. Pat. No. 4,616,622; Kotsiopoulos, U.S. Pat. No. 5,280,778; and Lukas et al., U.S. Pat. No. 5,613,483.

More recently, electronics have been employed in both non-regulated and statically-regulated air-guns to control actuation, timing and projectile velocity. Examples of electronic projectile accelerators are the inventions of Rice et al., U.S. Pat. No. 6,003,504; and Lotuaco, III, U.S. Pat. No. 6,065,460.

Problems with Compressed Gas Powered Guns Known to be in the Art, Relating to Maintenance, Complexity, and Reliability, are Illustrated by the Following Partial List:

Sensitivity to liquid $CO_2$— The most common gas employed by air-guns is $CO_2$, which is typically stored in a mixed gas/liquid state. However, inadvertent feed of liquid $CO_2$ into the air-gun commonly causes malfunction in both non-regulated or inertially regulated air-guns and, particularly, statically-regulated air-guns, due to adverse effects of liquid $CO_2$ on valve and regulator seat materials. Cold weather exacerbates this problem, in that the saturated vapor pressure of $CO_2$ is lower at reduced temperatures, necessitating higher gas volume flows. Additionally, the dependency of the saturated vapor pressure of $CO_2$ on temperature results in the need for non-regulated or inertially regulated air-guns to be adjusted to compensate for changes in the temperature of the source gas, which would otherwise alter the velocity to which projectiles are accelerated.

Difficulty of disassembly—In many air-guns known to be in the art, interaction of the bolt with other mechanical components of the device complicates removal of the bolt, which is commonly required as part of cleaning and routine maintenance.

Double feeding—air-guns known to be in the art typically hold a projectile at the rear of the barrel between projectile accelerating cycles. In cases where the projectile is round, a special provision is required to prevent the projectile from prematurely rolling down the barrel. Typically, a lightly spring biased retention device is situated so as to obstruct passage of the projectile unless the projectile is thrust with enough force to overcome the spring bias and push the retention device out of the path of the projectile for sufficient duration for the projectile to pass. Alternatively, in some cases close tolerance fits between the projectile caliber and barrel bore are employed to frictionally prevent premature forward motion of the projectile. However, rapid acceleration of the air-gun associated with movement of the operator is often of sufficient force to overcome the spring bias of retention device, allowing the projectile to move forward, in turn allowing a second projectile to enter the barrel. When the air-gun is subsequently operated, either both projectiles are accelerated, but to lower velocity than would be for a single projectile, or, for fragile projectiles, one or both of the projectiles will fracture within the barrel.

Bleed up of pressure—Statically-regulated air-guns require a regulated seal between the source reservoir and intermediate reservoir which closes communication of gas between said reservoirs when the set pressure is reached. Because this typically leads to small closing force margins on the sealing surface, said seal commonly slowly leaks, causing the pressure within the intermediate reservoir to slowly increase or "bleed up" beyond the intended set pressure. When the air-gun is actuated, this causes the projectile to be accelerated to higher than the intended speed, which, with respect to recreational combat, endangers players.

Not practical for fully-automatic operation—Air-guns which have an automatic re-cock mechanism can potentially be designed so as accelerate a single projectile per actuation of the trigger, known as "semi-automatic" operation, or so that multiple projectiles are fired in succession when the trigger is actuated, known as "fully-automatic" operation. (Typically air-guns that are designed for fully-automatic operation are designed such that semi-automatic operation is also possible.) Most air-guns known to be in the art are conceptually unsuitable for fully-automatic operation in that there is no automated provision for the timing between cycles required for the feed of a new projectile into the barrel, this function being dependent upon the inability of the operator to actuate the trigger in excess of the rate at which new projectiles enter the barrel when operated semi-automatically. Air-guns known to be in the art which are capable of fully-automatic operation typically accommodate this timing either by inertial means, using the mass-induced resistance to motion of moving components, or by electronic means, where timing is accomplished by electric actuators operated by a control circuit, both methods adding considerable complexity.

Difficult manufacturability—Many air-guns known to be in the art, particularly those designed for fully automatic operation, are complex, requiring a large number of parts and typically the addition of electronic components.

Stiff or operator sensitive trigger pull—The trigger action of many non-electronic air-guns known to be in the art initiates the projectile accelerating cycle by releasing a latch obstructing the motion of a spring biased component. In many cases, since the spring bias must be quite strong to properly govern the projectile acceleration, the friction associated with the release of this latch results in an undesirably stiff trigger action. Additionally, this high friction contact results in wear of rubbing surfaces. Alternatively, in some cases, to reduce mechanical complexity and circumvent this problem, the trigger is designed such that its correct function is dependent upon the technique applied by the operator, resulting in malfunction if the operator only partially pulls the trigger through a minimum stroke.

High wear on striking parts—In many air-guns known to be in the art, particularly those designed for semi-automatic or fully-automatic operation, the travel of some of the moving parts is limited by relatively hard impact with a bumper. Additionally, in many cases, a valve is actuated by relatively hard impact from a slider. The components into which the impact energy is dissipated exhibit increased rates of wear. Further, wear of high impact surfaces in the conceptual design of many air-guns known to be in the art make them particularly un-adaptable to fully-automatic operation.

Contamination—Many of the air-guns known to be in the art require a perforation in the housing to accommodate the attachment of a lever or knob to allow the operator to perform a necessary manipulation of the internal components into a ready-to-fire configuration, generally known as "cocking". This perforation represents an entry point for dust, debris, and other contamination, which may interfere with operation.

It would be desirable to have a compressed gas projectile accelerator, and a flow control and valving device, addressing some of the foregoing issues with existing compressed gas projectile accelerators.

SUMMARY

The present invention provides a reduced breakaway-friction flow control device for a compressed gas-powered projectile accelerator. The flow control device is located within a compressed gas-powered projectile accelerator housing having a forward end and a rear end. Contained within the housing is a valve passage having a forward end located adjacent to the forward end of the housing and a rear end located adjacent to the rear end of the housing. The valve passage is in communication with at least one other passage located within the housing. Contained within the valve passage is a valve slider having opposite forward and rear end wherein the first end is located adjacent to the forward end of the valve passage and the second end is located adjacent to the rear end of the valve passage. The valve slider slides along a length of the valve passage from a first position, adjacent to the forward end of the valve passage, to a second position, adjacent to the rear end of the valve passage, and from the second position to the first position. An annular groove, having opposite inner walls, is formed on an outer surface of the valve slider. An annular seal is affixed within the groove so that if "floats"; i.e. the "faces" of the seal only contact two adjacent inner walls of the channeled groove, but do not contact the opposing walls. Further, the annular seal initially remains stationary when the valve slider begins to move from the first position to the second position and from the second position to the first position, thereby significantly reducing the "breakaway friction"; i.e., the static frictional force existing between the surface of the seal and the inner wall of the valve passage or another surrounding body. This configuration mitigates the problem of undesirably stiff trigger action by allowing the valve spring to be of light design, resulting in an ultra-light trigger pull and smooth and efficient automatic and semi-automatic operation. In addition, the valve slider diameter can be increased without increasing force biasing the valve slider rearward.

BRIEF DESCRIPTION OF THE DRAWINGS

FIG. 65A is a sectional view from the side of a flow control device made according to the present invention, shown with the valve slider in the cocked position.

FIG. 65B is a sectional view from the side of a flow control device made according to the present invention, shown with the valve slider in the rear-most position.

FIG. 66 is a detailed and enlarged sectional view from the side of the floating o-ring-in-groove-type seal of the-flow control device shown in FIG. 65A.

DETAILED DESCRIPTION OF THE PREFERRED EMBODIMENTS

Figure 1:
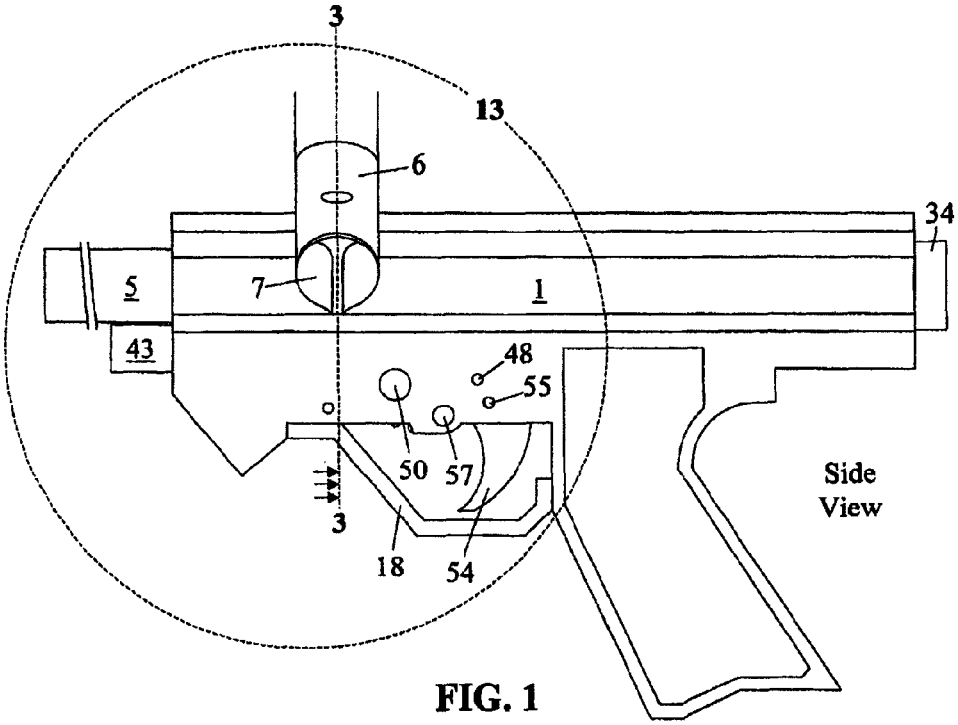
FIG. 1 is a view from the side of a compressed gas-powered projectile accelerator made according to the present invention.
Figure 2:
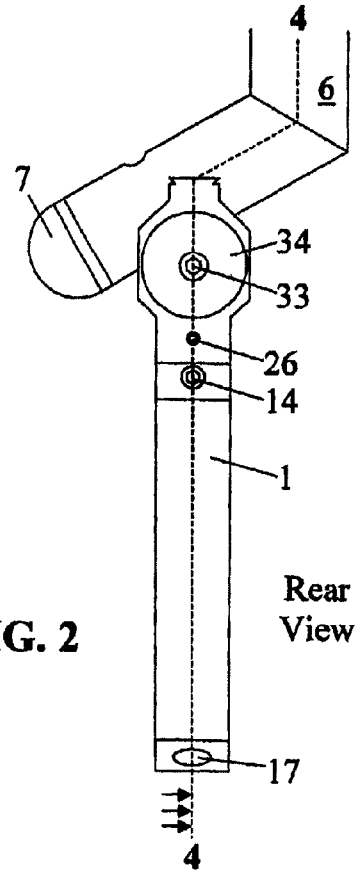
FIG. 2 is a view from the rear of a compressed gas-powered projectile accelerator made according to the present invention.

Several embodiments of a compressed gas-powered projectile accelerator of the present invention is here and in Figures disclosed. For clarity, within this document all reference to the top and bottom of the compressed gas-powered projectile accelerator will correspond to the accelerator as oriented in FIG. 1. Likewise, all reference to the front of said accelerator will correspond to the leftmost part of said accelerator as viewed in FIG. 1, and all reference to the rear of said accelerator will correspond to the rightmost part of said accelerator as viewed in FIG. 1. Referring to the Figures, the gas-powered accelerator of the present invention includes, generally:

A housing 1, preferably made of a single piece, shown in the Figures in the preferred shape of a pistol which is penetrated by hollow passages which contain the internal components.

Figure 4:
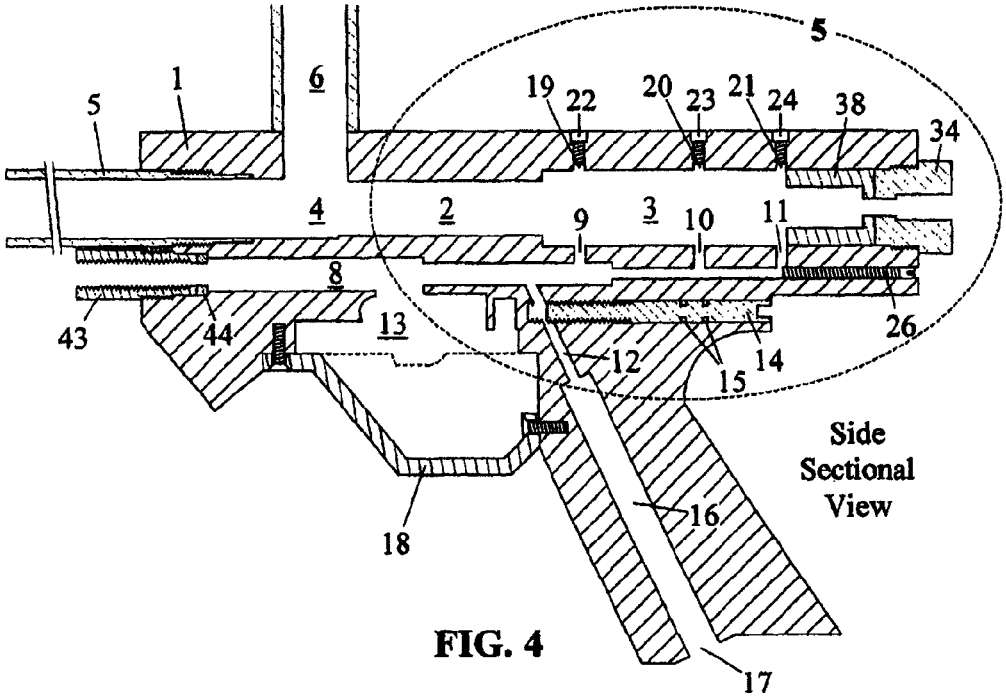
FIG. 4 is a sectional view from the side of a compressed gas-powered projectile accelerator made according to the present invention with internal components removed to show internal cavities and passages.

A preferably cylindrical receiver passage 2 forms a breech 3 and barrel 4, the latter being preferably extended by the addition of a tubular member, hereafter denoted the "barrel extension" 5, which is preferably screwed into the housing 1 or otherwise removably attached. The barrel 4 is intersected by a projectile feed passage 6 into which projectiles are introduced from outside the housing 1. The projectile feed passage 6 may meet the barrel 4 at an angle but preferably may be at least partially vertically inclined to take advantage of gravity to bias projectiles to move into the barrel 4; conversely an alternate bias, such as a spring mechanism may be employed. The projectile feed passage 6 may connect such that its center axis intersects the center axis of the barrel 4, or, as shown in the examples in the Figures, the projectile feed passage 6 center axis can be offset from the center axis of the barrel 4, as long as the intersection forms a hole sufficiently sized for the passage of projectiles from the projectile feed passage 6 into the barrel 4. Also, the breech 3 diameter may optionally be slightly less than that of the barrel 4 immediately rearward of where the projectile feed passage 6 intersects the barrel 4 to help prevent projectiles from sliding or rolling rearward, as shown in FIG. 4. The examples shown in the Figures are designed to introduce spherical projectiles under the action of both gravity and suction, and includes a cap 7 at the end of the projectile feed passage 6 to prevent movement of projectiles beyond the entry point into the barrel 4. This "projectile feed passage cap" 7 can be designed to be rotatable, with a beveled surface at the point of contact with projectiles, such that in one orientation said projectile feed passage cap 7 will facilitate movement of projectiles into the barrel 4, but, when rotated 174.degree. will prevent movement of projectiles into the barrel 4.

Preferably parallel to the receiver passage 2 is a preferably cylindrical valve passage 8 of varying cross section which is connected to the breech 3 by a gas feed passage 9, a bolt rest-point passage 10, and a rear passage 11. The valve passage 8 is intersected by a source gas passage 12 and a trigger cavity 13, which is perforated in several places to allow extension of control components to the exterior of the housing 1. The source gas passage 12 is preferably valved, preferably by the use of a screw 14, the degree to which partially or completely blocks the source gas passage 12 depending on the depth to which the screw 14 has been adjusted into a partially threaded hole in the housing 1, intersecting the source gas passage 12. Alternatively, the gas feed passage 9 may be similarly valved instead of, or in addition to, the source gas passage 12 to control flow both between the source gas passage 12 and breech 3, and between the source gas passage 12 and valve passage 8. The screw 14 must form a seal with the hole in which it sits, preferably by the use of one or more o-rings in grooves 15. The source gas passage 12 will preferably include an expanded section 16 to minimize liquid entry and maximize consistency of entering gas by acting as a plenum. Gas is introduced through the source gas passage inlet 17 at the base of the housing 1, which may be designed to accept any high pressure fitting. A gas cylinder, which may be mounted to the housing 1, preferably to the base of the housing 1 in front of the optional trigger guard 18 illustrated in FIG. 1 or immediately to the rear of the source gas passage inlet 17, may be connected to said fitting, preferably by a flexible high pressure hose. The source gas passage 12 is depicted preferably integrated into the lower rear part of the housing 1 to facilitate manufacture of the housing 1 from a single piece of material, but it is to be appreciated that any orientation of the source gas passage 12, either within the housing 1 or an attachment made to the housing 1 of the compressed gas-powered projectile accelerator of the present invention, will not alter the inventive concepts and principles embodied therein.

Figure 5:
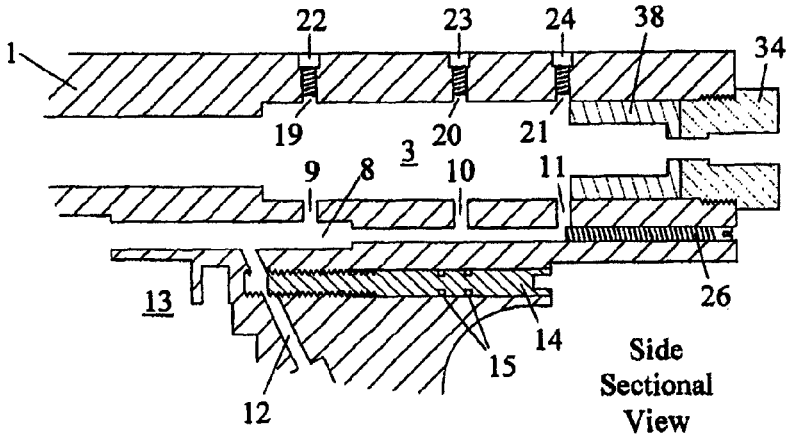
FIG. 5 is a sectional view from the side of upper rear portion of a compressed gas-powered projectile accelerator made according to the present invention shown enlarged, with internal components removed to show internal cavities and passages.
Figure 6:
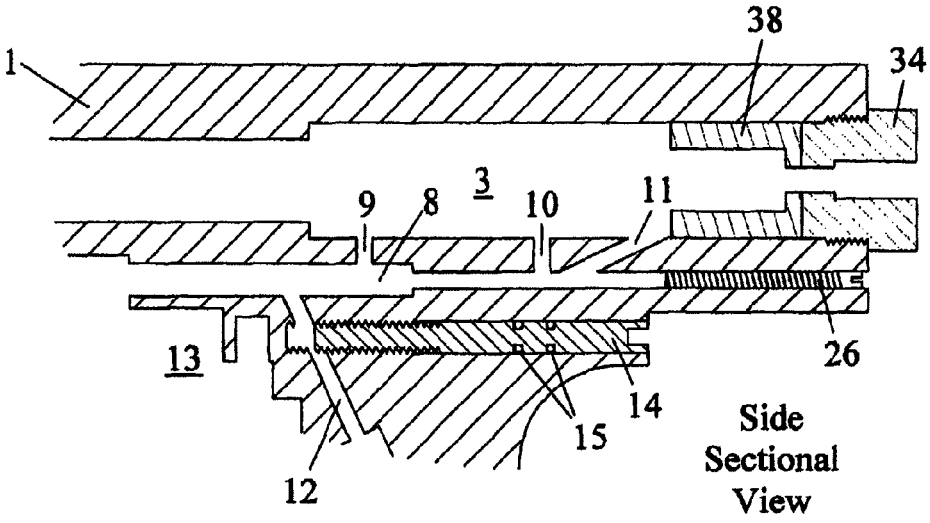
FIG. 6 is a sectional view from the side of upper rear portion of a compressed gas-powered projectile accelerator made according to the present invention shown enlarged where test/bleed ports have been eliminated by welding and strategic orientation of the rear passage, with internal components removed to show internal cavities and passages.
Figure 7:
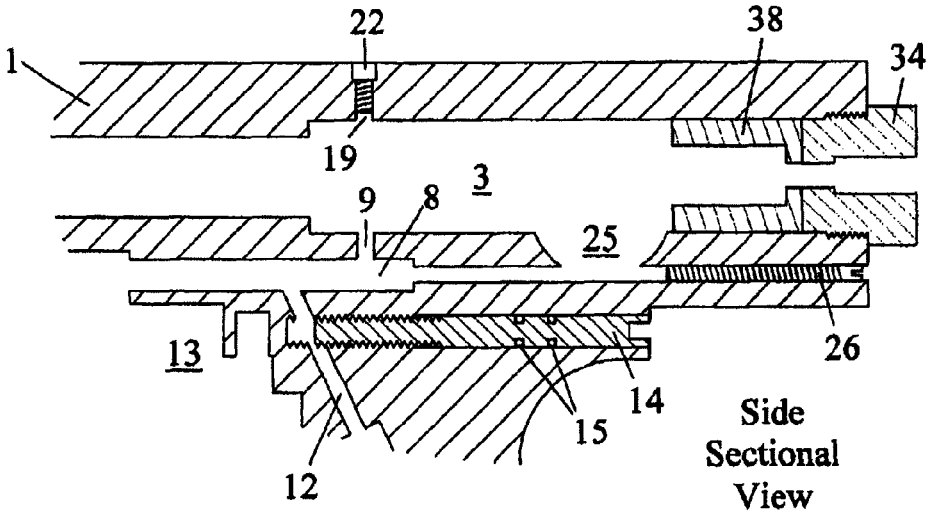
FIG. 7 is a sectional view from the side of upper rear portion of a compressed gas-powered projectile accelerator made according to the present invention shown enlarged where the bolt rest-point passage and rear passage have been replaced by a slot, eliminating corresponding perforations in the upper housing, with internal components removed to show internal cavities and passages.

A sectional view from the side of the housing with most internal components removed is shown in FIG. 4 for clarity. Optional test/bleed ports 19, 20, 21 are shown connecting the breech 3 to the outside of the housing 1, blocked by removable plugs 22, 23, 24 because they are formed as part of manufacture of the gas feed passage 9, bolt rest-point passage 10, and rear passage 11 of this preferred embodiment. Said ports 19, 20, 21 and plugs 22, 23, 24 are optional because they are not required for correct function of the projectile accelerator of the present invention. Said ports 19, 20, 21 may be eliminated from the design by a variety of means, such as the welding shut of said ports 19, 20, 21, use of special tooling, or by strategic routing of the gas feed passage 9, the bolt rest-point passage 10, and/or, in particular, the rear passage 11 which may be oriented such that it may be drilled either from the rear of the breech 3 or from the bottom. The breech 3 is shown enlarged in FIG. 5. In FIG. 6 the breech 3 is shown in detail with the front test/bleed port 19 and middle test/bleed port 20 eliminated by welding and rear passage 11 oriented such that it may be manufactured without additional perforation of the breech 3 or need of special tooling such as a small right-angle drill. A third option is shown in FIG. 7 where the bolt rest-point passage 10, and rear passage 11 are replaced by a single slot 25, eliminating the corresponding perforations at the top of the breech 3.

Passages 9, 10, 11 and/or bleed/test ports 19, 20, 21 may be individually optionally valved to control gas flow, preferably by the use of screws, the degree to which partially or completely block the passage or passages 9, 10, and/or 11, and/or bleed/test ports 19, 20, and/or 21, depending on the depth to which the screws have been adjusted into threaded holes appropriately made in the housing 1, intersecting the passage or passages 9, 10, and/or 11 and/or ports 19, 20, and/or 21. The preferred embodiment depicted in the Figures herein includes an exemplary valve screw 26 at the junction between the rear passage 11 and valve passage 8.

Figure 8:
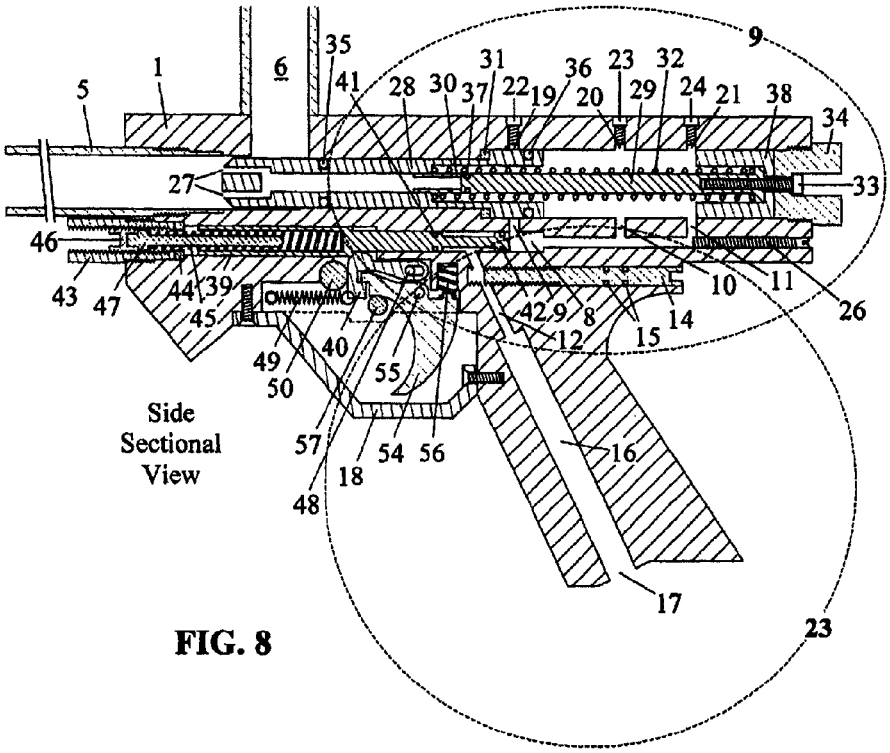
FIG. 8 is a sectional view from the side of a compressed gas-powered projectile accelerator made according to the present invention.
Figure 9:
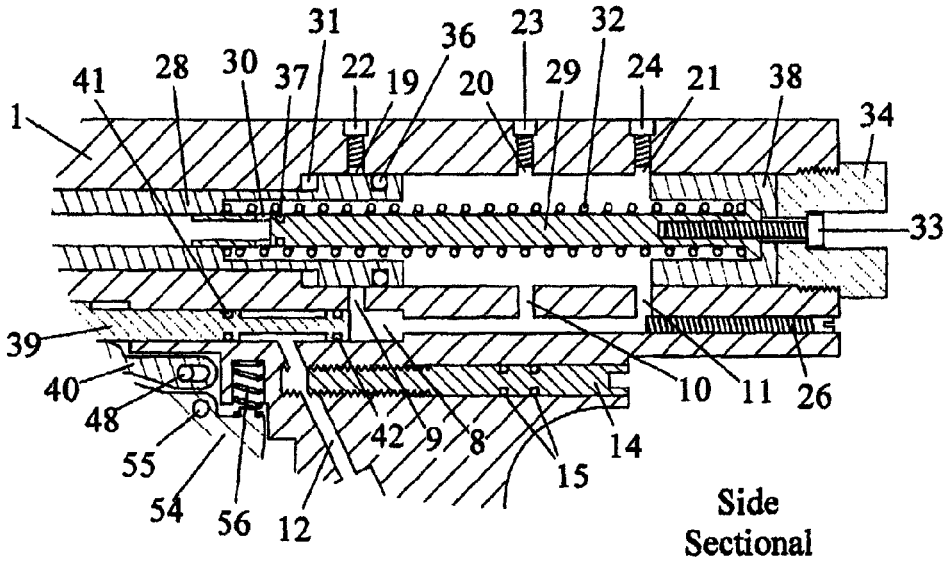
FIG. 9 is a sectional view from the side of the upper rear portion of a compressed gas-powered projectile accelerator made according to the present invention shown in detail with purge holes in the spring guide.
Figure 9A:
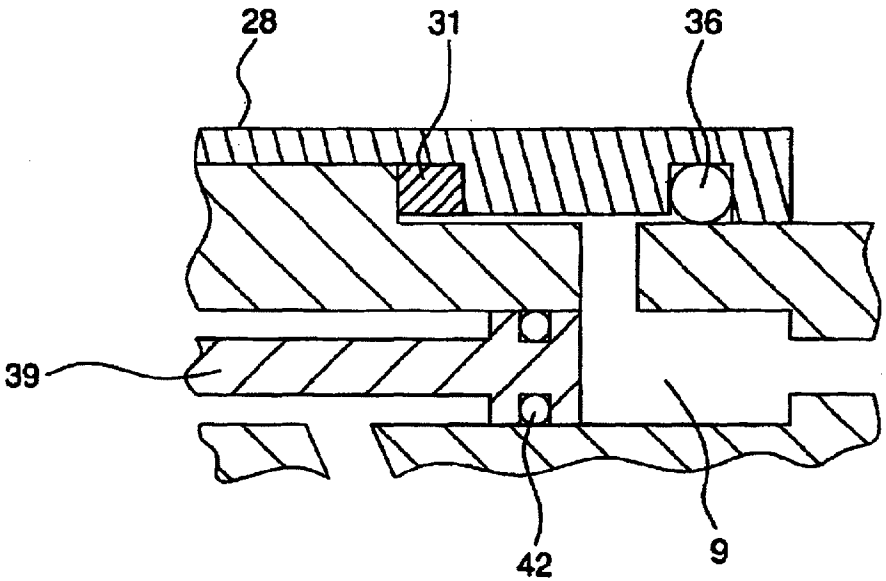
FIG. 9(A) is a detailed and enlarged view of the compressed gas-powered projectile accelerator shown in FIG. 9.

Referring now to FIG. 8, a hollow slider, having one or, as shown in FIG. 8, a plurality of holes 27 on the front surface, matching the shape of the barrel 4 and breech 3, preferably free to rotate about a central axis parallel to the receiver passage 2 to minimize wear, and preferably made of a single piece, generally referred to as a bolt 28, can slide within the receiver passage 2 and around a preferably cylindrical spring-guide 29, which has a hollow space at the forward end which communicates with said forward end a plurality of holes about its circumference which allow compressed gas to pass through the bolt 28 and will hence be denoted "purge holes" 30. A preferably elastic bumper or "bolt bumper" 31 is attached to the bolt 28 at a point where the bolt 28 changes diameter, limiting its forward travel and easing shock in the event of malfunction. (The projectile accelerator of the present invention can be designed such that the bolt 28 does not experience high impact against the housing 1.) A spring or "bolt spring" 32 surrounds the spring-guide 29, which is attached, preferably by a screw 33 to a removable breech cap 34, which closes the rear of the breech 3, preferably by being screwed into the housing 1. The bolt 28 and spring guide 29 are shown with preferable o-ring/groove type gas seals 35, 36, 37, although the type of sealing required at these locations is arbitrary. A preferably cylindrical elastic bumper 38 which protects the bolt 28 and breech cap 34 in the event of malfunction is held in place between the spring guide 29 and breech cap 34, partially surrounding the bolt spring 32 and spring guide 29. The breech cap 34, bumper 38, spring guide 29, bolt spring 32, and rear part of the bolt 28 and housing 1 are shown in detail in FIG. 9. FIG. 9(A) is an enlarged and detailed view of the bolt 28, bumper 38, bolt sprint 32, bolt rear seal 36, gas feed passage 9, and valve slider 39, of the present invention.

Figure 10:
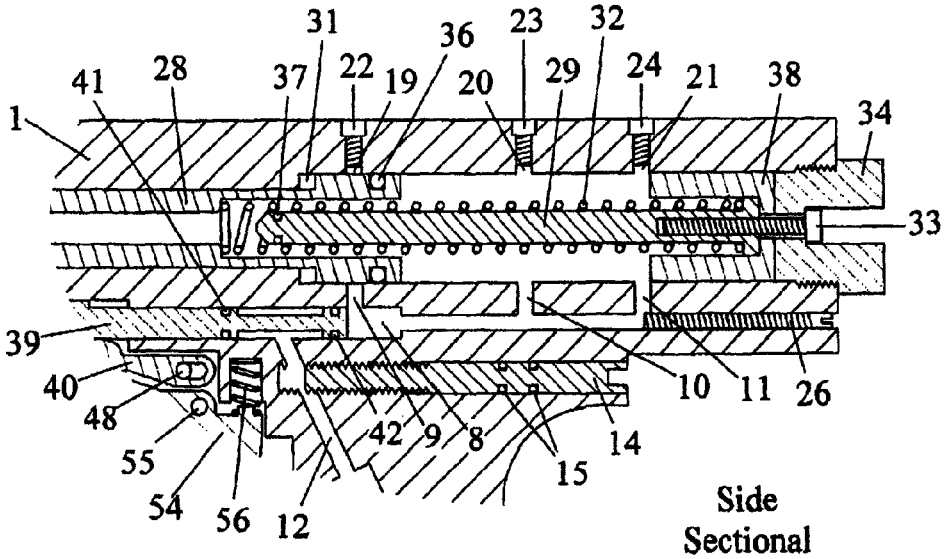
FIG. 10 is a sectional view from the side of the upper rear portion of a compressed gas-powered projectile accelerator made according to the present invention shown in detail with a truncated spring guide eliminating need for purge holes.
Figure 11:
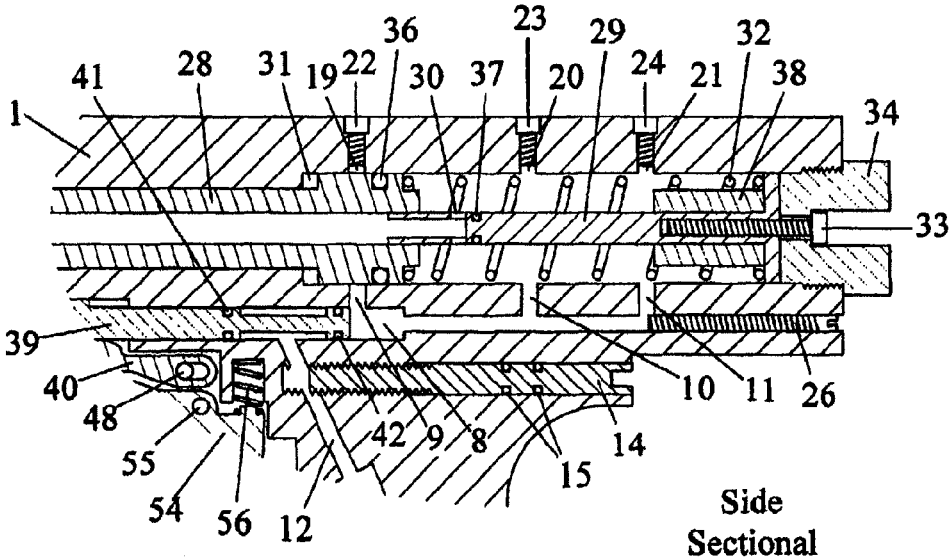
FIG. 11 is a sectional view from the side of the upper rear portion of a compressed gas-powered projectile accelerator made according to the present invention shown in detail with purge holes in the spring guide and an enlarged bolt spring.
Figure 12:
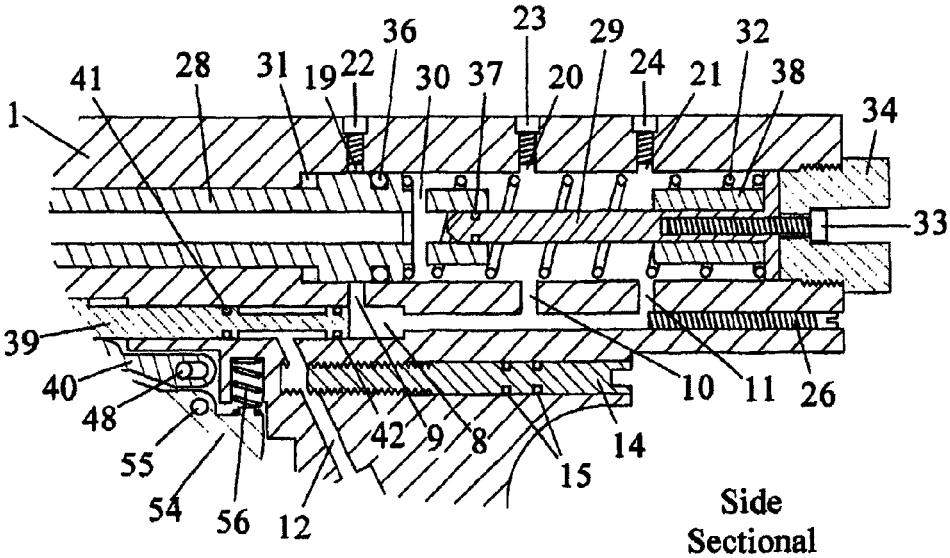
FIG. 12 is a sectional view from the side of the upper rear portion of a compressed gas-powered projectile accelerator made according to the present invention shown in detail with a truncated spring guide, an enlarged bolt spring, and purge holes in the bolt instead of the spring guide.
Figure 13:
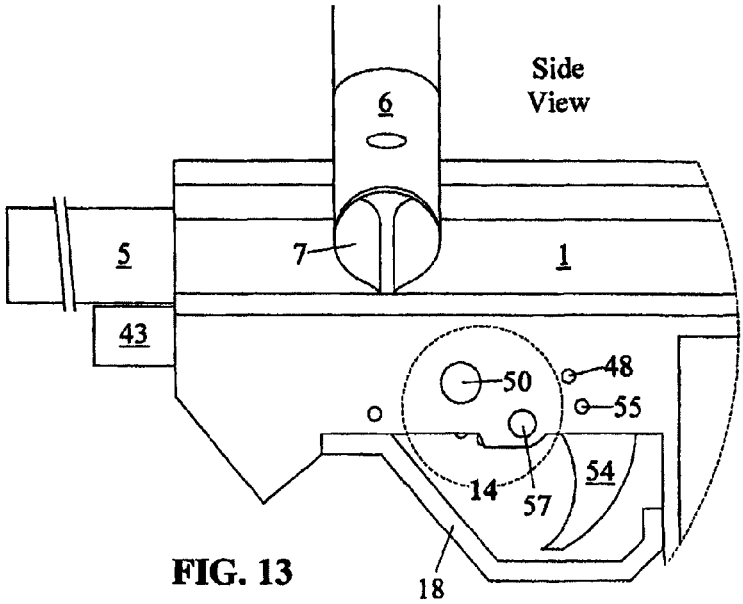
FIG. 13 is a view from the side of the front portion of a compressed gas-powered projectile accelerator made according to the present invention shown in detail.

Alternate configurations of these components are shown in detail in FIG. 10, where instead of having a hollow space at the forward end and purge holes 30, the spring guide 29 is truncated to allow the passage of gas through the bolt 28; FIG. 11, where the bolt spring 32 diameter is in detail to reduce wear on the spring guide o-ring 37 (or other seal type) and the bumper 38 resides partly inside the bolt spring 32; and FIG. 12, where the spring guide 29 is again truncated and the purge holes 30 are incorporated into the rear part of the bolt 28.

A partially hollow slider or "valve slider" 39 matching the shape of the valve passage 8 as shown in FIG. 8, preferably free to rotate about its axis parallel to the receiver passage 2 to minimize wear, particularly from contact with the sear 40 described below, can slide within the valve passage 8. The valve slider 39 forms seals with the valve passage 8 at two points—where single o-ring/groove type seals 41, 42 are shown for illustration, but multiple o-rings or any other appropriate type of seal may be used; e.g. use of a flexible material such as polytetrafluoroethylene at these points to form surface-to-surface seals in lieu of o-rings can potentially reduce wear on these seals 41, 42.

A preferably removable hollow valve passage cap 43, preferably screwed into the housing 1, traps an optional bumper or "valve bumper" 44 which protects the valve passage cap 43 from wear by contact with the valve slider 39 and vice-versa.

Figure 14:
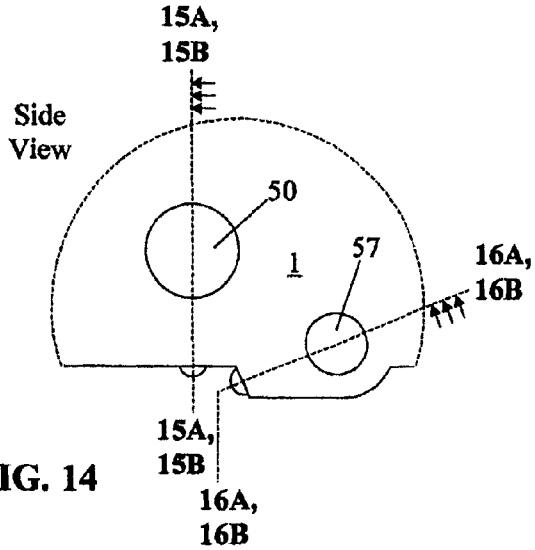
FIG. 14 is a view from the side of the region in the vicinity of the trigger of a compressed gas-powered projectile accelerator made according to the present invention shown in detail.
Figure 15A:
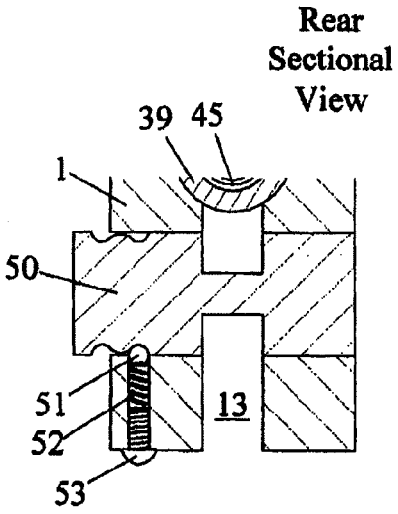
FIGS. 15A and 15B are sectional views from the rear of the region in the vicinity of the trigger of a compressed gas-powered projectile accelerator made according to the present invention showing the mode-selector cam in the semi-automatic and fully-automatic positions, respectively, with ball and spring retention assembly, shown in detail.
Figure 15B:
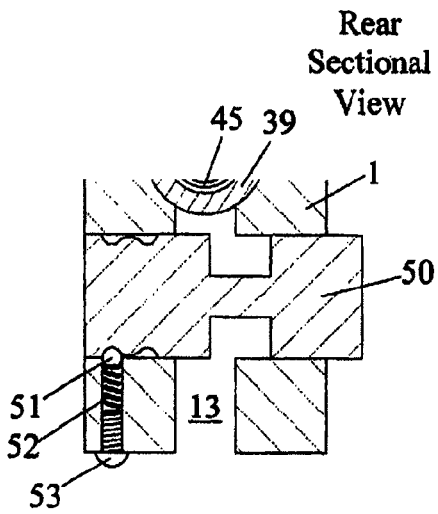

A spring or "valve spring" 45 within the valve passage 8, which may be accepted partially within the valve slider 39, and valve passage cap 43, pushes against the valve slider 39 and against a screw 46 preferably threaded inside of the valve passage cap 43, the position of which may be adjusted to increase or decrease tension in the spring 45, thereby adjusting the operating pressure of the cycle and magnitude of projectile acceleration. An optional internal guide 47 for the valve spring can be added. The valve slider 39 can be held in a forward "cocked" position by a sear 40, which can rotate about and slide on a pivot 48. A spring 49 maintains a bias for the sear 40 to slide forward and rotate toward the valve slider 39. Sliding travel of the sear 40 can be limited by means of a preferably cylindrical sliding cam or "mode selector cam" 50 of varying diameter shown in detail in FIGS. 14, 15A, and 15B, the positions corresponding to semi-automatic and fully-automatic being shown in FIGS. 15A and 15B, respectively. Position of the mode selector cam 50 is maintained and its travel limited by the ball 51 and spring 52 arrangement shown, which are retained within the housing 1 by the screw 53 shown.

Figure 16A:
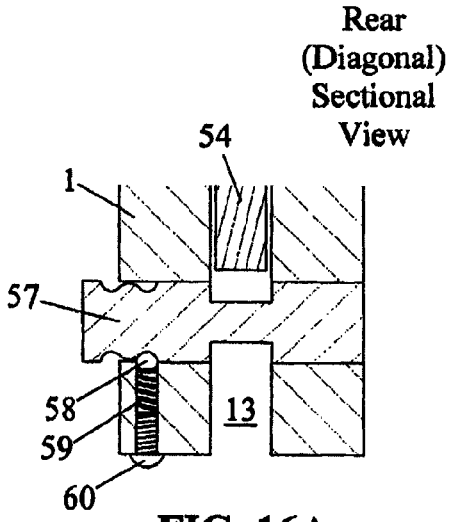
FIGS. 16A and 16B are sectional views of the region in the vicinity of the trigger of a compressed gas-powered projectile accelerator made according to the present invention, as viewed diagonally from the lower rear, showing the safety cam in the non-firing and firing positions, respectively, with ball and spring retention assembly, shown in detail.
Figure 16B:
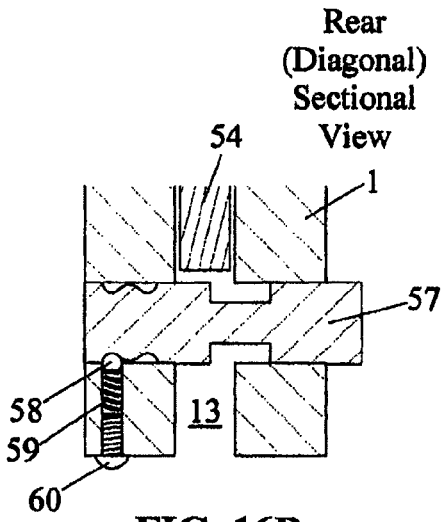

A lever or "trigger" 54 which rotates on a pivot 55 can press upon the sear 40, inducing rotation of the sear 40. A bias of the trigger 54 to rotate toward the sear 40 (clockwise in FIG. 8) is maintained by spring 56. Rotation of the trigger 54 can be limited by means of a preferably cylindrical sliding cam or "safety cam" 57 of varying diameter shown in detail in FIGS. 14, 16A, and 16B, the firing and non-firing positions being shown in FIGS. 16A and 16B, respectively. Position of the safety cam 57 is maintained and its travel limited by the ball 58 and spring 59 arrangement shown, which are preferably retained within the housing 1 by the screw 60 shown.

Figure 17A:
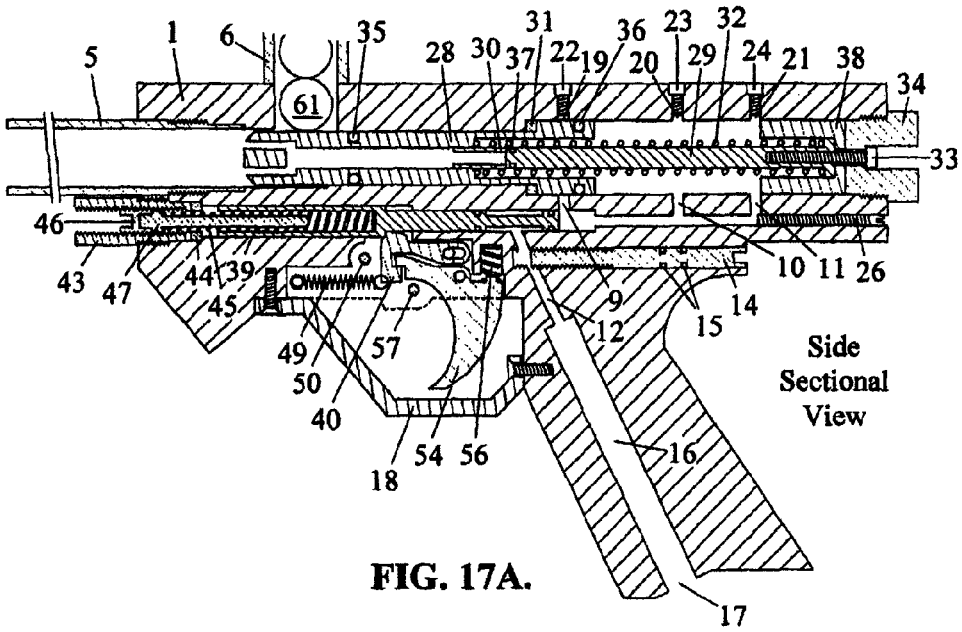
FIGS. 17A-I are sectional views from the side of a compressed gas-powered projectile accelerator made according to the present invention, illustrating semi-automatic operation.

Semi-automatic operation of the compressed gas-powered projectile accelerator of the present invention is here described:

The preferred ready-to-operate configuration for semi-automatic operation is shown in FIG. 17A, with the valve slider 39 in its cocked position, resting against the sear 40, which, under the pressure of the valve spring 45 translated through the valve slider 39, rests in its rearmost position. The safety cam 57 is positioned to allow the trigger 54 to rotate freely. The mode selector cam 50 is positioned so as to not restrict the forward travel of the sear 40. The smaller diameters of the safety cam 57 and mode selector cam 50 are shown in this cross section, as said smaller diameters represent the portions of these components interacting with the trigger 54 and sear 40, respectively. A projectile 61 is positioned to enter the barrel 4. The illustrated projectile is a spherical projectile 61 as an example. The projectile 61 is prevented from entering the barrel 4 by interference with the bolt 28.

Figure 17B:
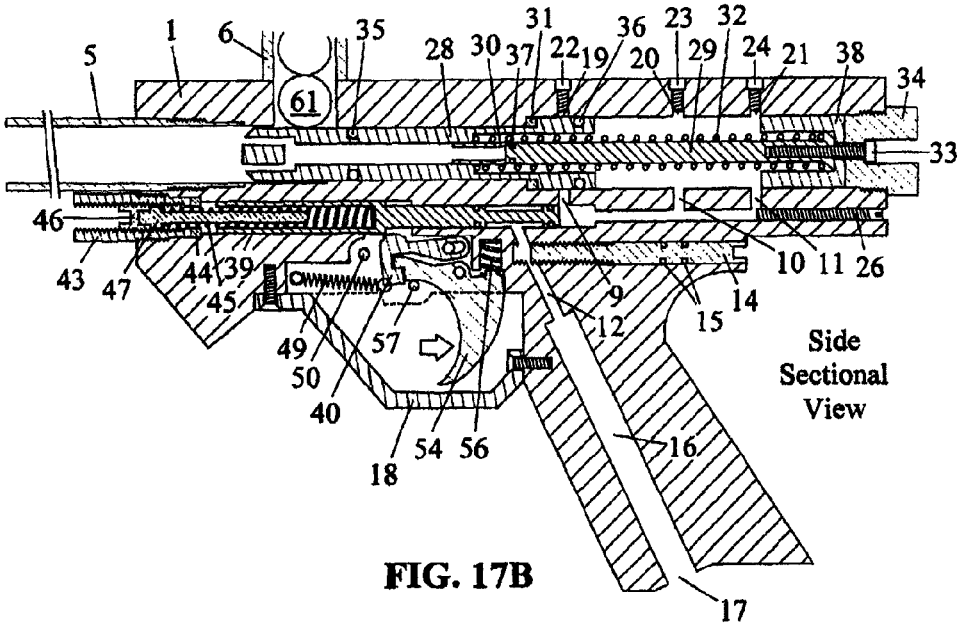

The trigger 54 is then pulled rearward, pulling the sear 40 downward, disengaging it from the valve slider 39, as shown in FIG. 17B.

Figure 17C:
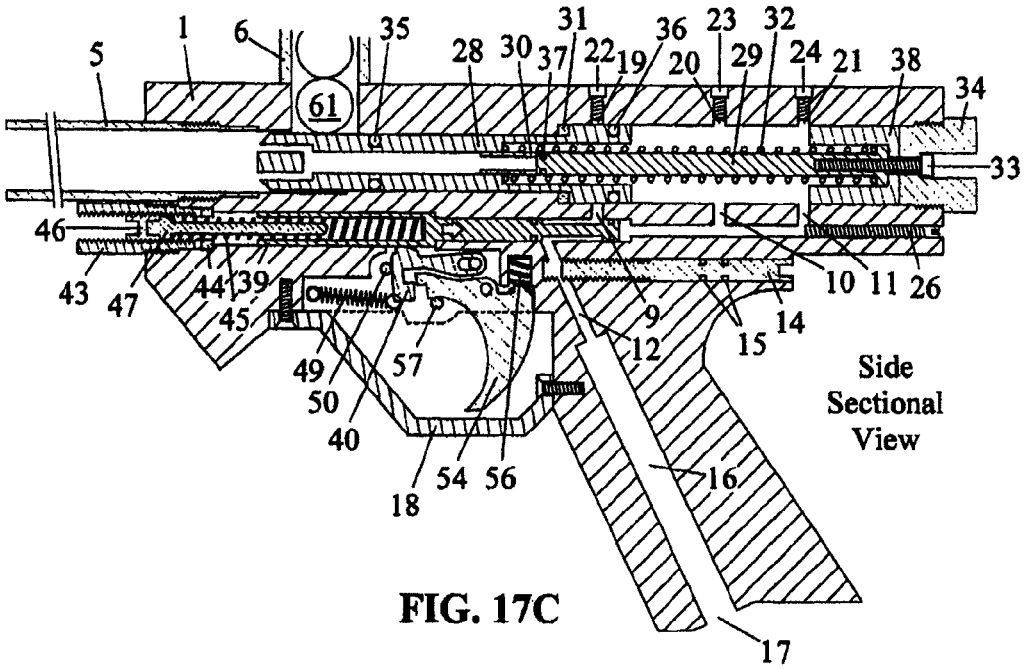

Shown in FIG. 17C, under the force applied by the valve spring 45, the valve slider 39 then slides rearward, until it is stopped preferably by mechanical interference with the changing diameter of the valve passage 8, allowing gas to flow through the gas feed passage 9 into the region of the breech 3 ahead of the bolt rear seal 36. Simultaneously, the sear 40 is caused to slide forward and rotate (clockwise in the drawing) by the sear spring 49, coming to rest against the valve slider 39, being now disengaged from the trigger 54.

Figure 17D:
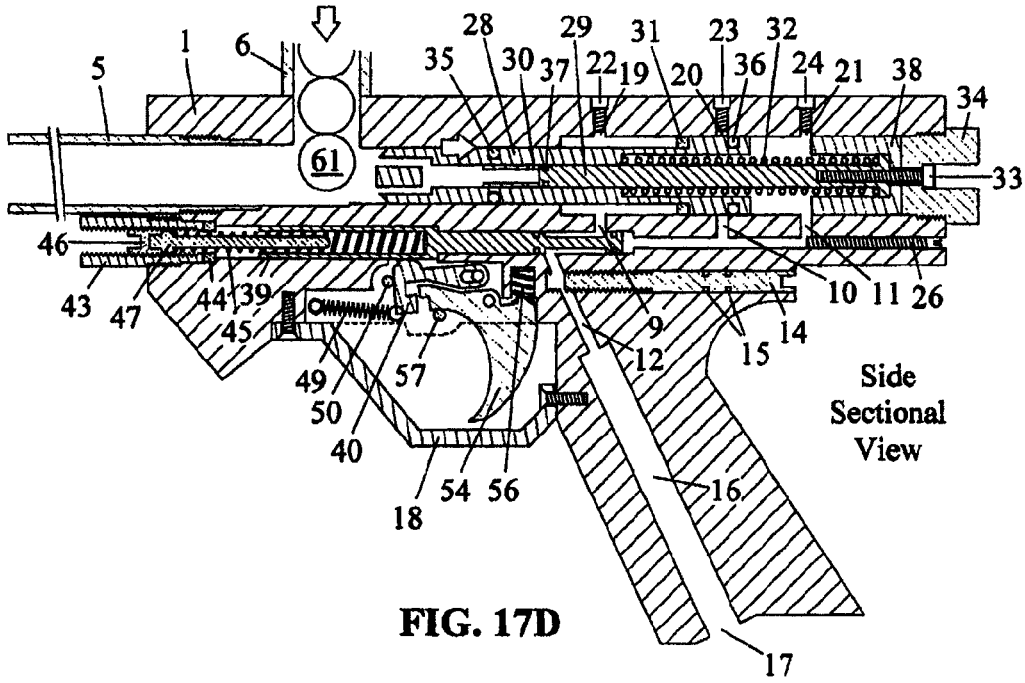

Shown in FIG. 17D, the pressure of the gas causes the bolt 28 to slide rearward, until the bolt rear seal 36 passes the front edge of bolt rest-point passage 10, opening a flow path, and allowing gas into the bolt rest-point passage 10, valve passage 8 rearward of the valve slider 39, rear passage 11, and region of the breech 3 to the rear of the bolt 28. The externally applied bias of the projectile 61 to enter the barrel 4, here assumed to be gravity as an example, acts to push a projectile 61 into the barrel 4, aided by the suction induced by the motion of the bolt 28. Additional projectiles in the projectile feed passage 6 are blocked from entering the barrel 4 by the projectile 61 already in the barrel 4. The combined force of the bolt spring 32 and the pressure behind the bolt 28 bring the bolt 28 to rest, preferably without contacting the breech cap bumper 38 at the rear of the breech 3. The breech 3, valve passage 8 rearward of the valve slider 39, and all contiguous cavities not isolated by seals within the housing 1 may here be recognized as the intermediate reservoir discussed in the background of the invention. The bolt 28 will remain approximately at rest, where its position will only adjust slightly to allow more or less gas through the bolt rest-point passage 10 as required to maintain a balance of pressure and spring forces on it while the pressure continues to increase.

Figure 17E:
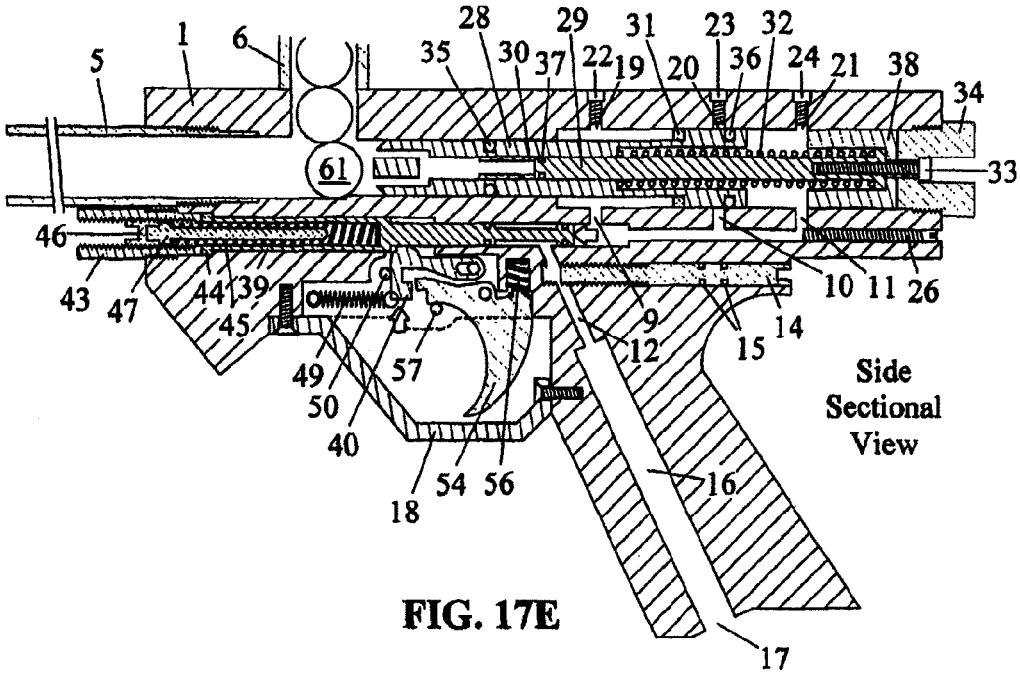

Shown in FIG. 17E, once the pressure in the valve passage 8 rearward of the valve slider 39 has increased sufficiently to overcome the force of the valve spring 45 on the valve slider 39, the valve slider 39 will be pushed forward until it contacts the valve bumper 44 if present, or valve passage cap 43 if no valve bumper 44 is present, thereby simultaneously stopping the flow of compressed gas from the source gas passage 12, and allowing the flow of gas from the region of the breech 3 ahead of the bolt rear seal 36 through the feed passage, into the valve passage 8 rearward of the valve slider 39, which is in communication with the region of the breech 3 behind the bolt 28. The sear 40, under the action of the sear spring 49, will rotate further (clockwise in the drawing) once the largest diameter section of the valve slider 39 has traveled sufficiently far forward to allow this, coming to rest against the portion of the valve slider 39 rearward of its said largest diameter section.

Figure 17F:
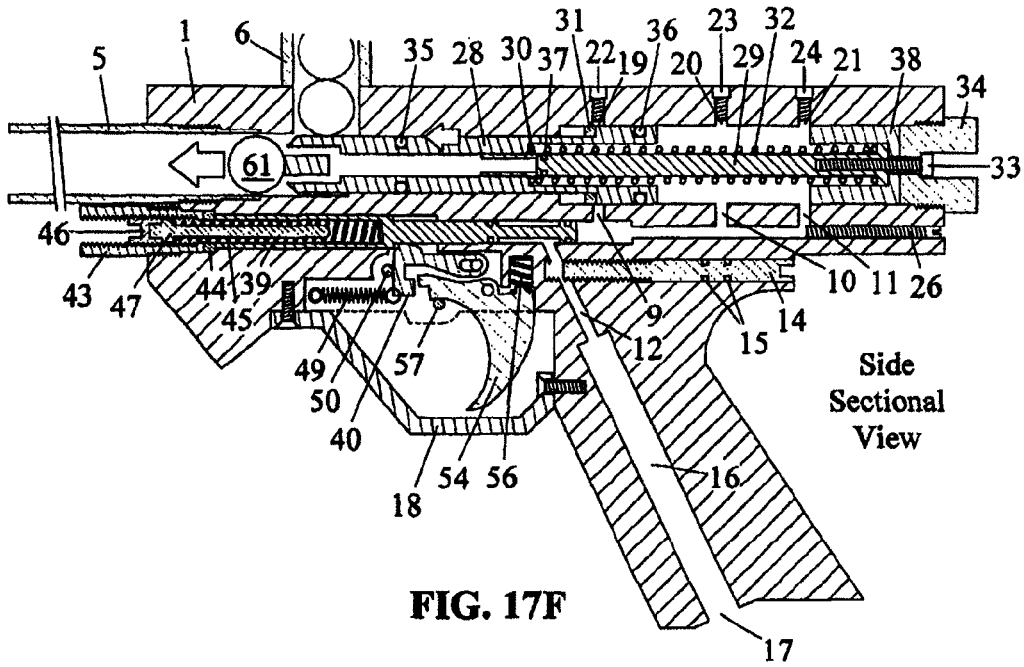

The bolt 28 is then driven forward by now unbalanced pressure and spring forces on its surface, pushing the projectile 61 forward in the barrel 4 and blocking the projectile feed passage 6, preventing the entry of additional projectiles. When the bolt 28 reaches the position shown in FIG. 17F, gas flows through the purge holes 30 in the spring guide 29, through the center of the bolt 28, and through the plurality of holes 27 on the front surface of the bolt 28, which distribute the force of the flowing gas into uniform communication with the rear surface of the projectile 61.

Figure 17G:
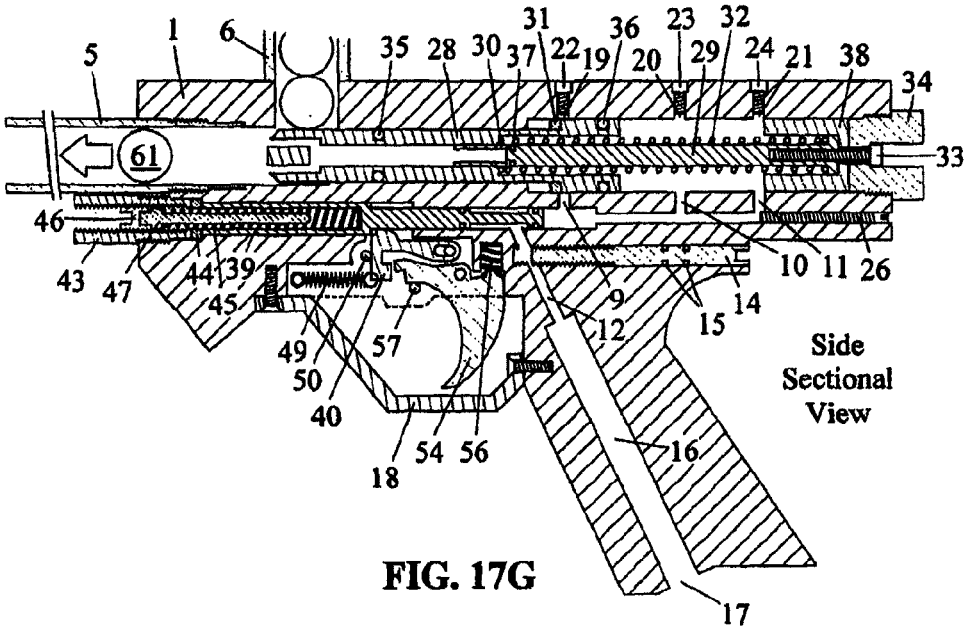
Figure 17H:
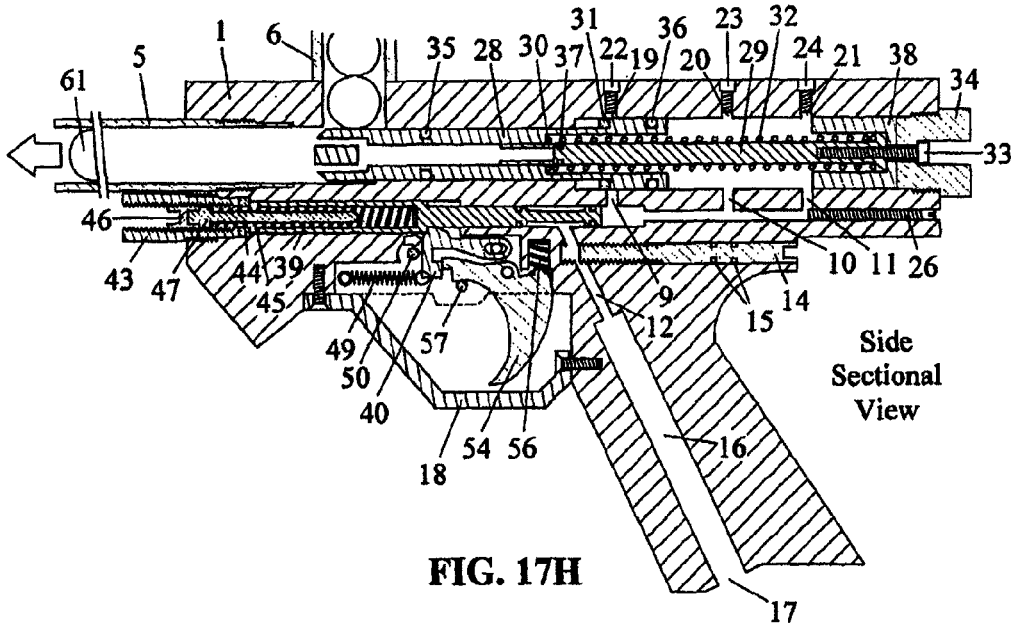

Shown in FIG. 17G and further in FIG. 17H, the action of the gas pressure on the projectile 61 will cause it to accelerate through and out of the barrel 4 and barrel extension 5, at which time the barrel, barrel extension 5, breech 3, valve passage 8 rearward of the valve slider 39, and all communicating passages which are not sealed will vent to atmosphere.

Shown in FIG. 17H, when the pressure within the valve passage 8 rearward of the valve slider 39 has been reduced to sufficiently low pressure such that the force induced on the valve slider 39 no longer exceeds that of the valve spring 45, the valve slider 39 will slide rearward until its motion is restricted by the sear 40. The sear 40 will rest against the front of the trigger 54, and may exert a (clockwise in drawing) torque helping to restore the trigger 54 to its resting position, depending on the design of the position of the trigger pivot 55 relative to the point of contact with the valve slider 39.

Figure 17I:
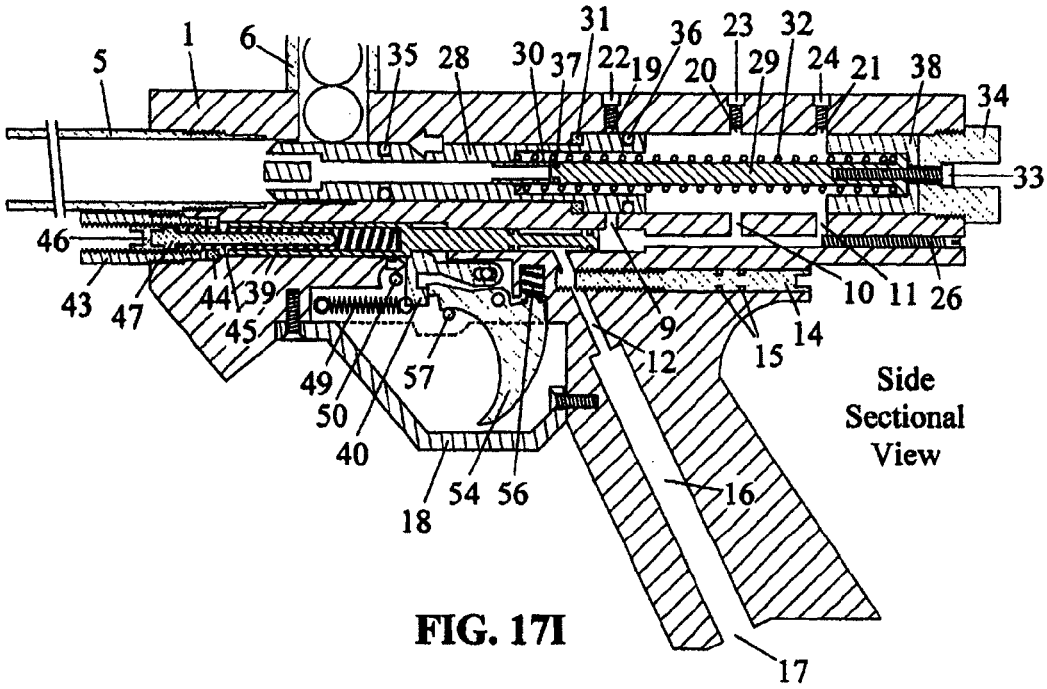

Under the action of the bolt spring 32, the bolt 28 will continue to move forward, compressing gas within the space ahead of the bolt rear seal 36 in so doing, and, allowing only a small gap by which the gas may escape into the valve passage 8, the bolt 28 will be decelerated, minimizing wear on the bolt bumper 31 and stopping in its preferred resting position, as shown in FIG. 17I.

When the trigger 54 is released, the action of the trigger spring 56, sear spring 49, and valve spring 45 will return the components to the preferred ready-to-fire configuration, shown in FIG. 17A.

Figure 18A:
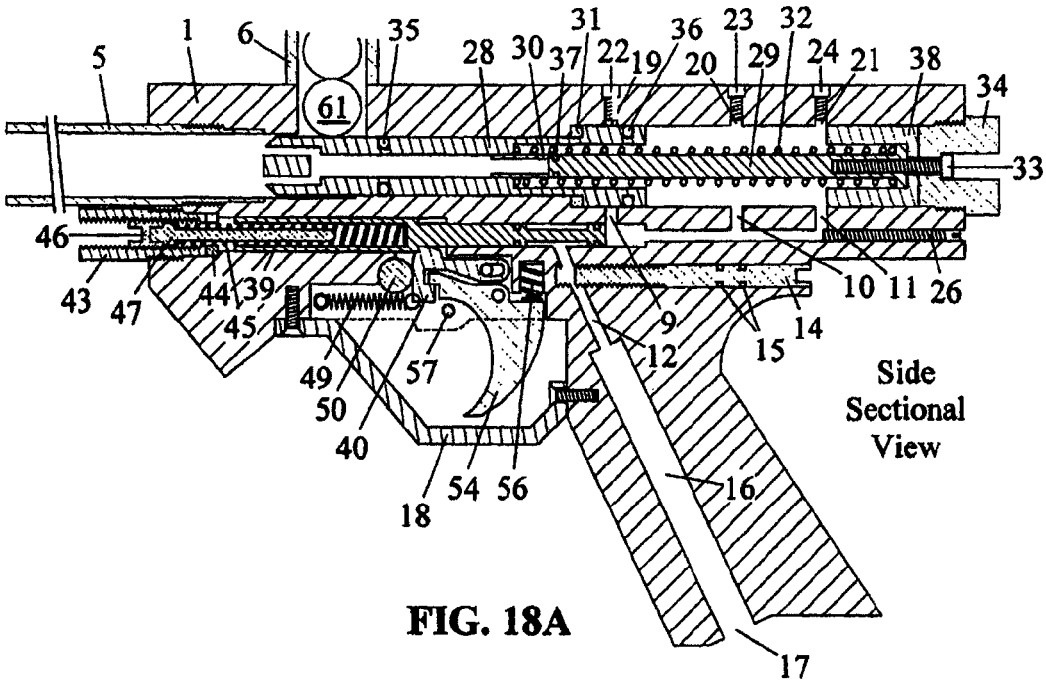
FIGS. 18A-H are sectional views from the side of a compressed gas-powered projectile accelerator made according to the present invention, illustrating fully-automatic operation.

Fully-Automatic Operation of the Compressed Gas-Powered Projectile Accelerator of the Present Invention is Here Described:

The preferred ready-to-operate configuration for fully-automatic operation is shown in FIG. 18A, with the valve slider 39 in its cocked position, resting against the sear 40, which, under the pressure of the valve spring 45 translated through the valve slider 39, rests in its rearmost position. The safety cam 57 is positioned to allow the trigger 54 to rotate freely. The mode selector cam 50 is positioned so as to restrict the forward travel of the sear 40. The smaller diameter of the safety cam 57 and larger diameter of the mode selector cam 50 are shown in this cross section, as said diameters represent the portions of these components interacting with the trigger 54 and sear 40, respectively. A projectile 61 with an arbitrary externally applied bias to enter the barrel 4, here a spherical projectile being used as an example, is prevented from entering the barrel 4 by interference with the bolt 28.

Figure 18B:
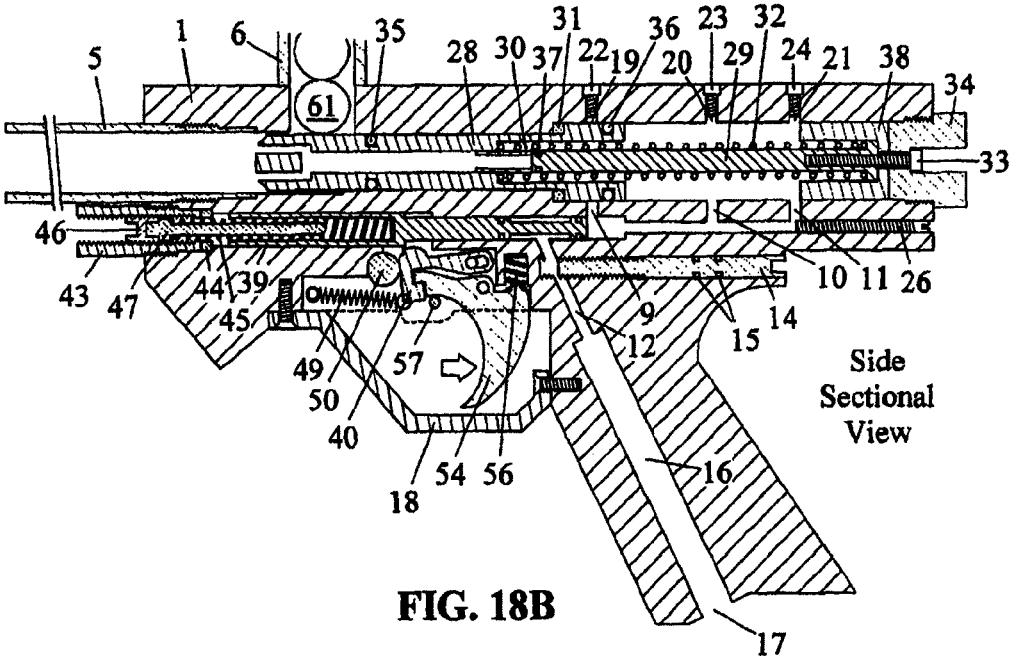

The trigger 54 is then pulled rearward, pulling the sear 40 downward, disengaging it from the valve slider 39, as shown in FIG. 18B.

Figure 18C:
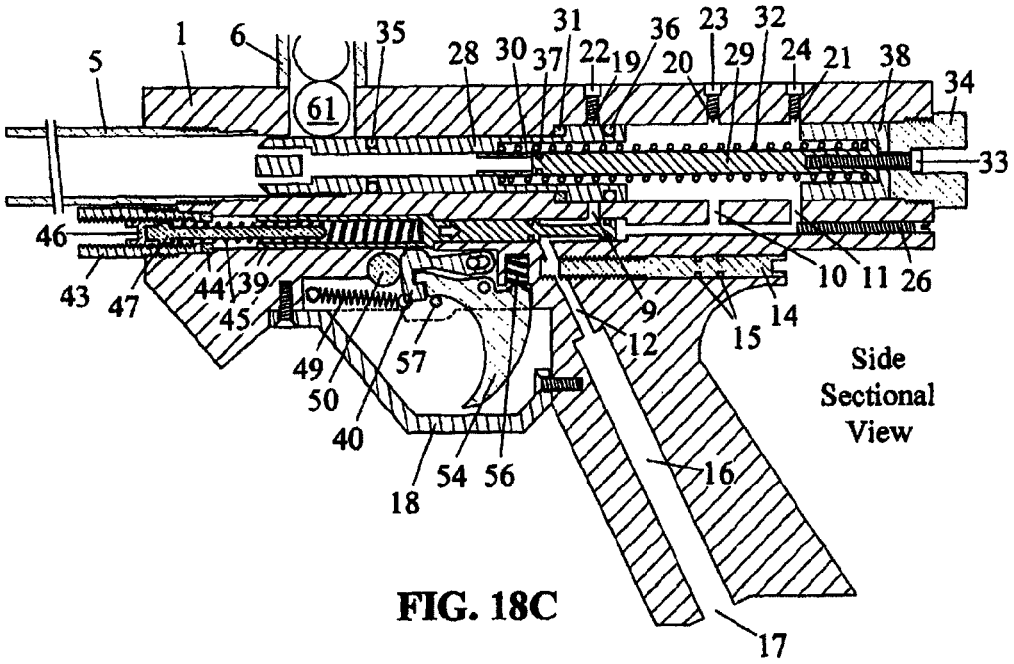

Shown in FIG. 18C, under the force applied by the valve spring 45, the valve slider 39 then slides rearward, until it is stopped preferably by mechanical interference with the changing diameter of the valve passage 8, allowing gas to flow through the gas feed passage 9 into the region of the breech 3 ahead of the bolt rear seal 36. The mode selector cam 50 prevents the sear 40 from sliding forward sufficiently far to disengage from the trigger 54.

Figure 18D:
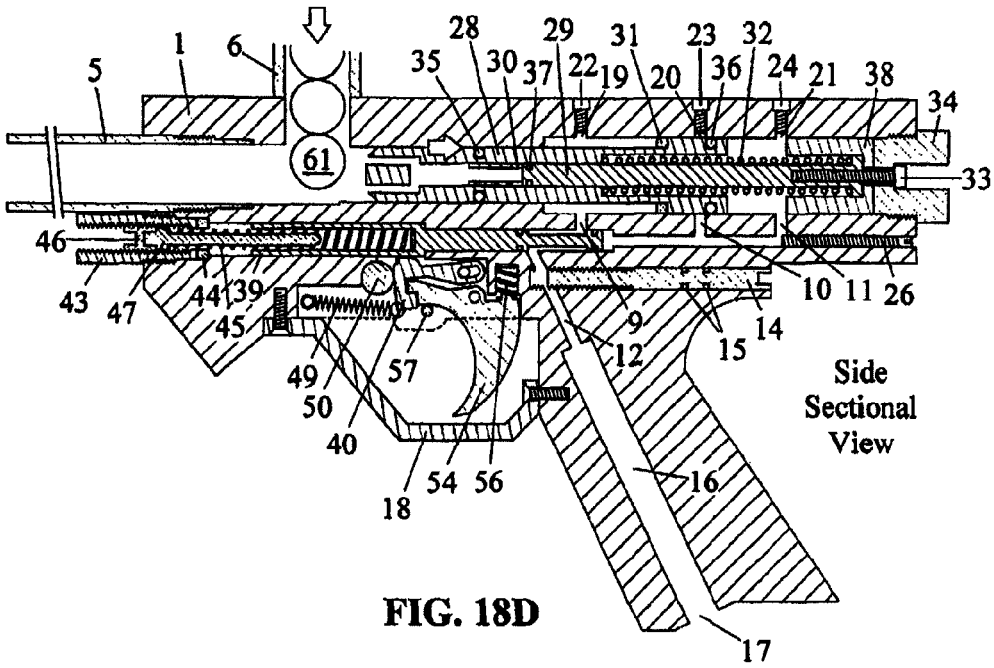

Shown in FIG. 18D, the pressure of the gas causes the bolt 28 to slide rearward, until the bolt rear seal 36 passes the front edge of the bolt rest-point passage 10, allowing gas into the bolt rest-point passage 10, valve passage 8 rearward of the valve slider 39, rear passage 11, and region of the breech 3 behind the bolt 28. The externally applied bias of the projectile 61 to enter the barrel 4, here assumed to be gravity as an example, acts to push a projectile 61 into the barrel 4, aided by the suction induced by the motion of the bolt 28. Additional projectiles in the projectile feed passage 6 are blocked from entering the barrel 4 by the projectile 61 already in the barrel 4. The combined force of the bolt spring 32 and the pressure behind the bolt 28 bring the bolt 28 to rest, preferably without contacting the breech cap bumper 38 at the rear of the breech 3. The breech 3, valve passage 8 rearward of the valve slider 39, and all contiguous cavities not isolated by seals within the housing 1 may here be recognized as the intermediate reservoir discussed in the background of the invention. The bolt 28 will remain approximately at rest, where its position will only adjust slightly to allow more or less gas through the bolt rest-point passage 10 as required to maintain a balance of pressure and spring forces on it while the pressure continues to increase.

Figure 18E:
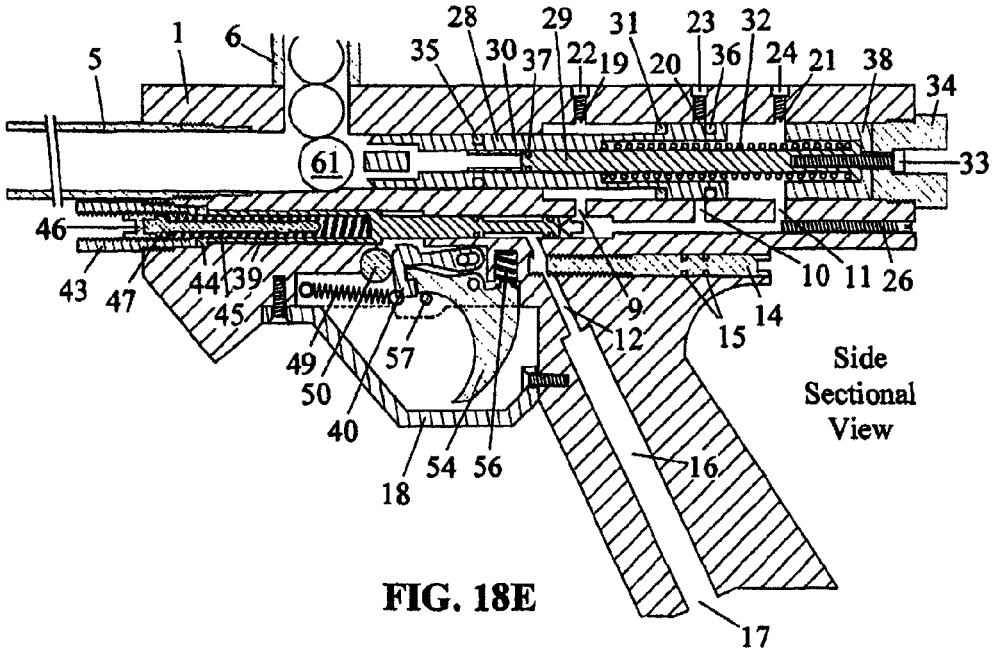

Shown in FIG. 18E, once the pressure in the valve passage 8 rearward of the valve slider 39 has increased sufficiently to overcome the force of the valve spring 45 on the valve slider 39, the valve slider 39 will be pushed forward until it contacts the valve bumper 44 if present, or valve passage cap 43 if no valve bumper 44 is present, thereby simultaneously stopping the flow of compressed gas from the source gas passage 12, and allowing the flow of gas from the region of the breech 3 ahead of the bolt rear seal 36 through the feed passage, into the valve passage 8 rearward of the valve slider 39, which is in communication with the region of the breech 3 behind the bolt 28.

Figure 18F:
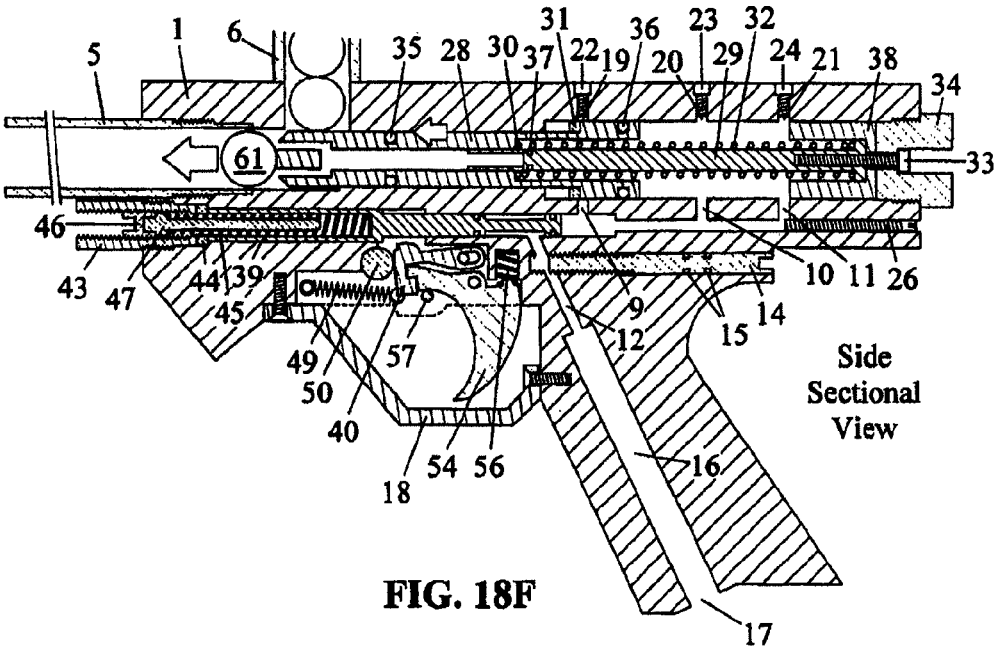

The bolt 28 is then driven forward by now unbalanced pressure and spring forces on its surface, pushing the projectile 61 forward in the barrel 4 and blocking the projectile feed passage 6, preventing the entry of additional projectiles. When the bolt 28 reaches the position shown in FIG. 18F, gas flows through the purge holes 30 in the spring guide 29, through the center of the bolt 28, and through the plurality of holes 27 on the front surface of the bolt 28, which distribute the force of the flowing gas into uniform communication with the rear surface of the projectile 61.

Figure 18G:
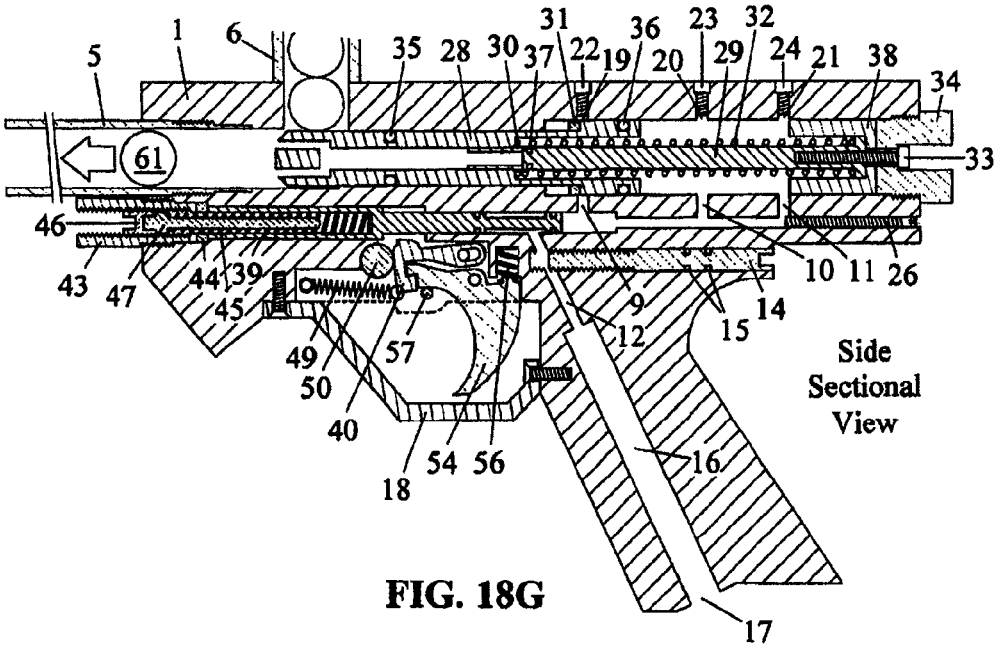
Figure 18H:
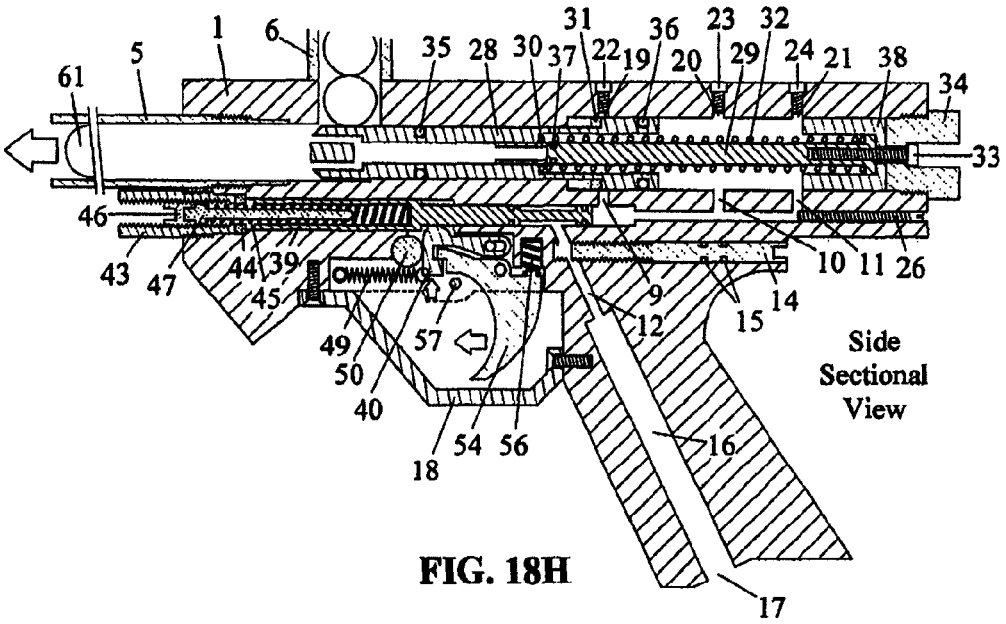

Shown in FIG. 18G and continued in FIG. 18H, the action of the gas pressure on the projectile 61 will cause it to accelerate through and out of the barrel 4 and barrel extension 5, at which time the barrel 4, barrel extension 5, breech 3, valve passage 8 rearward of the valve slider 39, and all communicating passages which are not sealed will vent to atmosphere.

When the pressure within the valve passage 8 rearward of the valve slider 39 has been reduced to sufficiently low pressure such that the force induced on the valve slider 39 no longer exceeds that of the valve spring 45, the valve slider 39 will begin to slide rearward. If the trigger 54 has not been allowed by the operator to move sufficiently far forward to allow the sear 40 to interfere with the rearward motion of the valve slider 39, the valve slider 39 will continue to move rearward as described in Step 3, and the cycle will begin to repeat, starting with Step 3. If the trigger 54 has been allowed by the operator to move sufficiently far forward to allow the sear 40 to interfere with the rearward motion of the valve slider 39, the valve slider 39 will push the sear 40 rearward into the preferred resting position and will come to rest against the sear 40 as shown in FIG. 18H, and the cycle will proceed to Step 9 below.

Under the action of the bolt spring 32, the bolt 28 will continue to move forward, compressing gas within the space ahead of the bolt rear seal 36 in so doing, and, allowing only a small gap by which the gas may escape into the valve passage 8, the bolt 28 will be decelerated, minimizing wear on the bolt bumper 31 and stopping in its preferred resting position, at which point all components will now be in their original ready-to-fire configuration, shown in FIG. 18A.

Cocking:

Whereas most compressed gas-powered projectile accelerators known to be in the art require a means of manual cocking, the compressed gas-powered projectile accelerator of the present invention will automatically cock when compressed gas, from a source mounted on any location on the housing 1 or other source, is introduced, preferably through a tube, attached to the source gas passage inlet 17. If the compressed gas-powered projectile accelerator of the present invention is un-cocked (i.e., the valve slider 39 is not resting against the sear 40, but further rearward under the action of the valve spring 45) when compressed gas is introduced through the source gas passage 12, said gas will flow through the source passage 12, valve passage 8, and gas feed passage 9 into the region of the breech 3 ahead of the bolt rear seal 36, and one of the semi-automatic or fully automatic cycles above described will ensue at Step 4, the particular cycle being determined by the position of the mode selector cam 50. The automatic cocking feature reduces potential contamination of the compressed gas-powered projectile accelerator of the present invention because said feature removes the necessity the additional perforation of the housing 1 to accommodate the connection of a means of manual cocking to internal components, which constitutes a common path by which dust and debris may enter the housing 1 of many compressed-gas powered projectile accelerators known to be in the art.

Figure 19:
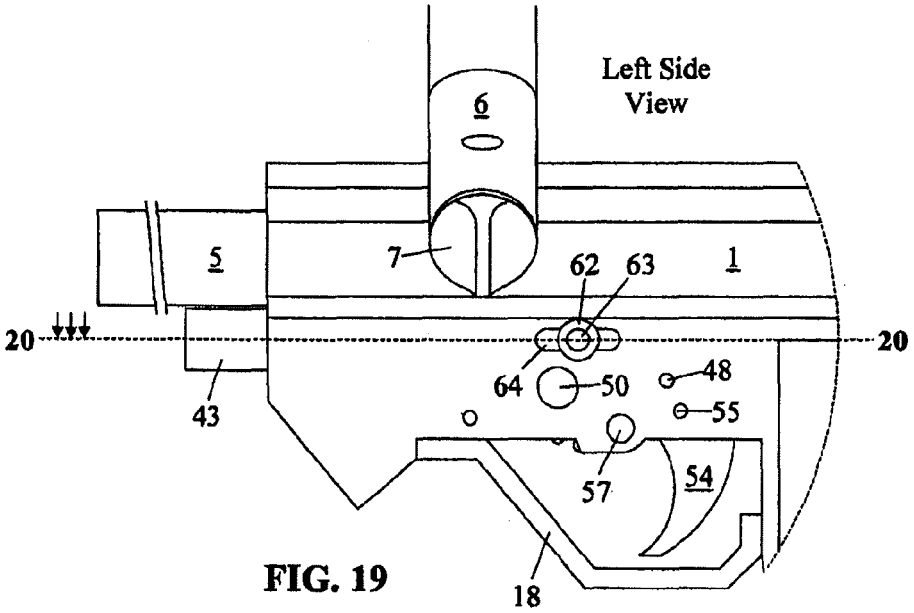
FIG. 19 is a view from the side of the front portion of a compressed gas-powered projectile accelerator made according to the present invention with the addition of a cocking knob, shown in detail.
Figure 20:
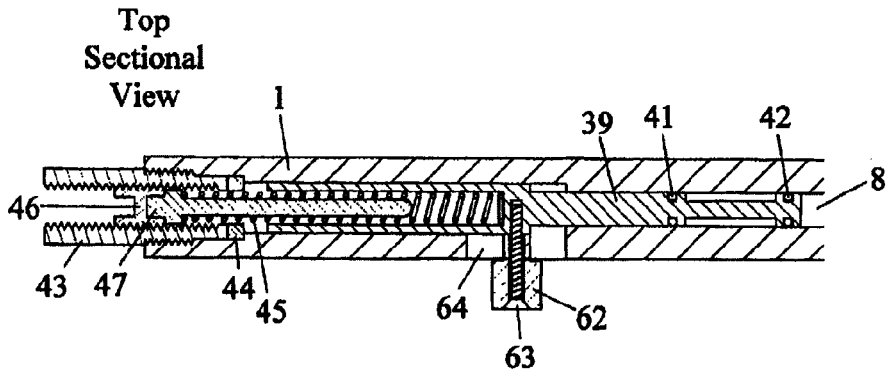
FIG. 20 is a sectional view from the top of the front portion of a compressed gas-powered projectile accelerator made according to the present invention with the addition of a cocking knob, shown in detail.
Figure 21:
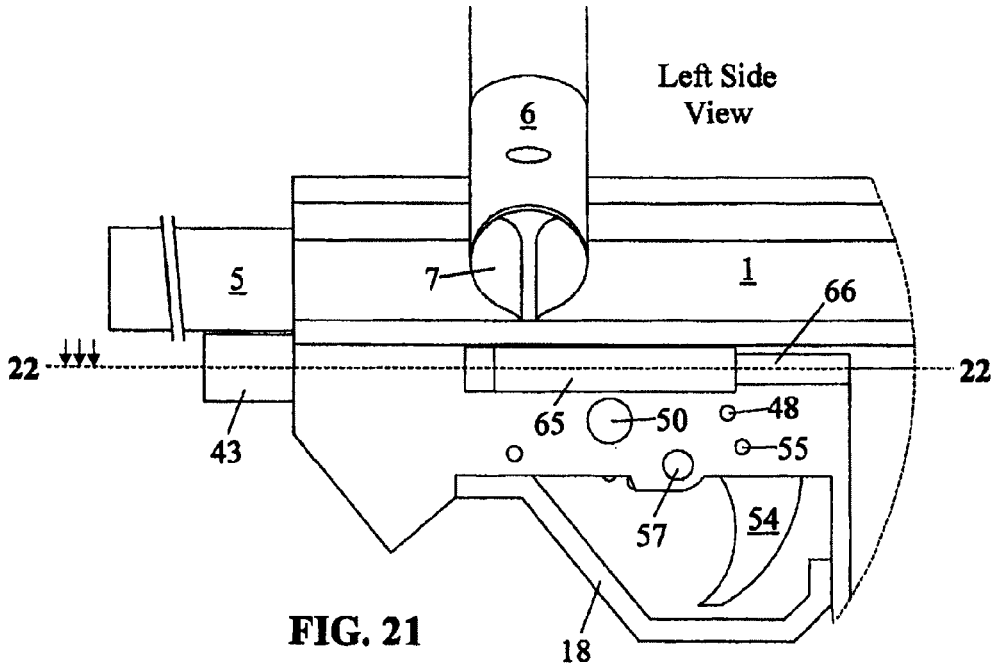
FIG. 21 is a view from the side of the front portion of a compressed gas-powered projectile accelerator made according to the present invention with the addition of a cocking manifold, slider, and spring assembly, shown in detail.
Figure 22:
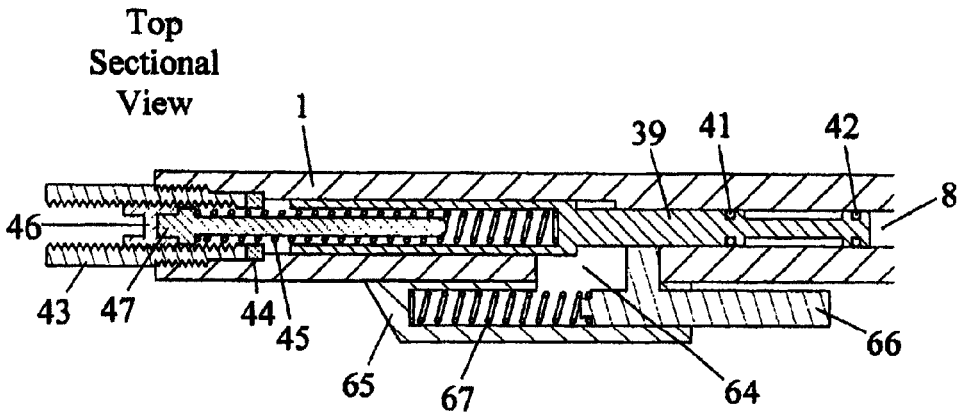
FIG. 22 is a sectional view from the top of the front portion of a compressed gas-powered projectile accelerator made according to the present invention with the addition of a cocking manifold, slider, and spring assembly, shown in detail.

A means of manual cocking may be employed, but should be considered optional to the compressed gas-powered projectile accelerator of the present invention, as the addition of a means of manual cocking will allow the operator to bring the compressed gas-powered projectile accelerator of the present invention into a cocked state without cycling, and, more specifically, silently, without the audible report that will be associated with allowing the compressed gas-powered projectile accelerator of the present invention to automatically cock by completing a cycle. The simplest method of applying a manual cocking mechanism to the compressed gas-powered projectile accelerator of the present invention is shown in detail in FIGS. 19 and 20, where a knob 62 is attached, preferably by a screw 63, to the valve slider 39, which protrudes through a slot 64 in the housing 1. However, because the presence of the slot 64 decreases the resistance to contamination and the cocking knob 62 increases wear on the valve slider 39 by not allowing it to freely rotate with respect to points of intermittent contact with the sear 40, a preferred option is shown in FIGS. 21 and 22, where a manifold 65 attached to the housing 1 holds a cocking slider 66 which penetrates the housing 1 through a slot 64 such that the pushing forward of said cocking slider 66 will cause the valve slider 39 to move forward into a cocked position. The cocking slider manifold 65 obstructs the path of debris into the slot 64 in the housing 1. A spring 67 biases the cocking slider 66 to remain out of the path of the valve slider 39 during operation.

The two examples provided are intended to be illustrative as it is to be appreciated that there are numerous methods by which a means of manual cocking (such as the addition of any appendage to the valve slider 39 which may be manipulated from the housing 1 exterior, particularly by protrusion from the front or rear of the valve passage 8) may be incorporated into the projectile accelerator of the present invention without altering the inventive concepts and principles embodied therein.

Figure 23:
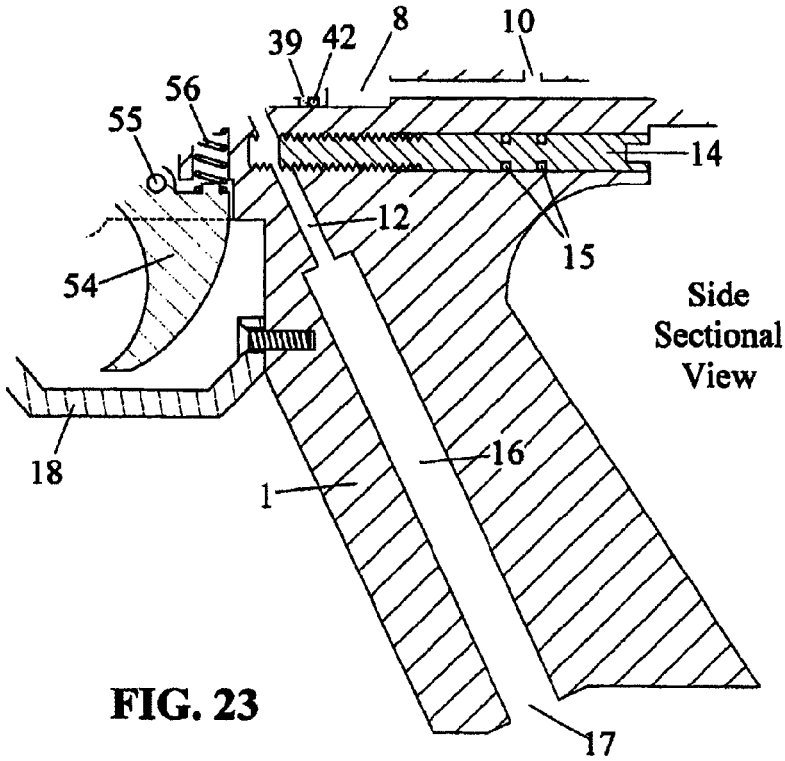
FIG. 23 is a sectional view from the side of the region in the vicinity of the source gas passage of a compressed gas-powered projectile accelerator made according to the present invention, shown in detail.

Expansion Chamber or Second Regulator in Source Gas Passage 12:

One distinct advantage of this preferred embodiment of the compressed gas-powered projectile accelerator of the present invention is that, because the housing 1 can preferably made from a single piece of material, a feed gas conditioning device can easily be incorporated into the housing 1, preferably inserted into the expanded section of the source gas passage 16, shown in detail in FIG. 23, whereas for compressed gas-powered projectile accelerators known to be in the art, such devices are typically contained in separate housings which are typically either screwed into or welded to the primary housing.

Figure 24:
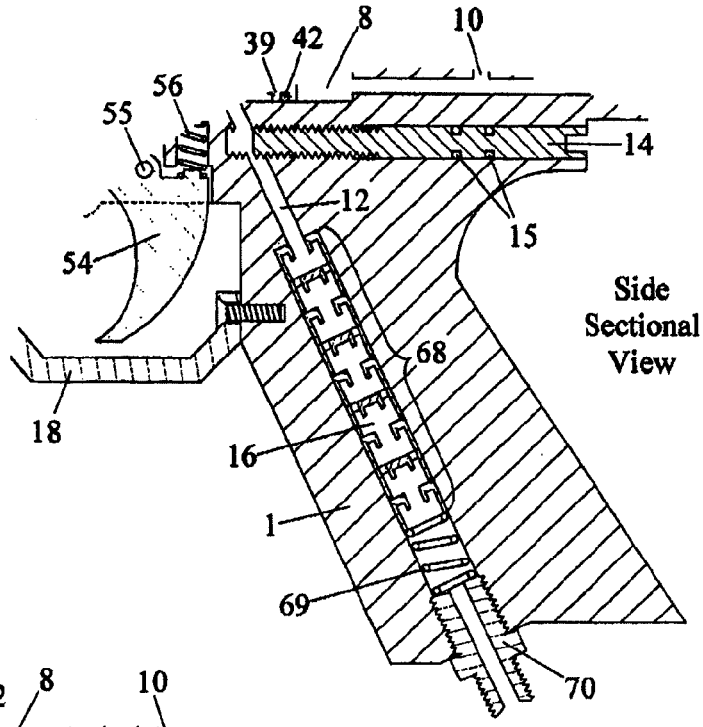
FIG. 24 is a sectional view from the side of the region in the vicinity of the source gas passage of a compressed gas-powered projectile accelerator made according to the present invention with baffle inserts inside the source gas passage, shown in detail.

In FIG. 24 the source gas passage 12 of the compressed gas-powered projectile accelerator of the present invention is shown in detail with the option of baffle inserts 68 within the expanded section of the source gas passage 16 to reduce the potential for liquid to enter the valve passage 8. A spring 69 placed between the lowest baffle insert and a fitting 70 installed at the source gas passage inlet 17 acts to retain the baffle inserts 68 in position.

Figure 25:
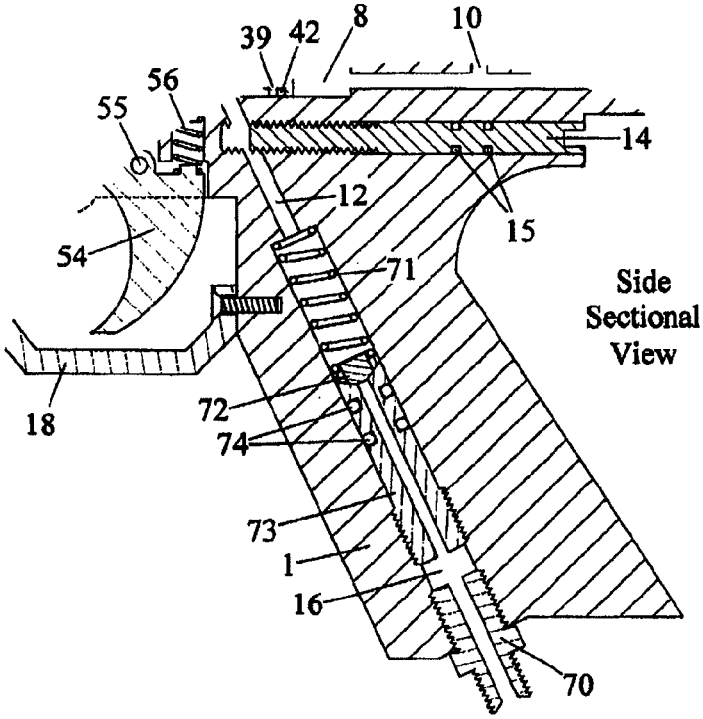
FIG. 25 is a sectional view from the side of the region in the vicinity of the source gas passage of a compressed gas-powered projectile accelerator made according to the present invention with regulator components inserted inside the source gas passage, shown in detail.
Figure 26:
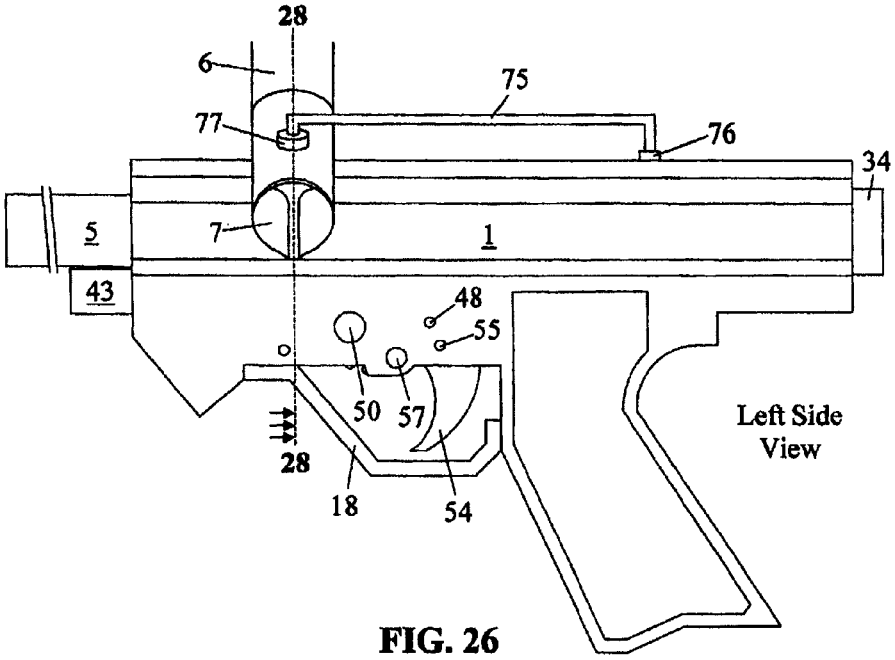
FIG. 26 is a view from the side of a compressed gas-powered projectile accelerator made according to the present invention with an pneumatically assisted feed system.
Figure 27:
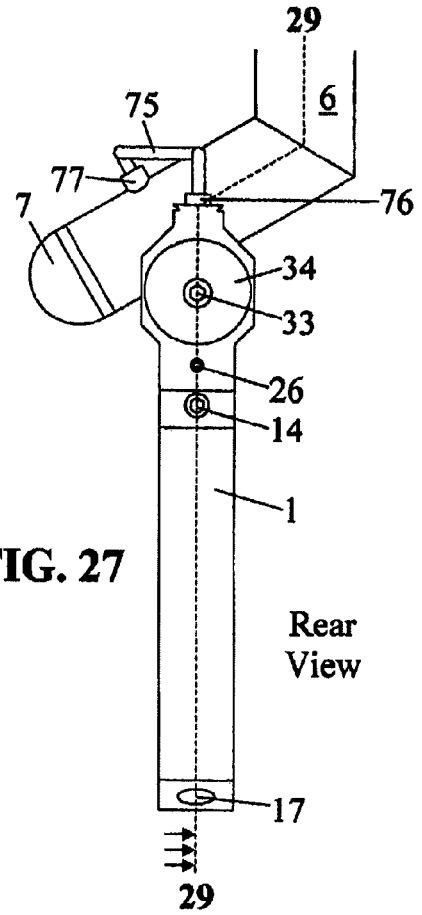
FIG. 27 is a view from the rear of a compressed gas-powered projectile accelerator made according to the present invention with a pneumatically assisted feed system.
Figure 28:
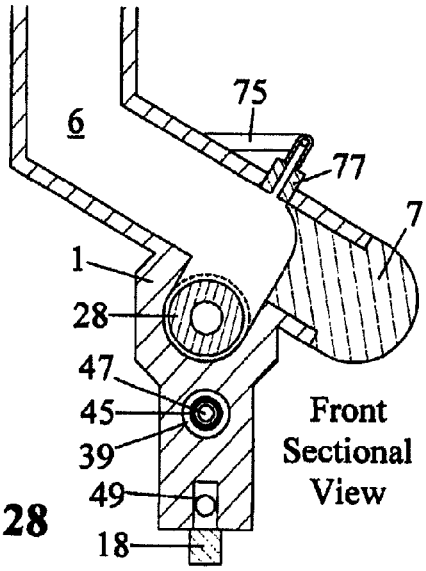
FIG. 28 is a sectional view from the front of a compressed gas-powered projectile accelerator made according to the present invention with a pneumatically assisted feed system.
Figure 29:
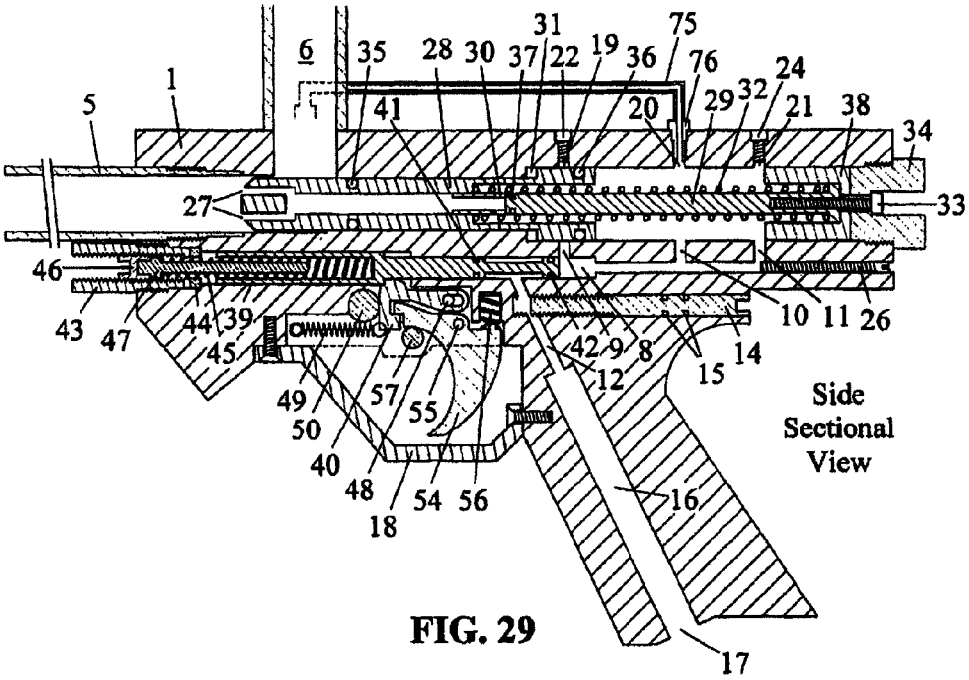
FIG. 29 is a sectional view from the side of a compressed gas-powered projectile accelerator made according to the present invention with a pneumatically assisted feed system.

In FIG. 25 the source gas passage 12 of the compressed gas-powered projectile accelerator of the present invention is shown with the option of an additional feed gas regulator inserted into the expanded section of the source gas passage 16, where a spring 71 pushes a preferably cylindrical and preferably beveled slider 72, perforated with a plurality of holes, against a matching seat 73, which is sealed against the wall of the expanded section of the source gas passage 16 by arbitrary means, and exemplified by o-ring/groove type seals 74 in FIG. 25. The position of the seat 73 is maintained by threads engaging the wall of the expanded section of the source gas passage 16, which is correspondingly threaded, and rotation of the seat 73 (which has a hexagonally shaped groove designed to match a standard hexagonal key wrench), causing it to thread more or less deeply into the expanded section of the source gas passage 16, allows adjustment of the spring 71 tension, thereby adjusting the equilibrium downstream (spring 71 side) pressure.

Pneumatically Assisted Feed:

In FIGS. 26-29 the compressed gas-powered projectile accelerator of the present invention with the option of an added pneumatic feed-assist tube 75 which re-directs a preferably small portion of gas from the breech 3 to increase the bias of projectiles to enter the barrel 4 is shown used in conjunction with a gravitationally induced bias. The pneumatic feed-assist tube 75 can increase the rate of entry of projectiles into the barrel 4, allowing the cycle to be adjusted to higher rates than is possible without the addition of said pneumatic feed-assist tube 75. The pneumatic feed-assist tube 75 may be attached in such a way to communicate with any point in any passage within the compressed gas-powered projectile accelerator of the present invention, the shown preferred position being exemplary, and may optionally be incorporated as an additional passage within the housing. The amount of gas which is redirected can be metered by the internal cross-sectional area of the pneumatic feed-assist tube 75 and/or connecting fittings 76, 77, and/or by optional adjustable valving integrated into the pneumatic feed-assist tube 75 and/or connecting fittings 76, 77 (not shown for clarity).

Alternate Bolt Resting Positions:

While the preferred embodiment of the compressed gas-powered projectile accelerator of the present invention has been shown depicting the preferred resting position of the bolt 28 in its most forward travel position because this takes advantage of the bolt 28 to prevent the entry of more than one projectile into the barrel 4 between cycles, it is to be appreciated that small changes in the configuration of the bolt 28, bumpers 31, 38, and bolt spring 32 can cause the bolt 28 to rest in a different location between cycles without changing the basic operation of the compressed gas-powered projectile accelerator of the present invention. If the bolt spring 32 is placed in front of the larger diameter section of the bolt 28, instead of behind as in FIG. 3, the bolt 28 will be biased to rest against the breech cap bumper 38 at the rear of the breech 3 between cycles. Alternatively, a combination of springs, one ahead and one behind the larger diameter section of the bolt 28, may be used to bias the bolt 28 toward any resting position between cycles, depending on the length and relative stiffness of the two springs. Changes in the resting position of the bolt 28 will alter the initial motion of the bolt 28 which in all cases will move the bolt 28 toward the position described in Step 4 of both the semi-automatic and fully-automatic cycle descriptions with the bolt rear seal 36 just behind the front edge of the bolt rest-point passage 10. Correspondingly, at the end of the last cycle, the bolt 28 will return to the altered rest position rather than the rest position described in the preferred embodiment. In all other respects, both semi-automatic and fully-automatic operation will be identical to as above described. If the bolt 28 is retained at rest in a position that does not prevent projectiles from entering the barrel 4 between cycles, some provision must be included to prevent projectiles from prematurely moving down the barrel 4. This may be accomplished frictionally, by a close fit of projectiles to the barrel 4 diameter, or by the addition of a conventional spring biased retention device which physically blocks premature forward motion of projectiles in the barrel 4.

Figure 30:
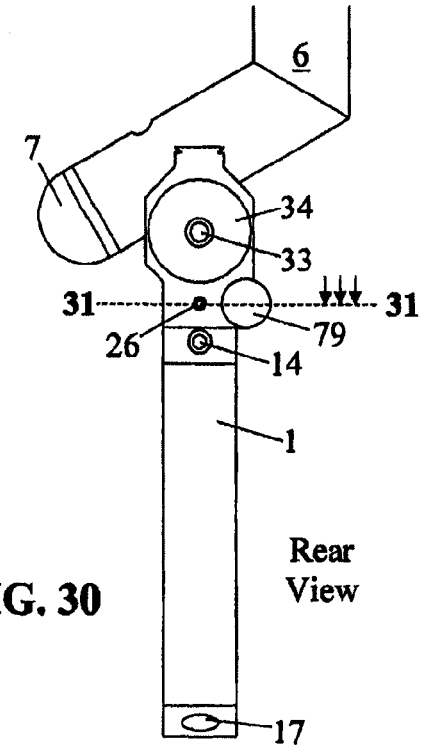
FIG. 30 is a view from the rear of a compressed gas-powered projectile accelerator made according to the present invention with a variable volume chamber connected to the valve passage.
Figure 31:
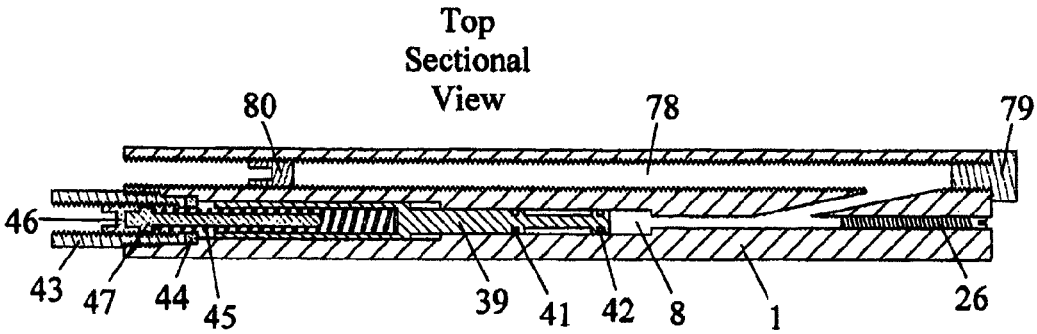
FIG. 31 is a sectional view from the top of a compressed gas-powered projectile accelerator made according to the present invention with a variable volume chamber connected to the valve passage.

Additional Cavities:

It is to be appreciated that the operating characteristics of the compressed gas-powered projectile accelerator of the present invention may be altered by the addition of supplementary cavities, either within the housing or attachments made to the housing, contiguous in any place with any of the internal passages of the apparatus without altering the inventive concepts and principles embodied therein. These cavities may be of fixed or variable volume. (Operating characteristics can be altered by changing the cavity volume.) An example of a compressed gas-powered projectile accelerator made according to the present invention with the addition of a variable volume is illustrated in FIGS. 30 and 31, where a threaded passage 78, parallel and connected to the valve passage 8, is closed at the rear by a threaded plug 79, and at the front by a screw 80, the position of which may be adjusted within the threaded passage 78 to vary the volume. In particular, the threaded passage 78 as shown in FIGS. 30 and 31 may be connected to the valve passage 8, as shown, or, alternatively, to the gas feed passage 9, so that the gas volume may be varied in order to change the amount of acceleration applied to projectiles in lieu of, or in addition to, other means to control the same, already and to be further described.

Figure 32:
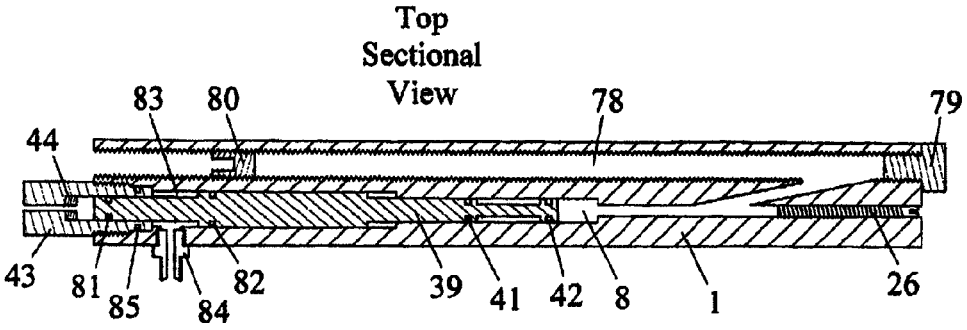
FIG. 32 is a sectional view from the top of a compressed gas-powered projectile accelerator made according to the present invention with a variable volume chamber connected to the valve passage and with the valve slider spring replaced by a pneumatic piston.

Pneumatic Valve Slider Bias:

It is to be appreciated that the operating characteristics of the compressed gas-powered projectile accelerator of the present invention may be altered such that the bias of the valve slider 39 is induced by the pressure of compressed gas, rather than by a valve spring 45, without altering the inventive concepts and principles embodied therein, as shown in FIG. 32, where the compressed gas-powered projectile accelerator made according to the present invention is shown in FIG. 31 with the valve spring 45 omitted and the valve slider 39 geometry modified with an extension and pair of preferably o-ring type seals 81, 82 to allow the valve slider 39 to be pneumatically biased to move rearward when compressed gas is introduced into the volume 83 between the seals 81, 82. FIG. 32 depicts gas communication into this volume 83 to be through a fitting 84 threaded into a hole through the housing 1 as an example, but the routing of gas, preferably from the source connected to the source gas passage 12, is arbitrary. The changes in the valve slider 39 geometry allow the valve slider bumper 44 to be placed inside the valve passage cap 43, which is shown with a preferable o-ring type seal 85 to prevent gas leakage. Projectile velocity may be controlled either by regulation by arbitrary means (e.g., by a regulator within the expanded portion of the gas feed passage 16, previously described, provided the gas is tapped downstream of the regulator) of the pressure in the volume 83 between of the valve slider seals 81, 82, or by an adjustable volume, as previously described. Operation is as previously described except that the bias for the valve slider 39 to move rearward is provided by the pressure of gas within the volume 83 between of the valve slider seals 81, 82 rather than by a spring.

Figure 33:
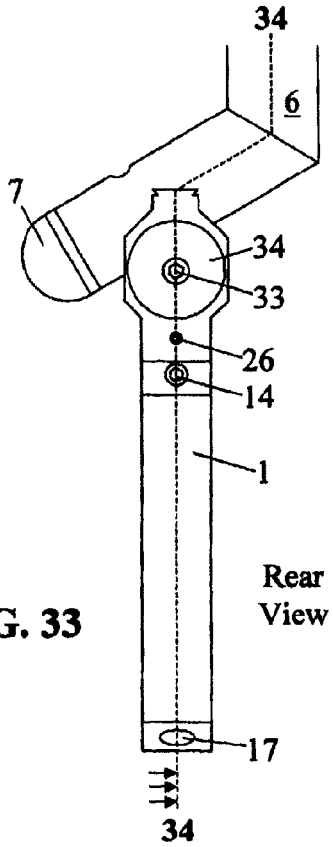
FIG. 33 is a view from the rear of an electronic compressed gas-powered projectile accelerator made according to the present invention.
Figure 34:
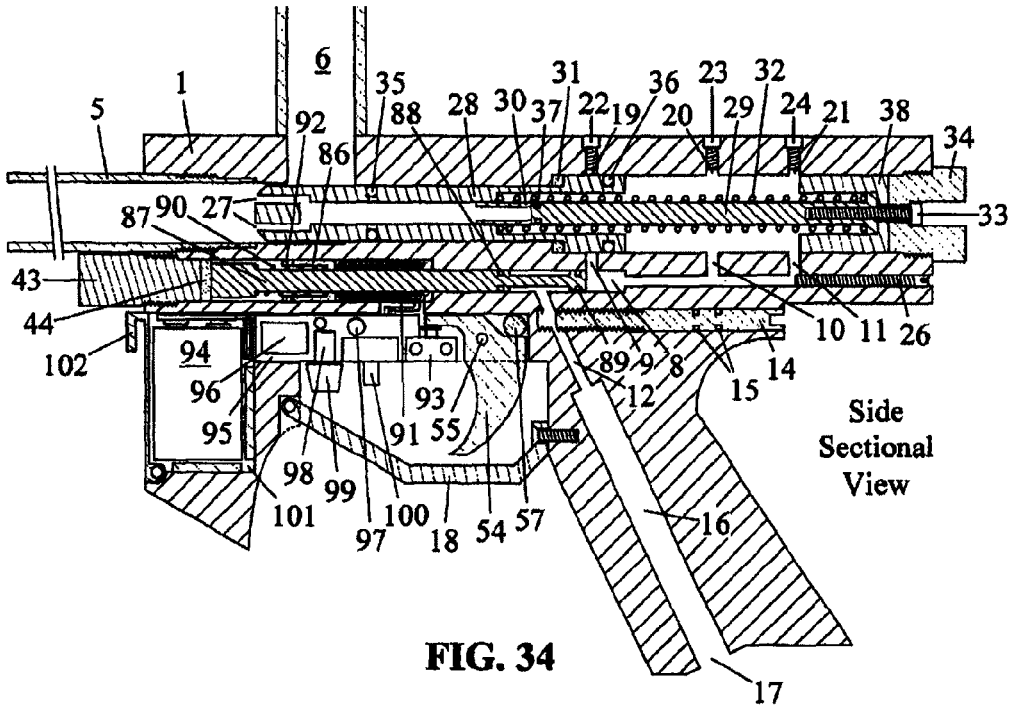
FIG. 34 is a sectional view from the side of an electronic compressed gas-powered projectile accelerator made according to the present invention.

Electronic Embodiment of the Compressed Gas-Powered Projectile Accelerator of the Present Invention:

It is to be appreciated that the operating characteristics of the compressed gas-powered projectile accelerator of the present invention may be altered by the replacement of the valve and internal trigger mechanism components shown in the non-electronic preferred embodiment with electronic components without altering the inventive concepts and principles embodied therein, as shown in FIGS. 33 and 34. In FIG. 34, the valve and internal trigger mechanism components are shown replaced by a spring biased (toward the closed position) solenoid valve, consisting of a valve body 86, valve slider 87 with seals 88, 89 (similar to the valve slider 39 in the non-electronic preferred embodiment), spring 90, coil 91, and bumper 92; electronic switch 93; battery 94 (or other power source); and control circuit 95; where the opening force applied to the solenoid valve slider 87 by the coil 91 when energized by the control circuit 95 can be designed such that the pressure within the valve passage 8 rearward of the solenoid valve slider 87 will force the valve into the unactuated position at the design set pressure, thus simultaneously terminating flow from the source gas passage 12 into the region of the breech 3 ahead of the larger diameter section of the bolt 28 and initiating flow from said region within the breech 3 ahead of the larger diameter section of the bolt 28 into the valve passage 8 rearward of the solenoid valve slider 87 and into the region of the breech 3 behind the bolt 28, simulating the behavior of the mechanical system already described. The set pressure can be adjusted by adjusting the current in the solenoid valve coil 91, thereby adjusting the projectile acceleration rate. Because velocity control is electronic, no velocity adjustment screw 46 need be incorporated into the valve passage cap 43, and the valve passage cap 43 and corresponding bumper 44 need not be hollow. The control circuit 95, preferably consists of an integrated circuit 96 which performs the cycle control logic, an amplifier 97, a means of controlling valve coil 91 current, e.g. a variable resistor 98 with a "velocity control dial" 99 protruding to the exterior, and a multi-position switch 100 which can be used to disable the trigger 54 (one switch position), or select between semi-automatic (second switch position) and fully-automatic (third switch position) operation when the trigger 54 is pulled. With the exception of components replaced by the electronic control circuit 95 and solenoid valve components 86, 87, 88, 89, 90, 91, 92, operation is identical to the non-electronic preferred embodiment (where the solenoid valve slider 87 performs the same role as the valve slider 39 in the non-electronic preferred embodiment). The battery 94 is shown preferably contained within a padded compartment 101 in the housing 1 with a preferably hinged door 102 to allow replacement. An optional mechanical safety cam 57, identical to that employed on the non-electronic preferred embodiment of the compressed gas-powered projectile accelerator of the present invention, but differently located, is also shown in FIG. 34.

Figure 35:
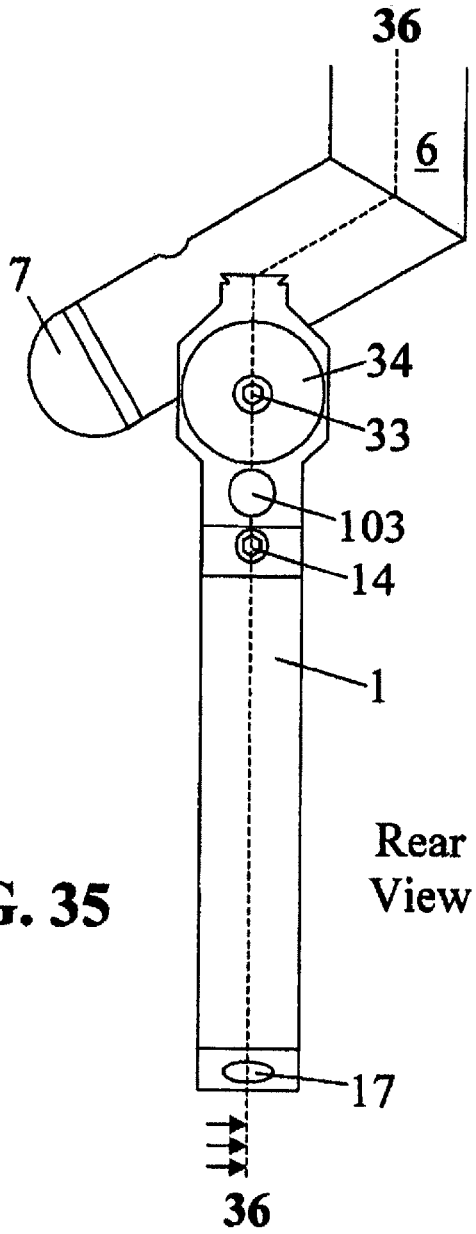
FIG. 35 is a view from the rear of an electronic compressed gas-powered projectile accelerator made according to the present invention with a pressure transducer connected to the rear of the valve passage.
Figure 36:
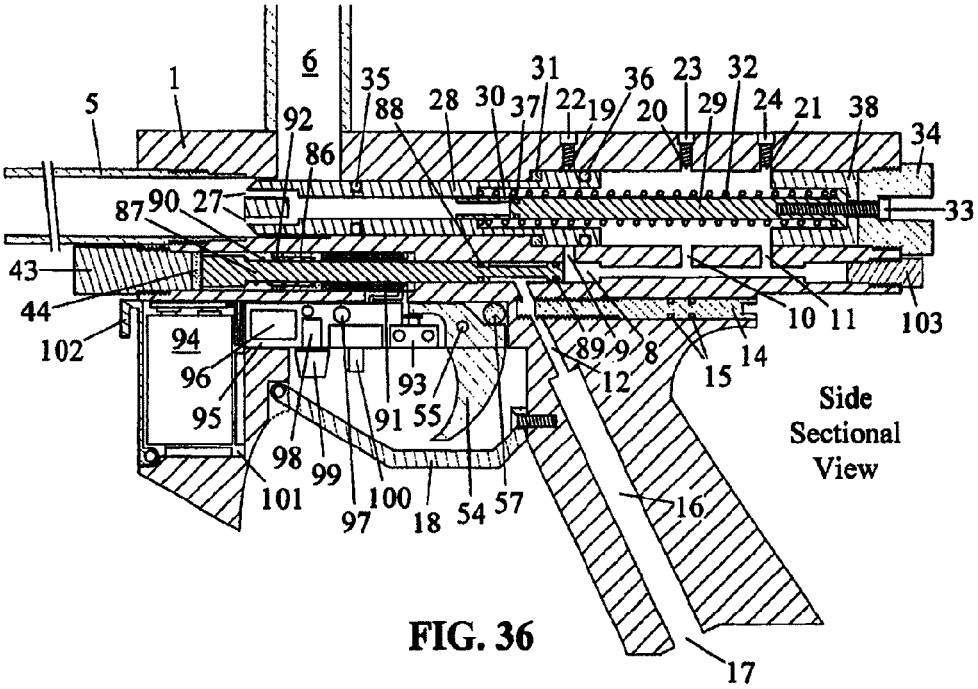
FIG. 36 is a sectional view from the side of an electronic compressed gas-powered projectile accelerator made according to the present invention with a pressure transducer connected to the rear of the valve passage.

Alternatively, rather than relying upon the mechanical action of pressure within the valve passage 8 rearward of the solenoid valve slider 87 to push the solenoid valve slider 87 into the closed position, the solenoid valve coil 91 can be de-energized when the set pressure is reached, which can be determined based on timing, or by a signal supplied to the control circuit 95 by a pressure transducer 103 (or other electronic pressure sensor), which can be positioned in communication with the gas behind the solenoid valve slider 87 or in the breech 3 either ahead of or behind the largest diameter section of the bolt 28 (i.e. the intermediate reservoir), as shown in FIGS. 35 and 36, (through wires connecting the pressure sensor 103 to the control circuit 95, the geometry of which are arbitrary and not shown in the Figures for clarity). In these cases, the velocity control dial 99 does not adjust the solenoid valve coil 91 current, but rather the timing, in the case of a timed circuit, or either the signal level from the pressure sensor 103 at which the control circuit 95 de-actuates the solenoid valve coil 91 or the said pressure sensor 103 signal, thereby accomplishing the same effect.

It is also to be appreciated that additional, optional controls can be incorporated into the control circuit 95 of the preferred electronic embodiment of the compressed gas-powered projectile accelerator of the present invention without altering the inventive concepts and principles embodied therein, such as additional switch 100 positions controlling additional operating modes where the projectile accelerator accelerates finite numbers of projectiles, greater than one, generally known as "burst modes" when the trigger 54 is pulled, as compared to semi-automatic operation, where a single projectile is accelerated per trigger 54 pull, and fully-automatic operation, where projectile acceleration cycles continue successively as long as the trigger 54 remains pulled rearward. Additionally, the timing between cycles can be electronically controlled, and said timing can be made adjustable by the inclusion of an additional control dial in the control circuit 95.

Figure 37:
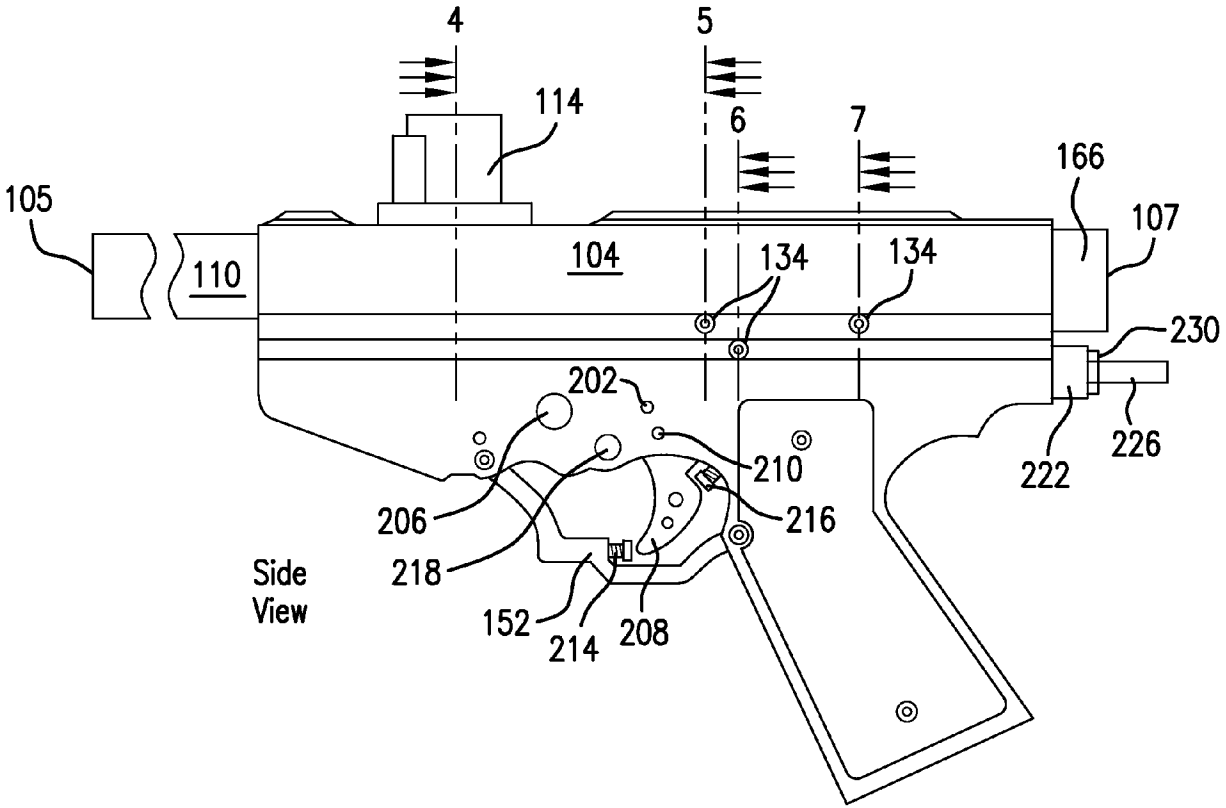
FIG. 37 is a view from the side of an additional embodiment of the compressed gas-powered projectile accelerator of the present invention.
Figure 38:
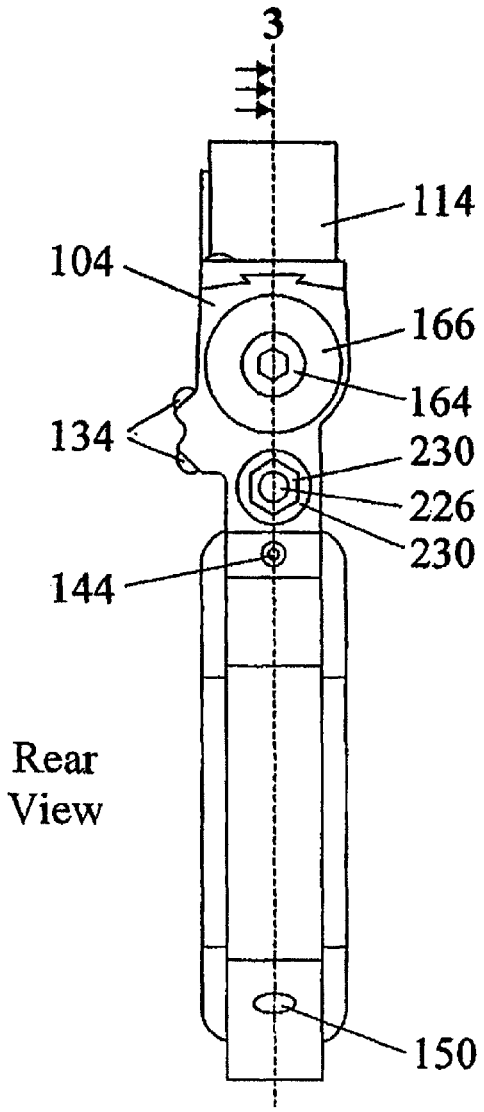
FIG. 38 is a view from the rear of the compressed gas-powered projectile accelerator of the present invention shown in FIG. 1.
Figure 39:
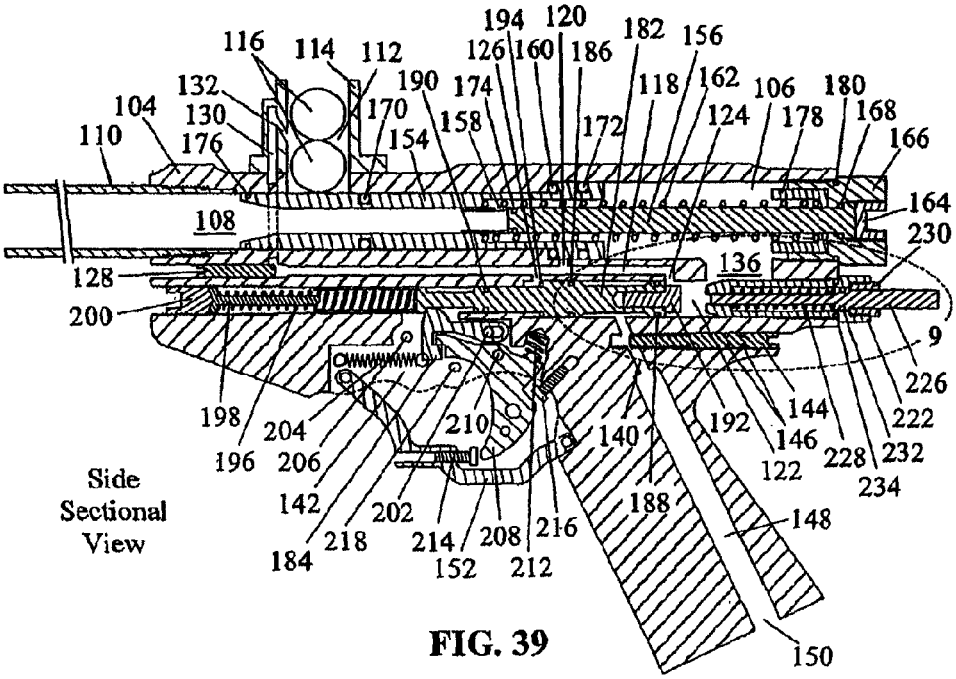
FIG. 39 is a sectional view from the side of a compressed gas-powered projectile accelerator made with improvements of the present invention.

In another embodiment of the present invention, shown in FIGS. 37, 38 and 39, a housing 104 has a forward end 105 shown to the left in the Figures and a rear end 107 shown to the right in the Figures. A preferably cylindrical passage forms a breech 106 contiguous with a barrel 108. The breech may have a narrow diameter forward portion adjacent the forward end of the housing, and an expanded diameter rear portion adjacent the rear end of the housing, as shown in FIG. 39.

Figure 40:
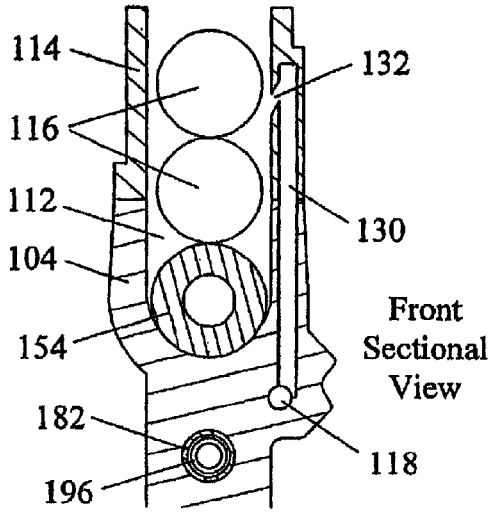
FIG. 40 is a sectional view from the front of a compressed gas-powered projectile accelerator made with improvements of the present invention in the vicinity of the intersection of the feed-assist shaft and gas distribution shaft, shown to advantage.
Figure 41:
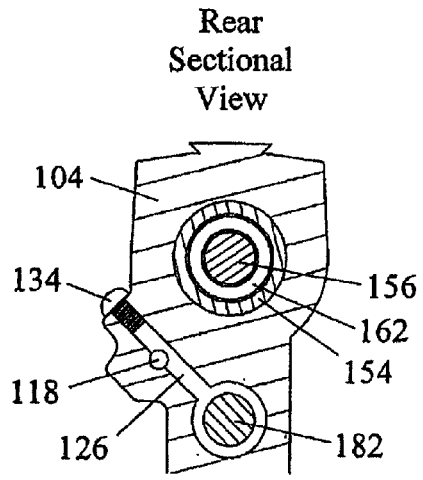
FIG. 41 is a sectional view from the rear of a compressed gas-powered projectile accelerator made with improvements of the present invention in the vicinity of the valve locking shaft, shown to advantage.
Figure 42:
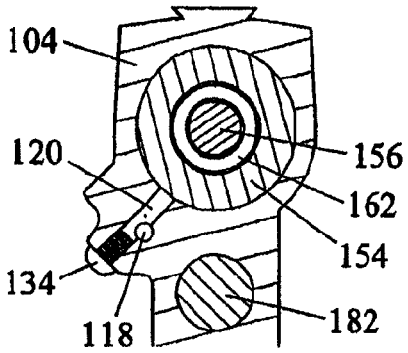
FIG. 42 is a sectional view from the rear of a compressed gas-powered projectile accelerator made with improvements of the present invention in the vicinity of the upper gas feed passage, shown to advantage.
Figure 43:
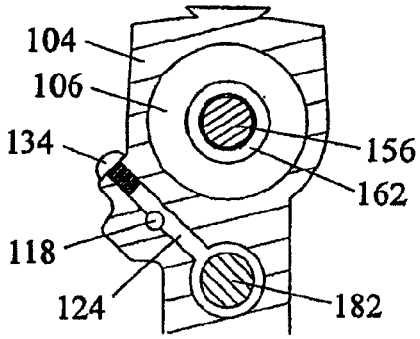
FIG. 43 is a sectional view from the rear of a compressed gas-powered projectile accelerator made with improvements of the present invention in the vicinity of the lower gas feed passage, shown to advantage.

The barrel 108 may be extended by the addition of a barrel extension 110, which is preferably a tubular member threaded or other wise attached into/onto barrel 108 at the front of the housing 104. The barrel 108 is in communication with a projectile feed passage 112, which may be defined in part by a projectile feed manifold 114 and further extending within the housing 104. Projectiles 116 are introduced into the breech 106 via the projectile feed passage 112. The projectile feed passage 112 may meet the barrel 108 at any angle whereby projectiles 116 can enter the breech 106, but preferably is at least partially vertically oriented with respect to the housing to take advantage of gravity to bias the projectiles 116 into the barrel 108. A means other than gravity may be employed to bias the projectiles into the housing, such as a spring mechanism. The projectile feed passage 112 may be connected such that its center axis intersects the center axis of the barrel 108, as shown in FIG. 40, or the projectile feed passage 112 center axis can be offset from the center axis of the barrel 108, as long as the intersection forms a hole sufficiently sized for the passage of projectiles 116 from the projectile feed passage 112 into the barrel 108.

Figure 3:
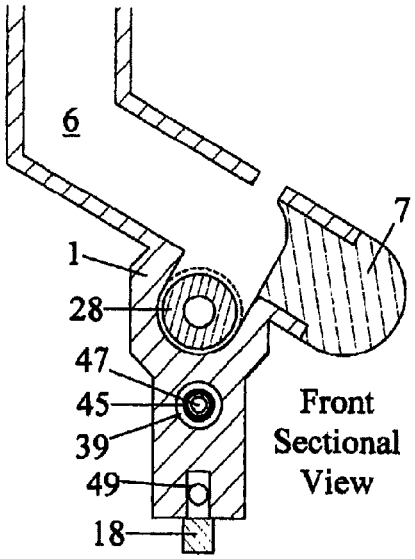
FIG. 3 is a sectional view from the front of a compressed gas-powered projectile accelerator made according to the present invention.

Preferably parallel to the barrel 108 and breech 106 is a preferably cylindrical gas distribution passage 118, in communication with the breech 120 via an upper gas feed passage 120, and further in communication with a preferably cylindrical valve passage 122 by a lower gas feed passage 124 and valve locking shaft 126. The gas distribution passage 118 may be closed at the front of the housing 104 by a plug, or, as shown in FIGS. 3 and 4, by a throttling screw 128 optionally incorporating an o-ring/groove type seal around its outer edge (not shown).

A feed-assist shaft 130 extends upwardly into the projectile feed manifold 134, and connects with a feed-assist jet 132. Alternatively, the feed-assist shaft 130 can also be connected to the feed-assist jet 132 by a tube 138 routed externally to the projectile feed manifold 134. The throttling screw 128 controls gas flow between the gas distribution passage 118 and the feed assist shaft 130. More particularly, the degree to which the throttling screw 130 partially or completely blocks the intersection of a vertical feed-assist shaft 130 and the gas distribution passage 118 is dependent upon the depth to which the throttling screw 128 has been threaded into the gas distribution passage 118. Of course, if there is no desire to use the gas from the gas distribution passage 118 to assist feeding projectiles 116, the throttling screw 128, feed-assist shaft 130 and feed-assist jet 132 may be removed.

The gas distribution passage 118, feed-assist shaft 130, and feed-assist jet 132 are shown in the same plane as the barrel 108, breech 106, and valve passage 122 centerlines in FIG. 39 for simplicity of interpretation. However, it is preferred that these components be positioned away from the centerline of the housing 104 to facilitate a more compact arrangement and simplify the intersection of the feed-assist shaft 130 with the gas distribution passage 118 and feed-assist jet 132, by providing an envelope for a straight vertical path beside the barrel 108, as illustrated in FIGS. 40-43. This simplifies the manufacture of the connecting passages 124, 128, 130, as shown in FIG. 40, FIG. 41, FIG. 42, and FIG. 43, where the connecting passages 124, 128, 130 are shown drilled from the side of the housing 104 through test ports closed with plugs 134. The test ports closed with plugs 134 are optional because they are not required for correct function of the compressed gas-powered projectile accelerator, and may be eliminated from the design by a variety of means, such as closure by welding, use of special tooling to allow manufacture from the interior, etc.

Figure 44:
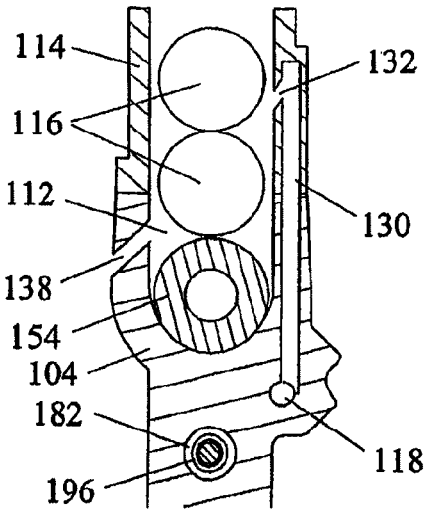
FIG. 44 is a sectional view from the front of a compressed gas-powered projectile accelerator made with improvements of the present invention in the vicinity of the intersection of the feed-assist shaft and gas distribution shaft showing an optional feed gas vent on one side of the barrel, shown to advantage.

Also for ease of understanding, the gas distribution passage 118 is not depicted extending to the rear of the housing 104 in FIG. 39. However, for manufacturing simplicity, provided that it is staggered so as to not intersect the bolt rest-point slot, discussed in further detail below, the gas distribution passage 118 may extend to the rear of the housing 104 and be either closed by a simple plug or a throttling screw applied to the intersection with the lower gas feed passage 124 in similar fashion to the intersection with the feed-assist shaft 130. The inclusion of one (as shown) or more optional ports 142 to vent feed-assist jet 132 gas once a projectile 116 is in the barrel 108 is illustrated in FIG. 44.

The valve passage 122 is also in communication with the breech 106 via a bolt rest-point slot 136. A source gas passage 140 is also in communication with the bolt rest-point slot 136. A trigger cavity 142 may also be in communication with the bolt rest-point slot 136. The trigger cavity 142 is perforated in several places to allow extension of control components to the exterior of the housing 104.

The source gas passage 140 is preferably valved, such as by means of a screw 144, the degree to which partially or completely blocks the source gas passage 140 depending upon the depth to which the screw 144 is threaded into the housing 104 so as to intersect the source gas passage 140. Alternatively, the lower gas feed passage 124 or upper gas feed passage 120, may be similarly valved instead of, or in addition to, the source gas passage 140 to control flow both between the source gas passage 140 and breech 106, and between the source gas passage 140 and valve passage 122. The screw 144 should form a seal with the hole in which it sits, preferably by the use of one or more o-rings in grooves 146.

The source gas passage 140 may include an expanded section 148 to minimize liquid entry and maximize consistency of entering gas by acting as a plenum. Gas is introduced through the source gas passage inlet 150 at the base of the housing 104, which may be designed to accept any high pressure fitting. A gas cylinder acting as a source of compressed gas (not shown), may be mounted to the housing 104, preferably to the base of the housing 104 in front of the optional trigger guard 152 illustrated in FIG. 39. Alternately, the gas cylinder may be mounted to the rear of the source gas passage inlet 150, and/or may be connected to said inlet 150 through a flexible high pressure hose. The source gas passage 140 is depicted as integrated into the lower rear part of the housing 104 to facilitate manufacture of the housing 104 from a single piece of material. However, it should be appreciated that any configurations of the source gas passage 140, whether within the housing 104 or as an attachment to the housing 104, may be substituted for the illustrated embodiment.

A hollow slider or bolt 154 is slidably disposed within the barrel. The bolt 154 preferably has a cylindrical shape that substantially mates with the cylindrical shape of the barrel 108. The bolt 154 is preferably rotatable within the barrel 108 and breech to minimize wear, and is preferably formed from a single piece. The bolt 154 is slidable within the barrel 108 and breech 106 between a forward or first position and a rearward or second position. The bolt 154 has an aperture therethrough for allowing the passage of gas. The bolt 154 may be adapted to move coaxially about a preferably cylindrical spring guide 156 which may be extended within the aperture of the bolt 154. The spring guide 156 has a hollow space at the forward end communicating with at least one or, as shown, a plurality of purge holes 158 about its circumference. A preferably resilient bolt bumper 160 is attached to the bolt 154 at a point where the bolt 154 changes diameter and meets a narrowed portion of the housing, limiting the bolts 154 forward travel and easing shock in the event of malfunction. The bolt bumper may be an o-ring as shown which acts both as a bumper and as a seal between the bolt 154 and the walls of the breech 106.

A bolt spring 162 surrounds the spring guide 156. The spring guide 156 is mounted to a removable breech cap 166. As illustrated, the spring guide 156 may be held in place by a cylindrical cavity in the cap 166 by means of a step in its diameter, and trapped by a screw 164. A spring guide bumper 168, such as an o-ring, may placed between the end of spring guide 156 and the breech cap 166.

The bolt 154 and spring guide 156 are shown with o-ring/groove type gas seals 170, 172, 174, to prevent leakage. However, various types of seals may be substituted for the illustrated o-rings. Optionally, an additional o-ring/groove type gas seal 176 may be placed at the front tip of the bolt 154. A cylindrical resilient bumper 178 which may be mounted between the bolt 154 and breech cap 166, partially surrounding the bolt 154 and spring guide 156, to protect the bolt 154 and breech cap 166 in the event of malfunction. An o-ring/groove type gas seal 180 may be placed between the breech cap 166 and the wall of the breech to provide further sealing.

As shown in FIG. 39, a valve slider 182 with a first end adjacent the forward end of the housing, and a second end adjacent the rearward end of the housing, is slidable within the valve passage 122 from a first position adjacent the forward end of the housing, to a second position adjacent the rearward end of the housing. The valve slider may be partially hollow adjacent its first end and adapted for receiving a valve spring 196.

Figure 45:
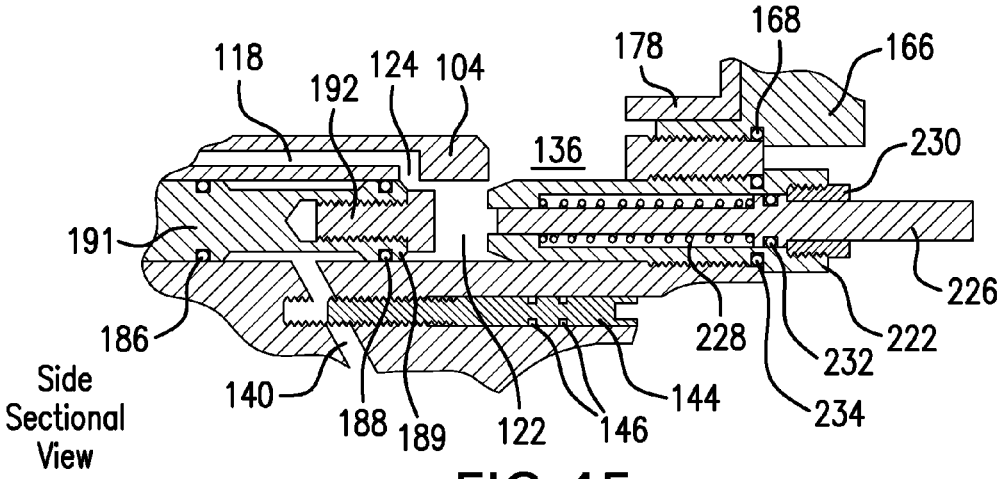
FIG. 45 is a sectional view from the side of the rear portion of the valve passage of a compressed gas-powered projectile accelerator made with improvements of the present invention, shown to advantage.

The valve slider may be formed having a first enlarged portion 189 adjacent the second end of the of the valve slider 182, and a second enlarged portion 191, forward of the first enlarged portion 189, as shown in detail in FIG. 45. In a preferred embodiment, the valve slider 182 forms or includes seals 186, 188, 190 with the valve passage 122 at a plurality of points. For example, in the Figures, three points are shown for illustration where single o-ring/groove type seals 186, 188, 190 provide sealing, but multiple o-rings or any other appropriate method of sealing may be used, for example, use of a flexible material such as polytetrafluoroethylene at the sealing points may be used to form surface-to-surface seals in lieu of o-rings, and can potentially reduce wear on the seals 186, 188, 190. An optional bumper 192 to minimize wear is shown threaded into a hole in the rear face of the valve slider 182 in FIG. 39, and a bumper 194, optionally an o-ring, is shown at a step in the valve slider 182 diameter to minimize wear and reduce noise due to interaction with the housing 104.

A valve spring 196 located adjacent the first end of the valve passage 122 and, preferably, partially within the valve slider 182. The valve spring is positioned between the valve slider 182 and a valve spring guide 198. The valve spring 196 biases the valve slider 182 toward its second position. The valve spring guide 198 may be held in place by a velocity adjustment screw 200 preferably threaded into the valve passage 122. The position of the screw may be adjusted to increase or decrease tension in the valve spring 196, thereby adjusting the operating pressure of the cycle and magnitude of projectile acceleration. The valve slider 182 may be held in its first position by a sear 184, which can rotate about and slide on a pivot 202. A sear spring 204 maintains a bias for the sear 184 to slide forward and rotate toward the valve slider 182. Sliding movement of the sear 184 can be limited by means of a preferably cylindrical mode selector cam 206 which can slide along an axis parallel to the rotational axes of the sear 184 as previously described.

A trigger 208, which rotates on a pivot 210, is adapted to press upon the sear 184, inducing rotation of the sear 184. A bias of the trigger 208 to rotate toward the sear 184 (clockwise in FIG. 39) is maintained by a spring 212. Forward travel of the trigger 208 may optionally be limited by an adjustable forward trigger adjustment screw 214, shown threaded into the trigger guard 152. Rearward travel of the trigger is optionally adjustably limited by an optional rear trigger adjustment screw 216, shown threaded into the housing 104. It is to be appreciated that a number of means may be employed to adjust the trigger 208 movement for the compressed gas-powered projectile accelerator of the present invention without altering the inventive concepts and principles embodied therein. Rotation of the trigger 208 can also be limited by means of a preferably cylindrical sliding safety cam 218 as previously described.

Figure 46:
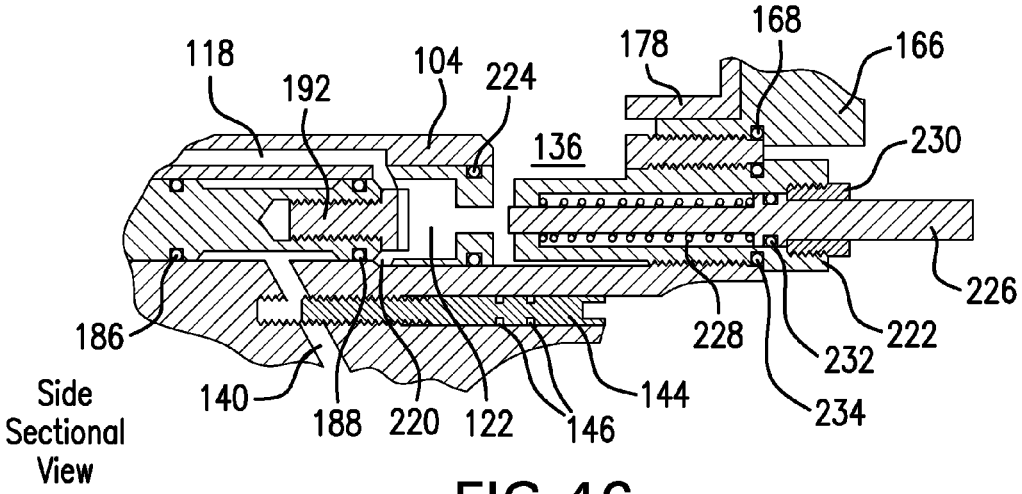
FIG. 46 is a sectional view from the side of the rear portion of the valve passage of a compressed gas-powered projectile accelerator made with improvements of the present invention, showing an annular enlargement of the valve passage at the lower feed passage intersection to advantage.
Figure 47:
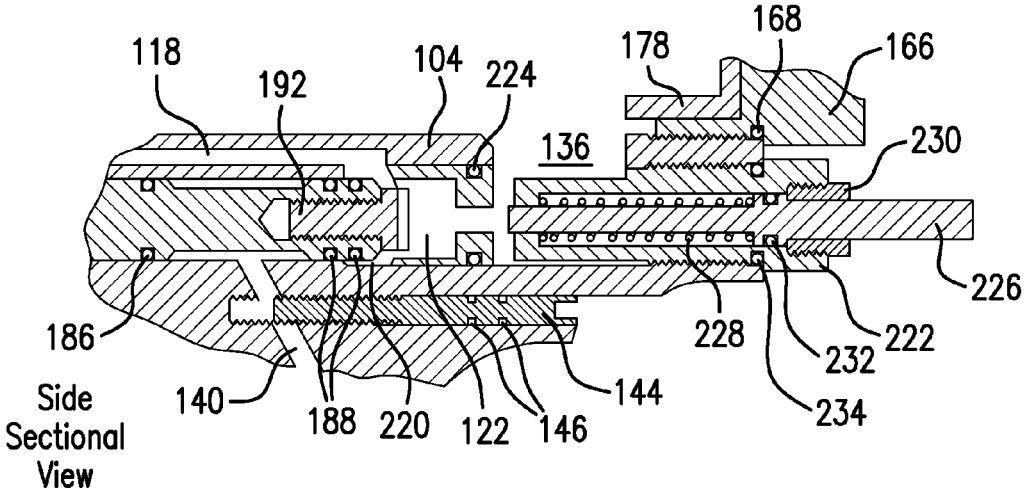
FIG. 47 is a sectional view from the side of the rear portion of the valve passage of a compressed gas-powered projectile accelerator made with improvements of the present invention, showing an annular enlargement of the valve passage at the lower feed passage intersection and dual o-ring seal to advantage.

It will be appreciated by one skilled in the art that the sliding of an o-ring/groove type rear valve slider seal 188, shown in detail in FIG. 45, past the intersection of the valve passage 122 with the lower gas feed passage 124 will cause wear on the seal 188, which may intermittently need replacement. One alternate configuration of the intersection between the valve passage 122 and lower gas feed passage 124 that is designed to reduce such wear is shown in FIG. 46. In this embodiment, the lower gas feed passage 124 intersects an enlarged portion 220 formed between a step in the valve passage 122 where the diameter of the valve passage changes, and an extension of the cocking assembly housing 222 (described below), is sealed to the wall of the valve passage 122 upstream of the bolt rest-point slot 136 by a preferably o-ring/groove type seal 224. This forces the rear valve slider seal 188 to release pressure from all parts of its perimeter simultaneously, thereby avoiding asymmetric extrusion of the valve slider seal 188 into the lower gas feed passage 124. Another configuration is shown in FIG. 47, where the rear valve seal 188 is comprised of a pair of o-rings, positioned such that the seal between the valve slider 182 and valve passage wall is made by a different o-ring on each side of the enlargement 220 of the valve passage 122. The o-ring is positioned such that exactly one is always in contact with the wall of the valve passage 122 on one side of the enlargement 220 of the valve passage 122 or the other, thereby minimizing the wear on each and eliminating the brief gas flow around the rear valve slider seal 188 that occurs when the seal 188 moves across the lower gas feed passage 124 or enlargement 220 of the valve passage 122, if present. In FIG. 46 and FIG. 47, the enlargement 220 of the valve passage 122 is shown formed by a gap between a step in the valve passage 122 bore and the discreet cocking assembly housing 222 (described below). However, it should be appreciated that the enlargement 220 could be formed between a step in the valve passage 122 bore and an alternate part, such as a plug, replacing the discreet cocking assembly housing 222, or as a feature in the valve passage 122 not involving a separate piece.

Discreet Cocking Module:

As described above, the compressed gas-powered projectile accelerator of the present invention will automatically cock when it is in an uncocked position when gas is supplied from a source of compressed gas to the source gas passage 140. It is also desirable to provide some means of manual cocking. This can be accomplished by the addition of a discrete assembly, shown in FIG. 39, comprised of a preferably cylindrical hollow body 224 containing a preferably cylindrical plunger 226 partially surrounded and biased to move rearwardly by a cocking spring 228. When not in use, the plunger 226 rests against and is contained within the cocking assembly housing 222 by interference with a hollow plug 230. The hollow plug 230 is preferably threaded into the rear of the cocking assembly housing 222. The hollow plug 230 has an inner diameter smaller than the largest section of the cocking plunger 226, and may be penetrated by a section of the plunger 226 which can slide within the hollow plug 230. The plunger 226 preferably forms a substantial seal with the body to minimized gas leakage. One suitable sealing mechanism is through use of an o-ring/groove type seal 232 located on the largest diameter section of the plunger 226. It is also preferable that an o-ring/groove type seal 234 be incorporated into the cocking assembly housing 222 to form a seal with the housing 104. Cocking is accomplished by depression of the portion of the cocking plunger 226 extending outward from the hollow plug 230. The force of the depression overcomes the biasing provided by the spring 244, thereby permitting the plunger 226 to push the valve slider 182 forward a sufficient distance to permit the sear 184 to engage the step in the valve slider 182 under the bias provided by the sear spring 246. When pressure is removed from the cocking plunger 226, the cocking spring 244 will bias the plunger 226 to its rearmost position, resting against the hollow plug 230, where it will not interfere with motion of the valve slider 182 during operation.

Operation

Semi-Automatic Operation of the Compressed Gas-Powered Projectile Accelerator:

The preferred ready-to-operate configuration for semi-automatic operation is shown in FIG. 39, with the valve slider 182 in its first or cocked position, resting against the sear 184, which, under the pressure of the valve spring 196 translated through the valve slider 182, rests in its rearmost position. For operation, the safety cam 218 is positioned to allow the trigger 208 to rotate freely. The mode selector cam 206 is positioned so as to not restrict the forward movement of the sear 184. The smaller diameters of the safety cam 218 and mode selector cam 206 are shown in this cross section, as said smaller diameters represent the portions of these components 218, 206 interacting with the trigger 208 and sear 184, respectively. A projectile 116 is prevented from entering the barrel 108 by interference with the bolt 154.

The trigger 208 is then pulled rearward, pulling the sear 184 downward, disengaging it from the valve slider 182. The valve slider 182 may then be biased rearwardly to its second position by the valve spring 196.

Under the force applied by the valve spring 196, the valve slider 182 then slides rearwardly to its second position. It may be stopped by contact of its rear bumper with the cocking assembly housing 222. When the valve slider 182 reaches its second position, it allows gas to enter the gas distribution passage 118 through the lower gas feed passage, flow through the gas distribution passage, and into the region of the breech 106 ahead of the bolt rear seal 172. Compressed gas will necessarily also flow into the region of the valve passage 122 forward of the second enlarged portion 191 of the valve slider 182 adding pressure force to hold the valve slider 182 rearward in addition to the valve spring 196 bias. Simultaneously, the sear 184 is caused to slide forward and rotate (shown clockwise in the drawing) by the sear spring 246, coming to rest against the valve slider 182 and, thus, disengaged from the trigger 208.

The pressure of the gas against the bolt rear seal 172 causes the bolt 154 to slide rearward, until the bolt rear seal 172 passes the front edge of the bolt rest-point slot 136, and reaches a preselected position, opening a flow path, and allowing compressed gas to pass into the bolt rest-point slot 136, the valve passage 122 rearward of the valve slider 182, and the region of the breech 106 behind the bolt 154. A projectile 116 may then enter the barrel 108, aided by gravity or some other force, and may be further aided by the suction induced by the motion of the bolt 154 rearward. Additional projectiles 116 in the projectile feed passage 112 are blocked from entering the barrel 108 by the projectile 116 already in the barrel 108. The combined force of the bolt spring 162 and the pressure behind the bolt 154 bring the bolt 154 to rest, preferably without contacting the breech cap bumper 248 at the rear of the breech 106. The bolt 154 will remain approximately at rest, where its position will only adjust slightly to allow more or less gas through the bolt rest-point slot 136 as required to maintain a balance of pressure and spring forces on it while the pressure continues to increase.

Once the pressure in the valve passage 122 rearward of the valve slider 182 has increased sufficiently to overcome the force of the valve spring 196 on the valve slider 182, the valve slider 182 will be pushed forward until the front valve slider bumper 250 contacts the step due to the change in diameter of the valve passage 122, thereby stopping the flow of compressed gas from the source gas passage 140, and allowing the flow of gas from the region of the breech 106 forward of the bolt rear seal 172 and the region of the valve passage 122 forward of the enlarged portion of the valve slider 182 into the valve passage 122 rearward of the valve slider 182, which is in communication with the region of the breech 106 rear of the bolt 154. The sear 184, under the action of the sear spring 246, will rotate further (clockwise in the drawing) once the smaller diameter section of the valve slider 182 has traveled sufficiently far forward to allow this, coming to rest against the smaller diameter section of the valve slider 182.

The bolt 154 is then driven forward by now unbalanced pressure and spring forces on its rear surface, pushing the bolt 154 and projectile 116 forward in the barrel 108 and blocking the projectile feed passage 112, preventing the entry of additional projectiles 116. When the bolt 154 has moved sufficiently far forward that the spring guide seal 174 enters the increased diameter hollow portion at the rear of the bolt 154, disengaging the spring guide seal 174 from the bolt 154 internal bore, gas flows through the purge holes 158 in the spring guide 156 and through the aperture of the bolt 154, to the rear surface of the projectile 116.

The action of the gas pressure on the projectile 116 will cause it to accelerate through and out of the barrel 108 and optional barrel extension 110, at which time the barrel 108, barrel extension 110, breech 106, valve passage 122 rearward of the valve slider 182, and all communicating passages which are not sealed will vent to atmosphere.

When the pressure within the valve passage 122 rearward of the valve slider 182 has been reduced to sufficiently low pressure such that the force induced on the valve slider 182 no longer exceeds that of the valve spring 196, the valve slider 182 will slide rearward until its 40 motion is restricted by the sear 184. The sear 184 will rest against the front of the trigger 208, and may exert a (clockwise in drawing) torque helping to restore the trigger 208 to its 53 resting position, depending on the design of the position of the trigger pivot 210 relative to the point of contact with the valve slider 182.

Under the action of the bolt spring 162, the bolt 154 will continue to move forward, compressing gas within the space ahead of the bolt rear seal 172 in so doing, and, since there is only a small gap by which the gas may escape into the upper gas feed passage 120, the bolt 154 will be decelerated, minimizing wear on the bolt bumper 160 and stopping in its preferred resting position.

When the trigger 208 is released, the action of the trigger spring 212, sear spring 204, and valve spring 196 will return the components to the preferred ready-to-fire configuration, as in Step 1 above.

Fully-Automatic Operation of the Compressed Gas-Powered Projectile Accelerator:

The preferred ready-to-operate configuration for fully-automatic operation is the same as described above for semi-automatic operation except that the mode selector cam 206 is positioned so as to restrict the forward travel of the sear 184, i.e. with the largest diameter section of the mode selector cam 206 interacting with the sear 184.

The trigger 208 is then pulled rearward, pulling the sear 184 downward, disengaging it from the valve slider 182.

Under the force applied by the valve spring 196, the valve slider 182 then slides rearward, until it is stopped by contact of its rear bumper with the cocking assembly housing 222, allowing gas to flow into the region of the breech 106 ahead of the bolt rear seal 172 and into the region of the valve passage 122 ahead of the enlarged portion of the valve slider 182 (adding pressure force to hold the valve slider 182 rearward in addition to the valve spring 196 bias). The mode selector cam 206 prevents the sear 184 from sliding forward sufficiently far to disengage from the trigger 208.

The pressure of the gas causes the bolt 154 to slide rearward, until the bolt rear seal 172 passes the front edge of the bolt rest-point slot 136, allowing gas into the bolt rest-point slot 136, valve passage 122 rearward of the valve slider 182, rear passage, and region of the breech 106 behind the bolt 154. The projectile 116 enters the barrel 108 either by gravity, a positive bias or a negative pressure, such as the suction induced by the motion of the bolt 154. Additional projectiles 116 in the projectile feed passage 112 are blocked from entering the barrel by the projectile 116 already in the barrel 108. The combined force of the bolt spring 162 and the pressure behind the bolt 154 bring the bolt 154 to rest, preferably without contacting the breech cap bumper 248 at the rear of the breech 106. The bolt 154 will remain approximately at rest, where its position will only adjust slightly to allow more or less gas through the bolt rest-point slot 136 as required to maintain a balance of pressure and spring forces on it while the pressure continues to increase.

Once the pressure in the valve passage 122 rearward of the valve slider 182 has increased sufficiently to overcome the force of the valve spring 196 on the valve slider 182, the valve slider 182 will be pushed forward until the front valve slider bumper 250 contacts the step in the valve passage 122, thereby simultaneously stopping the flow of compressed gas from the source gas passage 140, and allowing the flow of gas from the region of the breech 106 ahead of the bolt rear seal 172 and the region of the valve passage 122 ahead of the enlarged portion of the valve slider 182 into the valve passage 122 rearward of the valve slider 182, which is in communication with the region of the breech 106 behind the bolt 154.

The bolt 154 is then driven forward by the now unbalanced pressure and spring forces acting on it, pushing the projectile 116 forward in the barrel 108 and blocking the projectile feed passage 112, preventing the entry of additional projectiles 116. When the bolt 154 has moved sufficiently far forward that the spring guide seal 36 enters the increased diameter hollow portion at the rear of the bolt 154, disengaging the spring guide seal 36 from the bolt 154 internal bore, gas flows through the purge holes 158 in the spring guide 156 and through the center of the bolt 154, into communication with the rear surface of the projectile 116.

The action of the gas pressure on the projectile 116 will cause it to accelerate through and out of the barrel 108 and barrel extension 4, at which time the barrel 108, barrel extension 4, breech 106, valve passage 122 rearward of the valve slider 182, and all communicating passages which are not sealed will vent to atmosphere.

When the pressure within the valve passage 122 rearward of the valve slider 182 has been reduced to sufficiently low pressure such that the force induced on the valve slider 182 no longer exceeds that of the valve spring 196, the valve slider 182 will begin to slide rearward again. If the trigger 208 has not been allowed by the operator to move sufficiently far forward to cause the sear 184 to interfere with the rearward motion of the valve slider 182, the valve slider 182 will continue to move rearward as described above, and the cycle will begin to repeat. If the trigger 208 has been allowed by the operator to move sufficiently far forward to allow the sear 184 to interfere with the rearward motion of the valve slider 182, the valve slider 182 will push the sear 184 rearward into the preferred resting position and will come to rest against the sear 184.

Under the action of the bolt spring 162, the bolt 154 will continue to move forward, compressing gas within the space ahead of the bolt rear seal 172 in so doing, and, since there is only a small gap by which the gas may escape into the upper gas feed passage 120, the bolt 154 will be decelerated, minimizing wear on the bolt bumper 160 and stopping in its preferred resting position, at which point all components will now be in their original ready-to-fire configuration.

Figure 48:
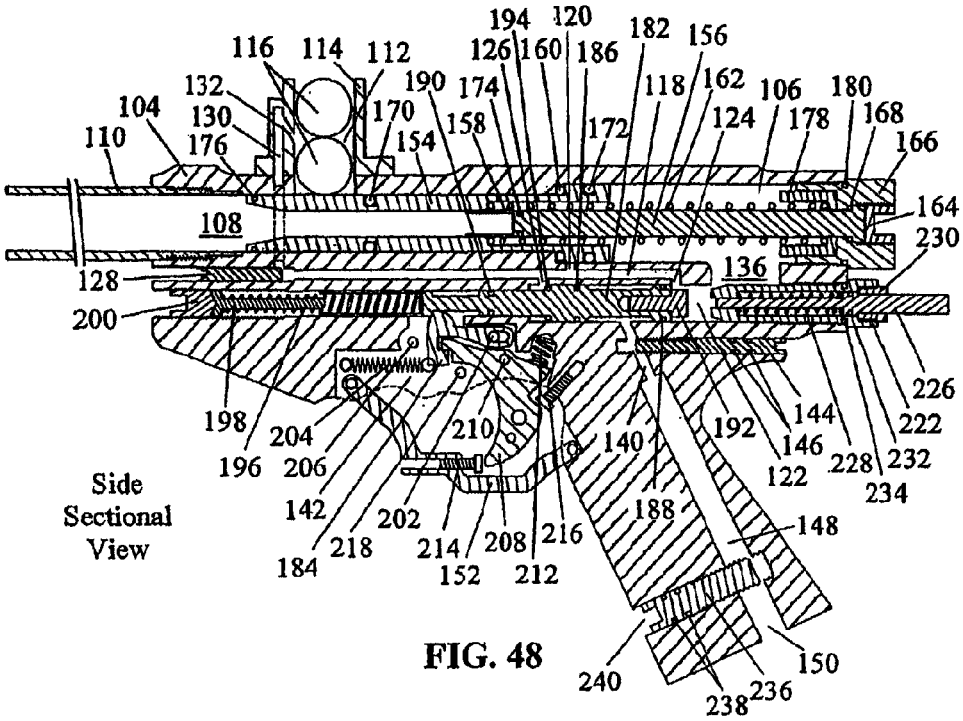
FIG. 48 is a sectional view from the side of a compressed gas-powered projectile accelerator made with improvements of the present invention with the addition of a second throttling screw in the source gas passage.

Pre-Chamber to Independently Adjust First Cycle Rate from Subsequent Cycles:

A second throttling point upstream expanded section of the source gas passage 148, can be formed by the addition of a throttling screw 236 with one or more preferably o-ring/groove type seals 238 about its diameter, threaded into a shaft 240 intersecting the source gas passage expanded section 148, such that the degree of occlusion of the source gas passage expanded section 148 is adjustable by the depth to which the throttling screw 236 has been threaded, as shown in FIG. 48. By adjusting the upstream throttling screw 236 to be more restrictive to the flow through the source gas passage expanded section 148 than the downstream screw 144, after the trigger 208 is pulled, gas flow past the downstream throttling screw 144 can be made to initially exceed that at the upstream throttling screw 236, but will gradually decrease to the same amount as the pressure within the portion of the source gas passage 140, 148 between the throttling screws 150, 236 drops, at which point the flow will remain at a steady rate determined by the most restrictive of the two throttling 150, 236 (set to be the upstream throttling screw 236 as before stated). Because this will cause the chambers ahead of and behind the enlarged diameter portion of the bolt 154 to fill more quickly at first, and then gradually more slowly, the cycle rate will be most rapid on the first cycle, and then will slow on subsequent cycles, the number of cycles required to achieve a steady cycle rate, being determined by the volume and set positions of the throttling 150, 236.

A preferred embodiment can be designed with the volume of the portion of the source gas passage 140, 148 between the throttling 150, 236 sized such that the downstream throttling screw 144 can be adjusted so that steady flow rate is established during the first cycle for a desired range of initial cycle times, thus allowing the position of the downstream throttling screw 144 to primarily adjust the time of the first cycle with all subsequent cycle times determined primarily by the position of the upstream screw 236. Alternatively, similar slowing of the cycle rate can be accomplished with the downstream throttling screw 144 adjusted to be equally or more restrictive than the upstream throttling screw 236; however, in such cases, the initial and ultimately achieved steady flow rates will be dependent on the positions of both throttling 150, 236, rather than the initial flow rate being primarily dependent upon the position of the downstream throttling screw 144 and the steady flow rate being primarily dependent upon the position of the upstream throttling screw 236.

Figure 49:
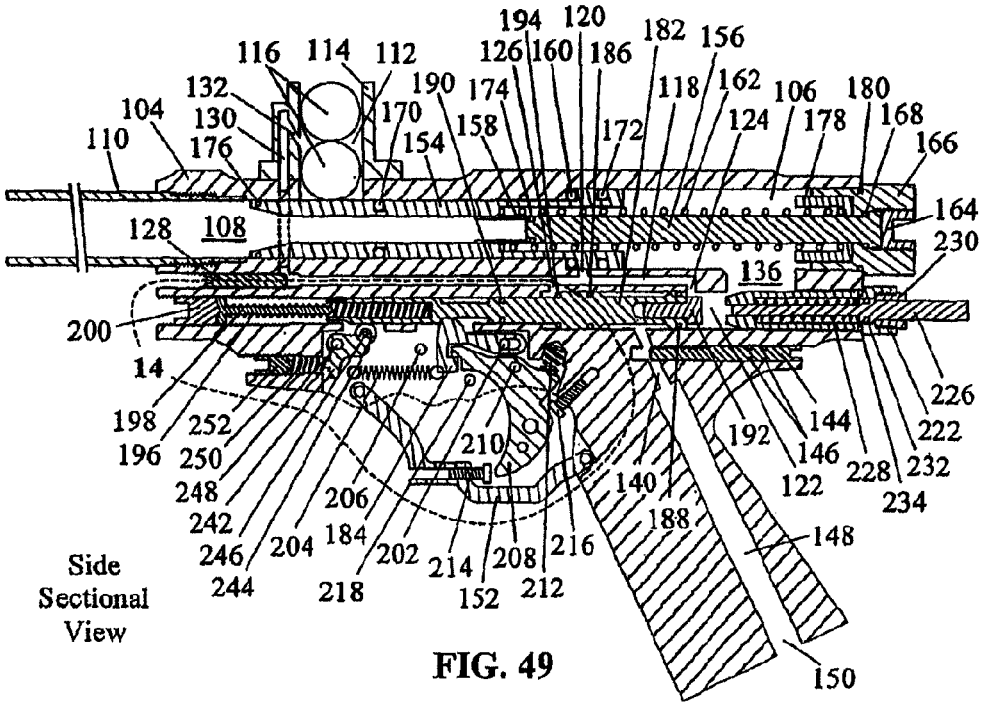
FIG. 49 is a sectional view from the side of a compressed gas-powered projectile accelerator made with improvements of the present invention, prior to operation, showing a valve locking cam in the non-locking position.
Figure 50:
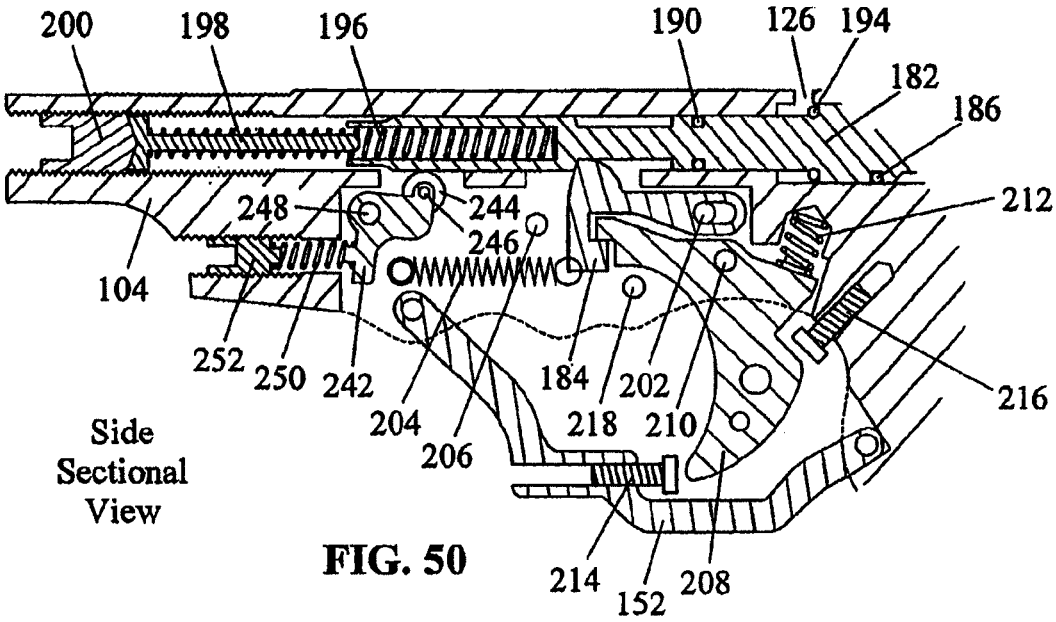
FIG. 50 is a sectional view from the side of the front portion of a compressed gas-powered projectile accelerator made with improvements of the present invention, prior to operation, showing a valve locking cam in the non-locking position, shown to advantage.
Figure 51:
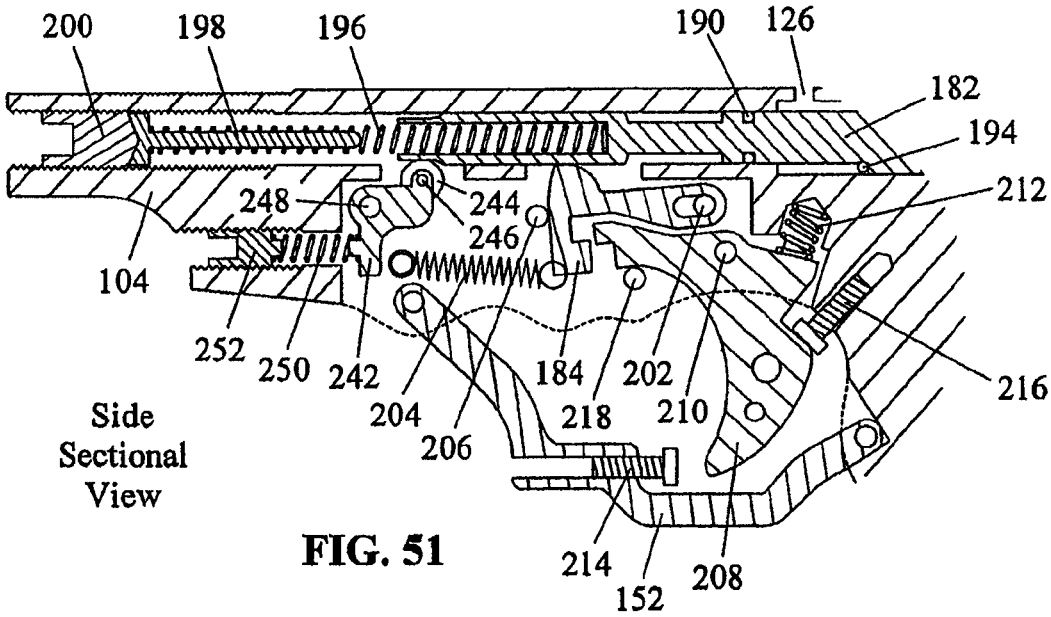
FIG. 51 is a sectional view from the side of the front portion of a compressed gas-powered projectile accelerator made with improvements of the present invention, during operation, showing a valve locking cam in a locking position, shown to advantage.

Mechanical Valve Locking:

A roller cam assembly, comprised of a rocker 242, preferably holding a wheel 244 and pin assembly 246 (but it is to be appreciated that the replacement of the wheel 244 and pin 246 with a geometrically similar protrusion of the rocker 242 will not alter the inventive concepts and principles embodied herein), biased to rotate about a pivot 248 toward the valve slider 182 by a roller cam spring 250, there engaging a detent in the valve slider 182 when in the rearmost position can be optionally included to mechanically increase the force required to push the valve slider 182 forward, as illustrated in FIG. 49 and shown in detail in FIG. 50 and FIG. 51. The roller cam assembly can be used in addition to, as shown, or in lieu of, the valve locking shaft 126 communicating gas ahead of the shoulder in the valve slider 182. During operation, for the valve slider 182 to begin to move forward, the gas must supply sufficient pressure force on the valve slider 182 not only to compress the valve spring 196, but to force the rocker to rotate against the roller cam spring 250 bias. Once the roller cam wheel 244 is fully disengaged from the detent in the valve slider 182, the pressure in the valve passage 122 will now exceed that necessary to continue the motion of the valve slider 182 toward and maintain the valve slider 182 in its foremost position, having to compress the roller cam spring 250 no further. The valve slider 182 will be maintained in its foremost position until the pressure in the valve passage 122 has dropped below that necessary for the valve spring 196 to again move the valve slider 182 rearward. The roller cam spring 250 pushes against, and is retained by a screw 252, which adjusts the tension in the roller cam spring 250 by the depth to which it is threaded into the housing 104. By changing the tension in the roller cam spring 250, the adjustment screw 252 can be used to adjust the amount of force required to push the valve slider 182 forward, thereby acting as an additional or substitute (to tensioning the valve spring 196) method of adjusting the set pressure of the compressed gas-powered projectile accelerator, thereby altering the projectile 116 velocity.

Figure 52:
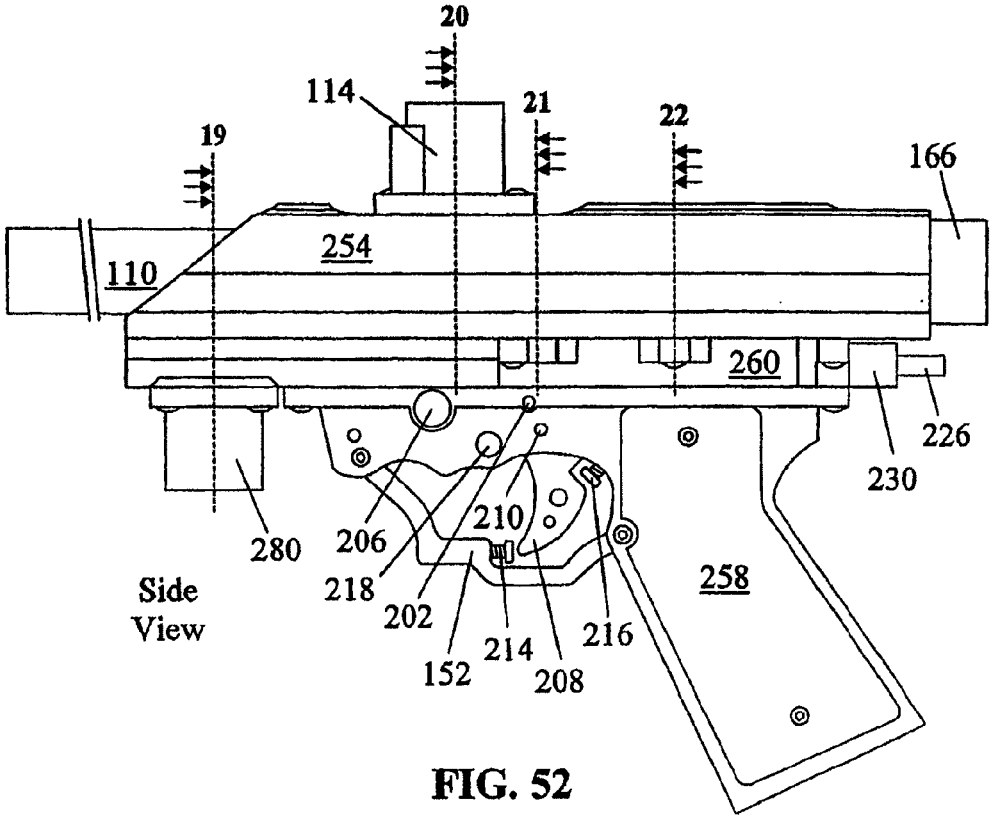
FIG. 52 is a view from the side of an alternate embodiment of a compressed gas-powered projectile accelerator made with improvements of the present invention.
Figure 53:
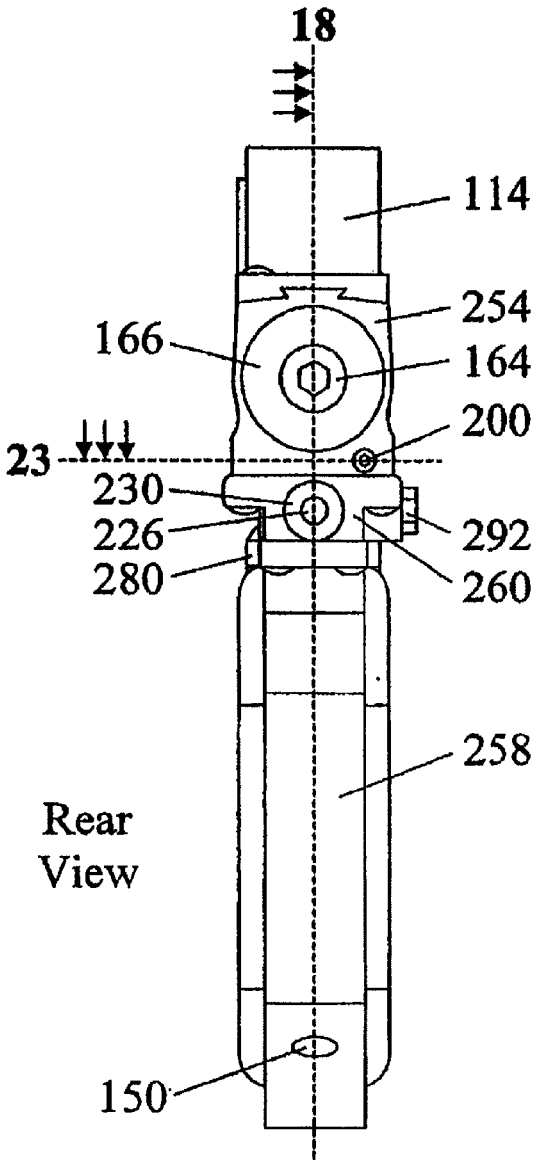
FIG. 53 is a view from the rear of an alternate embodiment of a compressed gas-powered projectile accelerator made with improvements of the present invention.
Figure 54:
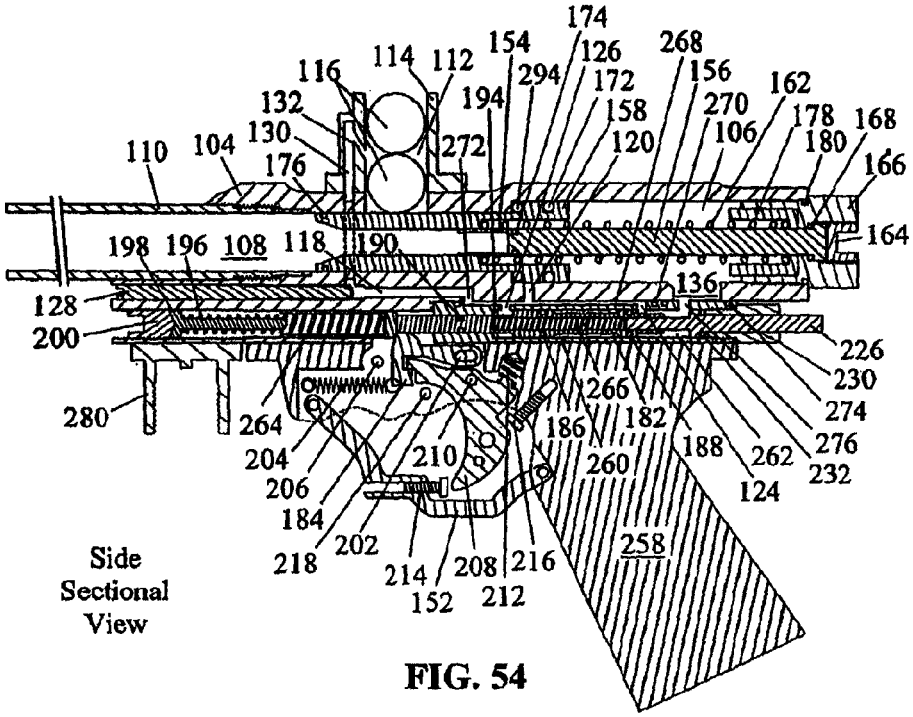
FIG. 54 is a sectional view from the side of an alternate embodiment of a compressed gas-powered projectile accelerator made with improvements of the present invention.
Figure 55:
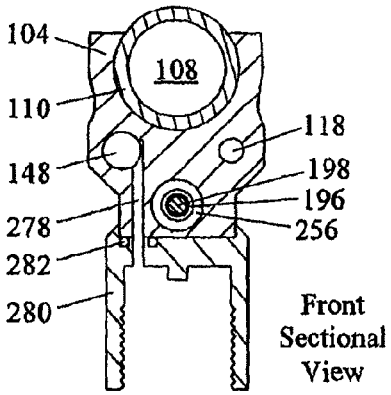
FIG. 55 is a sectional view from the front of an alternate embodiment of a compressed gas-powered projectile accelerator made with improvements of the present invention in the vicinity of the intersection of the vertical source gas shaft, shown to advantage.
Figure 56:
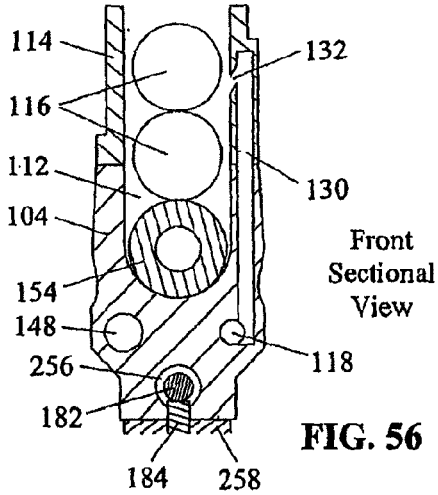
FIG. 56 is a sectional view from the front of an alternate embodiment of a compressed gas-powered projectile accelerator made with improvements of the present invention in the vicinity of the intersection of the feed-assist shaft and gas distribution passage, shown to advantage.
Figure 57:
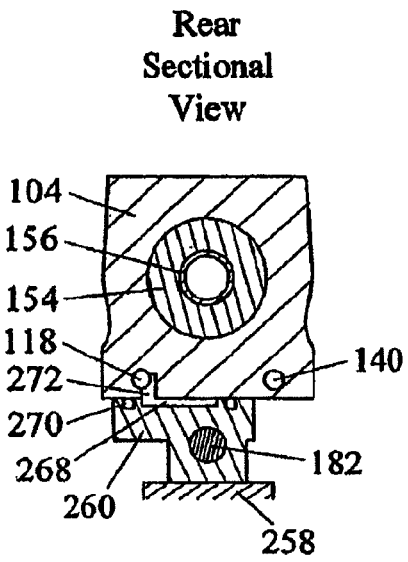
FIG. 57 is a sectional view from the rear of an alternate embodiment of a compressed gas-powered projectile accelerator made with improvements of the present invention in the vicinity of the vertical shaft connecting the valve module slot and gas distribution passage, shown to advantage.
Figure 58:
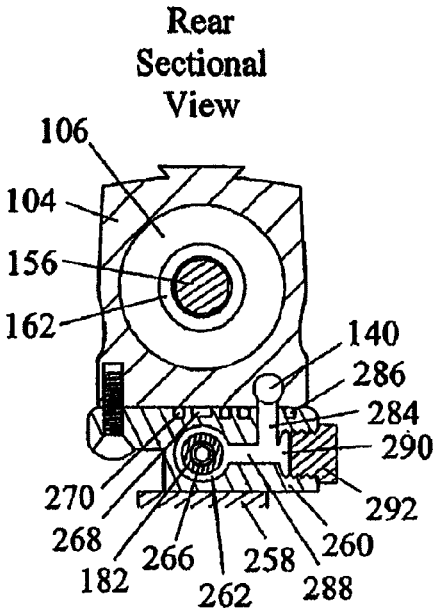
FIG. 58 is a sectional view from the rear of an alternate embodiment of a compressed gas-powered projectile accelerator made with improvements of the present invention in the vicinity of the rear source gas shaft, shown to advantage.
Figure 59:
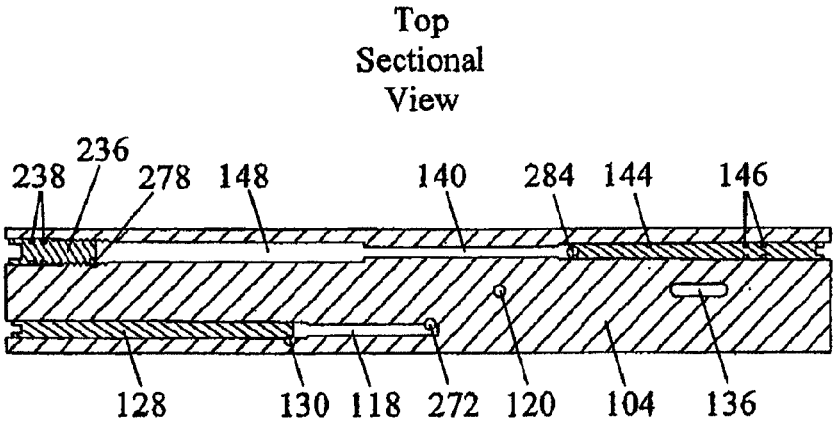
FIG. 59 is a sectional view from the top of an alternate embodiment of a compressed gas-powered projectile accelerator made with improvements of the present invention in the vicinity of a source gas passage incorporated into the upper housing.
Figure 60:
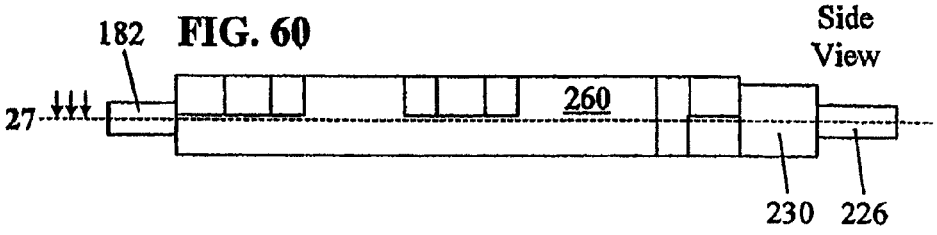
FIG. 60 is a view from the side of a valve module made according to the present invention, shown to advantage.
Figure 61:
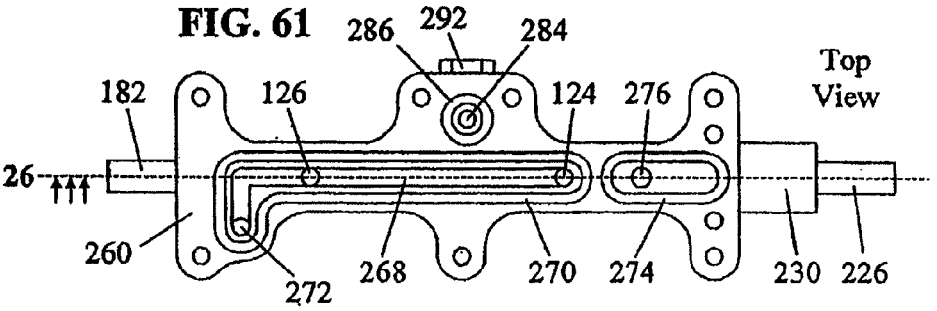
FIG. 61 is a view from the top of a valve module made according to the present invention, shown to advantage.
Figure 62:
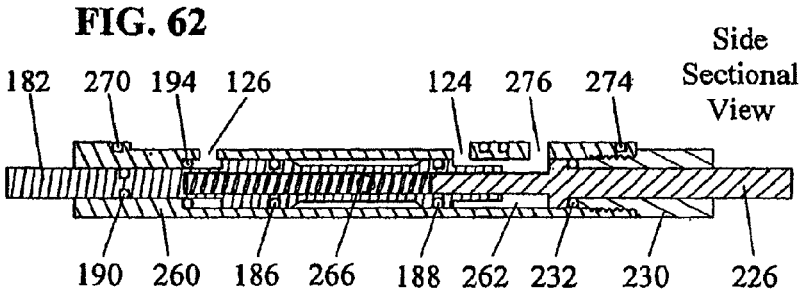
FIG. 62 is a sectional view from the side of a valve module made according to the present invention shown to advantage.
Figure 63:
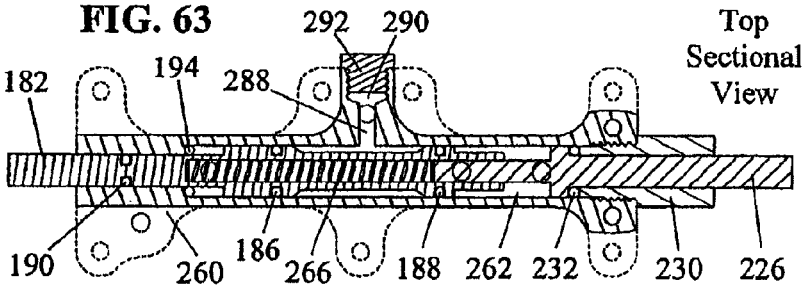
FIG. 63 is a sectional view from the top of a valve module made according to the present invention, shown to advantage.

Valve Module with Integrated Cocking Button:

An alternate embodiment of the compressed gas-powered projectile accelerator is shown in FIGS. 52-23, comprised as before, but where the single piece housing 104 is replaced by three components comprised of an upper housing 254, containing the barrel 108, breech 106, gas distribution passage 118 (again shown centered in the same plane as the barrel 108, breech 106, and valve passage 122 but preferably positioned away from the centerline of the upper housing 254 to facilitate a more compact arrangement and simple intersection with the feed-assist jet 132, and also again optionally not depicted extending to the rear of the upper housing 254), and front half of the valve passage 122 as designated in the previous embodiment, hereafter denoted as the valve spring passage 256; a handle 258, containing the trigger components and to which is connected the trigger guard 152; and a valve module housing 260. The valve slider 182 is truncated to move primarily within a rear valve passage (corresponding to the rear half of the valve passage 122 in the previously described embodiment) within the valve module housing 260, but with an extension into the valve spring passage 256 in contact with a separate hollow spring cup 264 sliding within the valve spring passage 256, replacing the front portion of the valve slider 182 in the previous embodiment.

The truncated valve slider 182 is biased to move forward under the action of a valve slider/cocking plunger return spring 266 located within a cavity inside the truncated valve slider 182 and retained in position by the cocking plunger 226 sliding within the cavity within the valve slider 182, the rear valve passage 262, and the hollow retaining plug 230. The valve slider/cocking plunger return spring 266, which is less stiff than the valve spring 196, serves only to maintain continuous contact between the valve slider 182 and valve spring cup 264, and maintain a bias for the cocking plunger 226 to move rearward, supplanting the similar cocking spring 244 in the previous embodiment (which did not act on the valve slider 182). As in the previously described embodiment, the truncated valve slider 182 forms preferably o-ring/groove type seals at three places with the walls of rear valve passage 262 and it is to be appreciated that the previously described alternate configurations of the valve slider 182 and valve passage 122 shown in FIG. 46 and FIG. 47 can be equally applied to the valve slider 182 and rear valve passage 262 within the valve module housing 260 without altering the inventive concepts and principles embodied therein.

Cocking is accomplished by depression of the portion of the cocking plunger 226 protruding through the hollow retaining plug 230, firstly causing it to slide forward into contact with the truncated valve slider 182 and subsequently pushing the truncated valve slider 182 and valve spring cup 264 forward with continued depression until the valve spring cup 264 has traveled sufficiently far to allow the sear 184, acting under the bias of the sear spring 246, to rotate clockwise into contact with the valve slider 182, thereby preventing rearward return of the valve spring cup 264 when the cocking plunger 226 is allowed to return to its resting position under the bias of the valve slider/cocking plunger return spring 266 by engaging the rear face of the valve spring cup 264. The valve slider/cocking plunger return spring 266 will also act to maintain the valve slider 182 in a forward position, resting against the valve spring cup 264.

Several views of the valve module are shown in detail in FIG. 60, FIG. 61, FIG. 62, and FIG. 63. The interconnectivity of the rear valve passage 262, gas distribution passage 118, and breech 106 is identical to the previously described embodiment, but is accomplished at the interface between the valve module housing 260 and the upper housing 254, rather than through test ports closed with plugs 134 from the side of the housing 104 as in the previously described embodiment. A slot 268 surrounded by a preferably o-ring/groove type seal 270 between the top face of the valve module housing 260 and the corresponding face of the upper housing 254 connects the upper gas feed passage 120, lower gas feed passage 124, valve locking shaft 126, and a vertical shaft 272 intersecting the gas distribution passage 118. A second preferably o-ring/groove type seal 274 surrounds the region of the valve module housing 260 upper face interfacing with the bolt rest-point slot 136 and a hole 276 providing connectivity to the region of the rear valve passage 262 behind the truncated valve slider 182.

While the source gas passage 140 may be incorporated into the handle 258, corresponding to its location in the housing 104 of previously described embodiment through a similar interface as between the valve module housing 260 and upper housing 254, an alternate scheme is illustrated in FIGS. 19-23, where the source gas passage 140 is incorporated into the upper housing 254, preferably parallel and opposite the gas distribution passage 118 with respect to the centerplane (intersecting the barrel 108, breech 106, and valve spring passage 256 centerlines). As in the previous embodiment, the source gas passage 140 can include an expanded section 148 to minimize liquid entry and maximize consistency of entering gas by acting as a plenum. A vertical front source gas shaft 278 connects the source gas passage expanded section 148 to a preferably standard compressed gas bottle mount 280 via a preferably o-ring/groove type seal 282, and, near the front and rear of the upper housing 254, throttling 150, 236 with preferably o-ring/groove type seals 146, 238 control the flow area at the intersections of the source gas passage 140 (and/or the source gas passage expanded section 148) with the vertical front source shaft 272 and a vertical rear source gas shaft 284 extending from the horizontal source gas passage 140 in the upper housing 254 downward through a preferably o-ring/groove type seal between the upper housing 254 and the valve module housing 260 into the valve module housing 260, to intersect a laterally oriented source gas shaft 288 connecting to the rear valve passage 262, functioning similarly to the previously described embodiments. The lateral source gas shaft 288 extends to an access port 290 at the side of the valve module housing 260, primarily an artifact of manufacture and shown blocked by a plug 292 threaded into the access port, but optionally replaceable with a pressure gauge or connectable to an alternate gas source.

It is to be appreciated that the seals 270, 274, 286 between the upper housing 254 and valve module housing 260 can be replaced by an alternate sealing scheme such as a single gasket without altering the inventive concepts and principles embodied therein.

The embodiment shown in FIGS. 52-23 also employs a combined front bolt bumper (160 in the previous embodiment) and seal (170 in the previous embodiment), or bumper seal 294, preferably an o-ring, which, in providing a stationary front bolt seal (not moving with the bolt 154), allows a reduction in the length of the breech 106 and bolt 154 by the distance required for the sliding seal 170 of the previously described embodiment to maintain continuous contact with the breech 106 wall. When not operating, and therefore not under pressure, the bumper seal 96 contact with the bolt 154 and internal surfaces of the breech 106 is maintained by pressure from the bolt 154, biased to move forward by the bolt spring 162 30. When the chamber formed between the step in the breech 106 and bolt 154 diameters is pressurized during operation, unlike in the previously described embodiment where the front bolt bumper 160 moves with the bolt 154, the gas pressure will bias the bumper seal 96 to remain against the step in the breech 106 bore and the smaller bolt 154 outer diameter, thereby preventing gas from leaking around the bolt 154 toward the barrel 108 while the bolt 154 slides rearward, and therefore requiring no forward seal on the bolt 154. The optional small, preferably o-ring/groove type seal 176 shown near the front tip of the bolt 154 does not aid in sealing gas within the chamber formed between the step in the breech 106 and bolt 154 diameters, but functions to minimize gas leakage rearward around the bolt 154 when vented into the barrel 108 through the bolt 154 to accelerate the projectile 116. The front valve slider bumper and foremost valve slider seal 44 may similarly be replaced by a combined front valve slider bumper.

In addition to the valve spring cup 264, the valve spring passage 256 contains identical components (velocity adjustment screw 49, valve spring guide 198, valve spring 196) to the front half of the valve passage 122 in the previously described embodiment. Because the valve spring 196 and valve slider/cocking plunger return spring 296 maintain constant contact between the valve spring cup 264 and truncated valve slider 182, the valve spring cup 264 and truncated valve slider 182 move together, and act in the same fashion as the valve slider 182 of the previously described embodiment; thus function of the alternate embodiment illustrated in FIGS. is identical to that of the previously described embodiment for both semi-automatic and fully-automatic operation.

Additional flow control and valving assemblies for a compressed gas projectile accelerator (or pistol or gun or rifle or marker, all used interchangeably herein) are disclosed herein, for use with any device necessitating the selective restriction and passage of compressed gas. As previously described a housing 298, shown in the figures in the preferred shape of a gun which includes a plurality of hollow passages containing the internal components described herein, and may contain other internal components that are well known in the art of compressed projectile accelerators, such as certain valves, regulators, and reservoirs.

A preferably cylindrical passage of varying cross-sectional diameter is formed as a breech 300, that houses a bolt 340 moveable from a forward position to a rearward position, as described in detail herein. The breech 300 is in communication with a contiguous barrel portion 302 formed in the housing 298 which extends forward the breech 300, the barrel portion 302 being preferably formed as a tubular member 304, which is preferably threaded into barrel portion 302 at the forward end of the housing 298 or otherwise removably attached. The breech 300 is intersected by a projectile feed passage 306 for receiving projectiles 310, which may be partly formed within a projectile feed manifold 308 and partly within the housing 298, into which projectiles 310 are introduced (by any acceptable means such as by a magazine, hopper or loader, as are well known in the art of compressed gas projectile accelerators) from outside the housing 298 and continuing into the housing 298.

Figure 64:
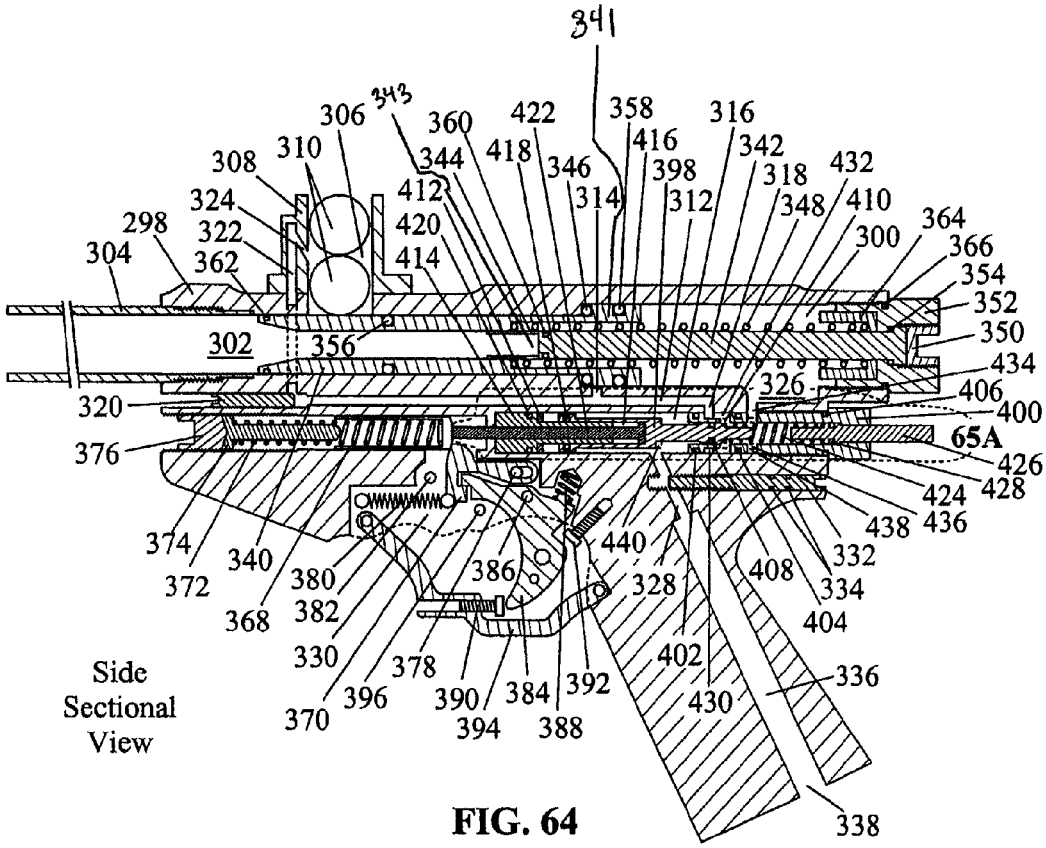
FIG. 64 is a sectional view from the side of a compressed gas-powered projectile accelerator made with improvements of the present invention.

A preferably cylindrical gas distribution passage 312 is in communication with the breech 300 via an upper gas feed passage 314, and in communication with an also preferably cylindrical valve passage 316 of varying cross sectional diameter by a lower gas feed passage 318. The gas distribution passage 312 may be simply closed at the front of the housing 298 by a plug, or, as shown in FIG. 64, by a throttling screw 320 optionally incorporating a preferably o-ring/groove type seal (not shown), the degree to which the throttling screw 320 partially or completely blocks the intersection of a vertical feed-assist shaft 322 with the gas distribution passage 312 depending on the depth to which the throttling screw 320 has been threaded into the gas distribution passage 312. The feed-assist shaft 322 extends upward into the projectile feed manifold 308, and connects with a feed-assist jet 324. The gas distribution passage 312, feed-assist shaft 322, and feed-assist jet 324 are shown in the same plane as the barrel 302, breech 300, and valve passage 316 centerlines in FIG. 64 for simplicity of interpretation, but are preferably positioned away from (offset from) the centerline of the housing 298 to facilitate a more compact arrangement and simplify the intersection of the feed-assist shaft 322 with the gas distribution passage 312 and feed-assist jet 324 by providing for a vertical path beside the barrel 302. Also for ease of understanding, the gas distribution passage 312 is not depicted extending to the rear of the housing 298 in FIG. 64; however, for manufacturing simplicity, provided that it is staggered so as to not intersect the bolt rest-point slot 326 (discussed below), the gas distribution passage 312 may extend to the rear of the housing 298 and be either closed by a simple plug or a throttling screw applied to the intersection with the lower gas feed passage 318 in similar fashion to the intersection with the feed-assist shaft 322.

A valve passage 316 housing a valve slider 398 is in communication with the breech 300 via a bolt rest-point slot 326, which may include a rear passage 434. The valve passage may be intersected by and in communication with a source gas passage 328, which communicates compresses gas supplied by a compressed gas source (not shown). Compressed gas may be supplied by any known means, and is usually supplied by a gas tank, or a compressor. A trigger cavity 330 is provided for housing a trigger 384, which may have an opening or openings formed to allow extension of control components to the exterior of the housing 298. The source gas passage 328 may be selectively obstructed, preferably by the use of a screw 332, the degree to which partially or completely blocks the passage of compressed gas to the source gas passage 328 being dependent upon the depth to which the screw 332 has been adjusted into a partially threaded hole in the housing 298, intersecting the source gas passage 328. The screw 332 forms a seal with the opening in which it 332 sits, preferably by the use of one or more o-rings in grooves 334. The source gas passage 328 will preferably include an expanded section 336 to minimize liquid entry and maximize consistency of entering gas by acting as a plenum. Gas is introduced through the source gas passage inlet 338 at the base of the housing 298, which may be designed to accept any high pressure fitting.

A hollow bolt 340 having a passage therethrough, sized and shaped to fit within the breech 300, is slidably moveable from a forward position to a rearward position within the breech 300. A preferably cylindrical spring guide 342 is positioned in the rearward portion of the breech 300, and includes a hollow space 343 at the forward end of the spring guide 342 communicating with at least one or, as shown, a plurality of purge holes 344 about its 342 circumference. An elastic bolt bumper 346, which may be formed from any suitable elastic material to provide cushioning, or may optionally be provided as an o-ring, as shown, may be attached to the bolt 340 at an enlarged portion of bolt 341 where the bolt 340 changes diameter, limiting the bolt's 340 forward travel and easing shock in the event of malfunction. A bolt spring 348 surrounds the spring guide 342, which is held in place by a step in its 342 diameter trapped, preferably by a screw 350, within a preferably cylindrical cavity within a removable breech cap 352, which closes the rear of the breech 300, preferably by being threaded into the housing 298. An elastic bumper 354, such as an o-ring, is positioned within the cavity formed between the spring guide 342 diametrical step and the wall of the breech cap 352 penetrated by the spring guide 342 to form a seal and provide alignment tolerance to the spring guide 342. The bolt 340 and spring guide 342 are shown with preferable o-ring/groove type seals 356, 358, 360. An additional, optional, preferably o-ring/groove type seal 362 is shown at the front tip of the bolt 340. A preferably cylindrical elastic bumper 364 which protects the bolt 340 and breech cap 352 in the event of malfunction is held in place between the bolt spring 348 and breech cap 352, partially surrounding the bolt spring 348 and spring guide 342. A preferably o-ring/groove type gas seal 366 also preferably seals the breech cap 352 to the wall of the receiver passage.

A partially hollow spring cup 368 shaped to fit within the valve passage 316 as shown in FIG. 64, is preferably free to rotate about its 368 axis parallel to the barrel portion 302 and breech 300 to minimize wear, particularly from contact with the sear 370 described below, can slide within the valve passage 316. A valve spring 372 within the valve passage 316 and extending partially within the spring cup 368 pushes against the spring cup 368 and against a valve spring guide 374, held in place by a velocity adjustment screw 376 preferably threaded into the valve passage 316, the position of which may be adjusted to increase or decrease tension in the valve spring 372, thereby adjusting the operating pressure of the cycle and magnitude of projectile 310 acceleration. The valve slider 368 can be held in a forward "cocked" position by a sear 370, which can rotate about and slide on a pivot 378. A spring 380 maintains a bias for the sear 370 to slide forward and rotate toward the valve slider 368. Sliding travel of the sear 370 can be limited by means of a preferably cylindrical mode selector cam 382 of varying diameter which can slide along an axis parallel to the rotational axes of the sear 370, the position of which adjusts between semi-automatic and fully-automatic operation.

A trigger 384 which rotates on a pivot 386 is adapted to press upon the sear 370, which partially penetrates the valve passage 316, inducing rotation of the sear 370. A bias of the trigger 384 to rotate toward the sear 370 (clockwise in FIG. 64) is maintained by a spring 388. Forward travel of the trigger 384 is optionally adjustably limited by an optional forward trigger adjustment screw 390, shown threaded into the trigger guard 394, while rearward travel is optionally adjustably limited by an optional rear trigger adjustment screw 392, shown threaded into the housing 298. An optional trigger guard 394 can be attached to the housing 298 to prevent accidental manipulation of the trigger 384. A safety cam 396 of varying diameter can be alternatively positioned to allow or prevent rotation of the trigger 384 and sear 370.

The spring cup 368 pushes against a preferably cylindrical valve slider 398 of varying diameter and having opposite forward and rear ends, which slidably moves in tandem with the spring cup 368 within the valve passage 316 from a forward, first position, to a rearward, second position and from the second position back to the first position. Preferably the rear end of the valve slider 398 slidably moves within a portion of the valve passage including a valve passage cap 400 defining an inner bore (hollow portion) preferably having a portion threaded into the rearward portion of the valve passage 316 and having an inner bore in communication with the valve passage 316. Gas-tight seals 402, 404, 406 are formed between the wall of the valve passage 316 and the outer surface of portions of the valve passage cap 400, which may preferably be by o-ring-in-groove type seals, as shown in FIG. 64.

It is apparent that a portion of the valve passage cap 400 is included in and extends within the valve passage 316. For example, the walls of the valve passage cap 400 essentially extend the walls of the valve passage 316. Accordingly, any references to the valve passage cap 400, or any elements, slots, holes, or passages described as being in or relating to the valve passage cap 400, apply equally to the valve passage 316. The valve passage cap 400 may define a portion of the valve passage 316 in certain embodiments of the present invention. However, it is appreciated that the valve passage 316 could simply be formed or manufactured in the same configuration described herein as relating to the valve passage cap 400, without effecting the operability of the present invention.

A preferably o-ring-in-groove type sliding seal 408 (which is explained in greater detail below) is formed between the enlarged portion 399 of the valve slider 398 and portion of the valve passage cap 400, positioned such that the sliding seal 408 completely traverses a hole, passage or preferably annular slot 410 formed in the wall of the valve passage cap 400 when the valve slider 398 moves from the first or forward position to the second or rearward position. The valve slider 398 is restricted in motion in the rearward direction by mechanical interference of the shoulder of an enlarged section 409 of the valve slider 398 with a forward facing face of the valve passage cap 400 adjacent the seal 402, and restricted in the forward direction by mechanical interference with a preferably elastic guide stem bumper 412, which is preferably positioned on a rearward-facing face of a preferably cylindrical hollow guide stem 414 of varying cross sectional diameter. As shown in FIGS. 64 and 65, the guide stem bumper 412 rests against the shoulder of an enlarged diameter section 415 of the guide stem 414, a smaller diameter portion 417 of which extends rearwardly within a preferably cylindrical hollow cavity 416 formed in the forward or front portion of the valve slider 398. A gas-tight, forward valve slider seal 418 is formed between the outer face 442 of the guide stem 414 and the inner wall of the cavity 416 preferably by means of an o-ring-in-groove type seal 418 adjacent the front edge of the cavity 416 in the valve slider 398. A preferably o-ring-in-groove type seal 420 prevents gas leakage between the guide stem 414 and the valve passage 316 inner wall, causing the guide stem 414 to be held in place against the shoulder of a constriction in the valve passage 316 bore by the contained gas pressure. A pushrod 422 having opposite forward and rear ends, is slidably movable in tandem with the valve slider 398 and extends through the inner bore of the guide stem 414 providing a means of pushing the valve slider 398 rearward against a forward bias effected by a valve counter spring 424 pushing upon the rearmost end of the valve slider 398, as will be explained in greater detail.

The embodiment shown in FIG. 64 optionally includes an optional cocking button 426 having opposite forward and rear ends, slidably moving within the valve passage cap 400 wherein the rear end of the cocking button 426 protrudes out of the rear end of the valve passage cap 400 and to the forward end extends into the valve passage 316. The cocking button 426 is biased to move rearward by the counter spring 424 and retained by mechanical interference between a step in its 426 diameter and a shoulder formed by a step in the bore of the valve passage cap 400 and provides a means of manually assisting the counter spring 424 in pushing the valve slider 398 forward (toward the first position) when the part extending through the valve passage cap 400 inner bore is depressed further into the valve passage cap 400. The cocking button 426 forms a gas-tight seal 428 with the internal bore of the valve passage cap 400, preferably by means of an o-ring-in-groove type seal. The cocking button is optional 426 in that, while the cocking button 426 provides utility to the assembly when used as a part of the compressed gas-powered projectile accelerator by providing a means of cocking, the cocking button 426 is unnecessary for the correct operation of the separable seal and flow control device of the present invention.

FIGS. 65A and 65B show one embodiment of a flow control and valving device according to the present invention, with the sliding components (particularly the valve slider 398) in the cocked (forward) and rearmost positions respectively, for use in a compressed gas-powered projectile accelerator such as shown in FIG. 64. Compressed gas from any acceptable source enters the valve passage 316 through the source gas passage 328 preferably at a location between the forward-most seal 402 of the valve passage cap 402 and the guide stem o-ring 420 contacts the inner wall of the valve passage 316, as shown in FIGS. 65A and 65B. It should be noted that the valve slider 398 does not form an air-tight seals with the portions of the housing 298, or walls of the valve passage 316, or the guide stem, adjacent the valve slider 398. That is, gas may flow around the valve slider 398. Gas-tight seals are provided by the various o-rings (i.e., 408, 418) or other seals described in detail herein.

Gas is released to flow from the source gas passage 328 through the flow control device and valving system of the present invention when the valve slider 398 is moved rearward by force translated from the valve spring 372 to the spring cup 368, and to the pushrod 422, when the trigger 384 is operated, and the sear 370 releases the spring cup 368 as previously described. It is appreciated that any manual, mechanical or gas pressurized means may be employed to apply force to the pushrod 422 of the flow control and valving device of the present invention without altering the inventive concepts embodied herein. For example, while movement of the pushrod 422 is controlled by a spring in FIG. 64, a direct acting mechanical linkage operated by a triggering system could also be used to actuate the pushrod 422. Similarly, a pneumatic system or rod and piston system could be utilized, such as a pushrod activated by a three-way valve as in known paintball markers such as of the "autococking" type, an example of which is shown in U.S. Published patent application Ser. No. 11/150,002, the entire contents of which is incorporated by reference as if fully set forth herein. The pushrod 422 moves rearward upon trigger actuation initiating or beginning a "firing cycle," and thereby moves the valve slider 398 rearward.

As shown in FIG. 65B, when the valve slider rear seal 408 slides past the annular slot 410, a flow passage is opened communicating compressed gas from the source gas passage 328 to the gas distribution passage 312. Gas is communicated from the source gas passage 328 through the valve passage 316 through the annular slot 410 into an annular slot 430 in the valve passage cap 400 outer surface connected by at least one or a plurality of axially aligned grooves 432, also in the outer surface of the valve passage cap 400, into a lower gas feed passage 318 in communication with the outer annular slot 430, and into a gas distribution passage 312 in communication with an upper gas feed passage 314. At the same time, with the valve slider 398 positioned in its rearward position as shown in FIG. 65B, the annular slot 410 is sealed off from communication with the rear part of the valve passage cap 400 inner bore, which is connected to the breech 300 through a rear passage 434 intersecting a bolt rest-point slot 326 by at least one or a plurality of holes 436 through the wall of the valve passage cap 400 intersecting a second annular slot 438 around the circumference of the valve passage cap 400. In addition, optionally, at least one or a plurality of radial grooves 440 can be formed in the shoulder step 409 in the outer diameter of the valve slider 398 to facilitate gas flow from the source gas passage 328 into the annular slot 410 in the inner bore of the valve passage cap 400.

Both seals 408, 418 of the valve slider 398 are sized smaller than the respective retention grooves, as shown in FIG. 66, and move with, rather than against, pressure when the valve slider 398 moves rearward. Thus, the seals 408, 418 are adapted to "float", forming floating pneumatic seals. The floating pneumatic seal design of the present invention offers several advantages, including greatly reduced "breakaway" or "breakout" friction and longer seal life. In the preferred embodiments, the seals 408, 418 form seals between a vertical face of their 408, 418 respective retention grooves and the corresponding surfaces 442 of the guide stem 414 and internal bore of the valve passage cap 400, without contacting the other two walls of their 408, 418 retention grooves as shown in greater detail in FIG. 66. In this "floating" arrangement, the sealing and/or sliding friction force will only be communicated to the valve slider 398 to greatly reduced extent, if at all. The valve slider 398 does not push the seals 408, 418 when moving rearward, but rather the seals 408, 418 actually "chase" the valve slider 398 under the action of the gas sealing pressure; thus, the seals 408, 418 contribute little to no resistance to the motion of the valve slider 398 in the rearward direction, and the flow control and valving device of the present invention will exhibit a greatly reduced "breakaway-friction." This reduced friction reduces wear on the moving parts of the valve and makes the trigger pull easier.

The bolt 340 movement and firing operation of the compressed gas powered projectile accelerator is described in detail above, and as set forth in detail in U.S. Pat. No. 6,708,685 and U.S. Published Patent Application No. 2004/0065310 (Ser. No. 10/656,307), the entire contents of both of which are incorporated by reference as if fully set forth herein. With the valve slider 398 in its rearward most position, gas will flow from gas distribution passage 312, into the breech 300, and move the bolt 340 rearward. When the enlarged portion 341 of the bolt 340 reaches the bolt rest-point slot 326, gas will flow to the rearward portion of the breech 300, per the operating scheme outlined above, and as set forth in detail in U.S. Pat. No. 6,708,685 and U.S. patent Application No 2004/0065310 (Ser. No. 10/656,307). The valve slider 398 will reset to its forward position when the force of gas returning from the bolt rest-point slot 326 through rear passage 434 into the bore of the valve passage cap 400 and counter spring 424 overcomes any rearward gas and/or spring bias. When the valve slider 398 moves to its 398 forward-most position, gas from the source gas passage 328 is again contained and gas in the gas distribution passage 312 is communicated through the valve passage cap 400 into the bolt rest-point slot 326 and the rear passage 434.

Figure 67A:
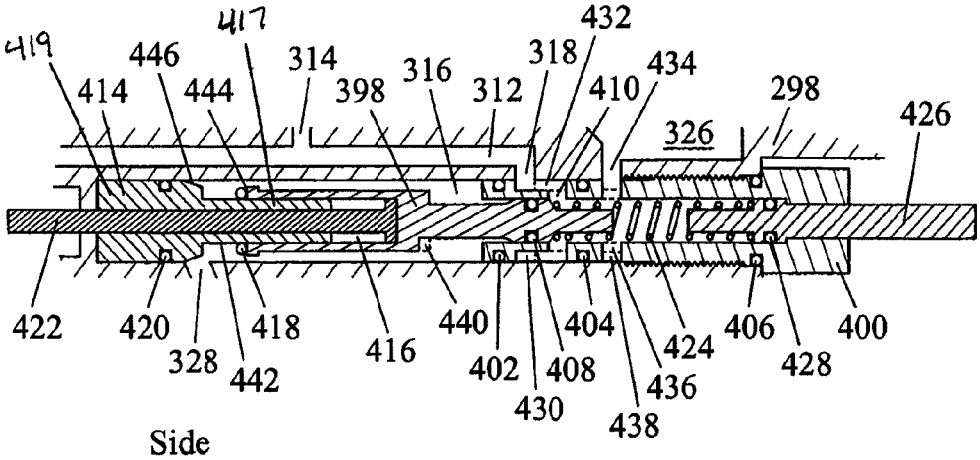
FIG. 67A is a sectional view from the side of a flow control device made according to the present invention with an uncontained forward-most valve slider seal surrounding a valve slider guide stem, but not affixed within a groove, shown with the valve slider in the cocked position.
Figure 67B:
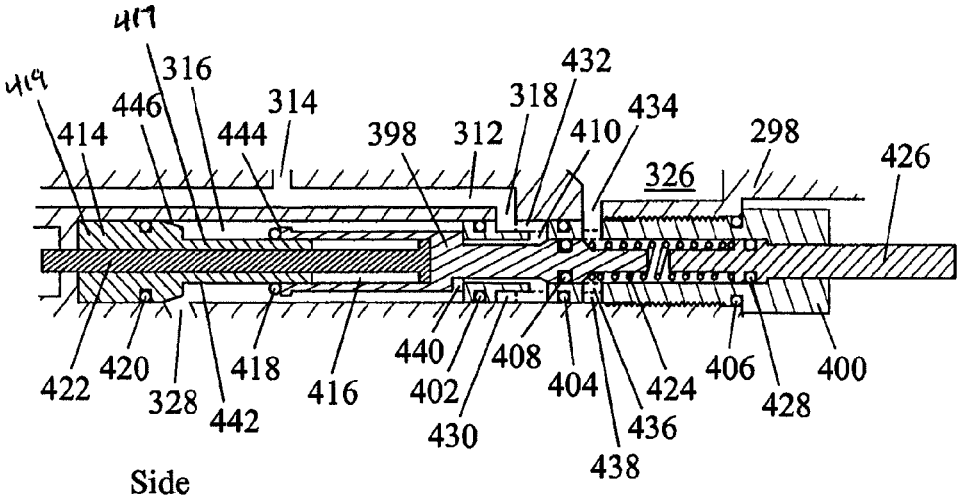
FIG. 67B is a sectional view from the side of a flow control device made according to the present invention with an uncontained forward-most valve slider seal surrounding a valve slider guide stem, but not affixed within a groove, shown with the valve slider in the rear-most position.

FIGS. 67A and 67B show another embodiment of a flow control and valving device of the present invention for use in connection with a compressed gas projectile accelerator (gun or marker) such as shown in FIG. 64, with the sliding components in the cocked (forward) and rearmost positions respectively. In this embodiment, a flow control device made according to the present invention includes a valve slider 398 that has been modified at the forward end, so that the forward seal 418 is not contained within the valve slider 398. Gas pressure presses the exposed forward seal 418 against the front face 444 of the valve slider 398 and the outer face 442 of the guide stem 414, without the seal 418 being contained in a groove. In other words, gas pressure makes the forward valve seal 418 chase the valve slider 398 as it moves rearward during a firing operation; a portion of the valve slider 398 does not push the forward valve seal 418. This simplifies manufacture and allows the seal 418 to double as an elastic bumper, supplanting the need for the guide stem bumper 412 in the embodiment shown in FIGS. 65A and 65B. Whereas the action of the seal 418 is unchanged when under pressure, since the seal 418 is not mechanically constrained to remain adjacent the sealing surface of the valve slider 398, the source gas passage 328 is positioned forwardly adjacent an added tapered section 446 at the rear part of an enlarged diameter section 419 of the guide stem 414, such that gas flow and pressure maintain a consistent bias to push the front valve slider seal 418 against the front face 444 of the valve slider 398 even with the valve slider seal 418 in its 418 forward-most position. This embodiment otherwise operates similarly to the embodiment discussed in connection with FIGS. 65A and 65B.

Figure 68A:
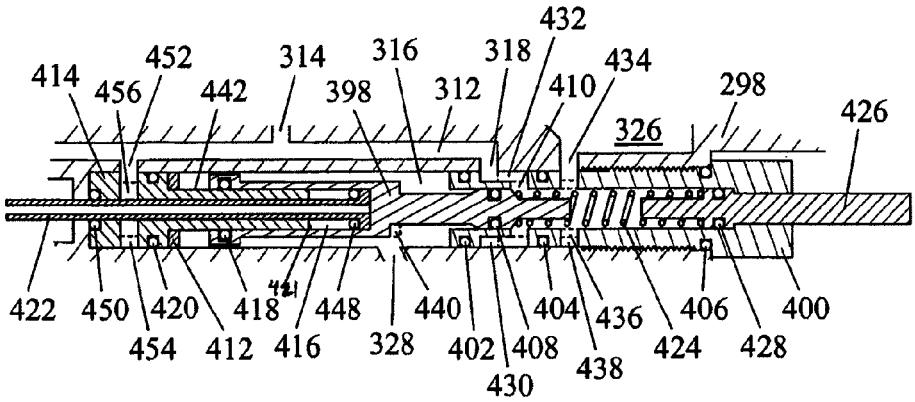
FIG. 68A is a sectional view from the side of a flow control device made according to the present invention incorporating a pneumatic locking feature, shown with the valve slider in the cocked position.
Figure 68B:
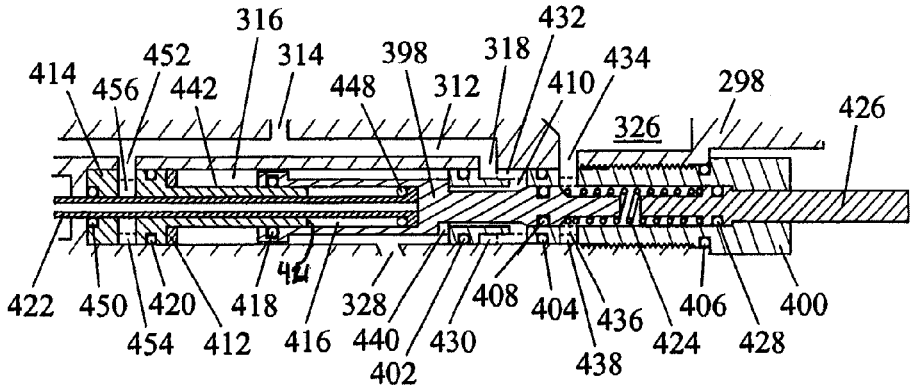
FIG. 68B is a sectional view from the side of a flow control device made according to the present invention incorporating a pneumatic locking feature, shown with the valve slider in the rear-most position.

FIGS. 68A and 68B show another embodiment of a flow control and valving device of the present invention for use in connection with a compressed gas projectile accelerator (gun or marker) such as shown in FIG. 64, with the sliding components in the cocked (forward) and rearmost positions respectively. A flow control and valving device made according to the this embodiment of present invention incorporates a pneumatic locking chamber formed in part by a preferably o-ring type seal 448 positioned adjacent the rearward end of the pushrod 422. The pushrod 422 in this embodiment has an internal bore running therethrough to communicate ambient, external gas pressure to the face at the rearward end of the internal hollow cavity 416 in the forward portion of the valve slider 398. An additional, preferably o-ring-in-groove type seal 450 is positioned between the pushrod 422 and a modified guide stem 414 and a step in the valve passage 316 bore.

When the valve slider 398 is moved rearward by the pushrod 422, gas flows out of the valve passage and into the gas distribution passage 312 in a similar manner as that described above in connection with the embodiments shown in FIGS. 65A, 65B, 67A and 67B. The gas also flows through the gas distribution passage 312, and through a communicating intersecting valve locking passage 452, into an annular groove 454 in the outer diameter of the modified guide stem 414, through one or, as illustrated, a plurality of guide stem holes 456, and through the gap between the outer face 442 of the guide stem 414 and the pushrod 422 rearward of the valve locking passage 452, into a portion of the cavity 416 of the valve slider 398 between the seal 448 and the rearward portion 421 of the guide stem 414, thereby causing gas pressure to apply an additional bias to the valve slider 398 to move and/or remain rearward until the gas is vented (such as through firing the gun/marker and releasing the compressed gas through the bolt 304 to fire a projectile 310). Because there is no pressure differential across the seal 450 between the forward most portions of the guide stem 414 and pushrod 422, virtually no or very little friction is contributed by the seal's 450 addition on the rearward opening stroke of the valve slider 398. In addition, it is preferred that the seal 450 floats within its groove. A compressed gas projectile accelerator incorporating the embodiment of the present invention shown in FIGS. 68A and 68B operates as described above, with the addition of the pneumatic locking chamber feature.

As shown, with this seal 450 formed as an o-ring located in a female groove formed between a step in the guide stem 414 inner bore and valve passage 316, some friction may be contributed on the return stroke, which can be minimized by keeping the diameter of the pushrod 422 small. Alternatively, for larger scale applications, the seal 450 could instead be formed as an o-ring in a male groove located on the pushrod 422 outer diameter (provided the wall is designed with sufficient thickness in the vicinity of the seal 450), in which case it 450 will contribute little friction, provided the seal 450 floats within its 450 groove, as described above.

Figure 69A:
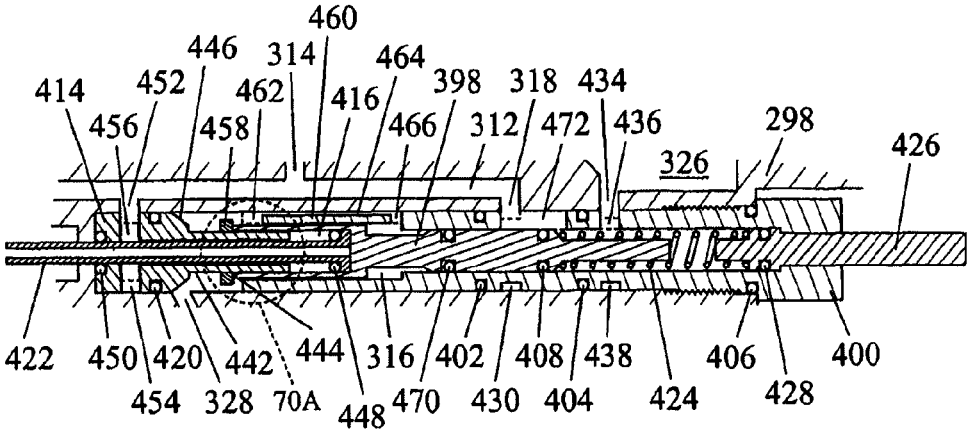
FIG. 69A is a sectional view from the side of a flow control device made according to the present invention incorporating a pneumatic locking feature, a forward-most, uncontained, valve slider seal, and a seal separator made according to the present invention, shown with the valve slider in the cocked position.
Figure 69B:
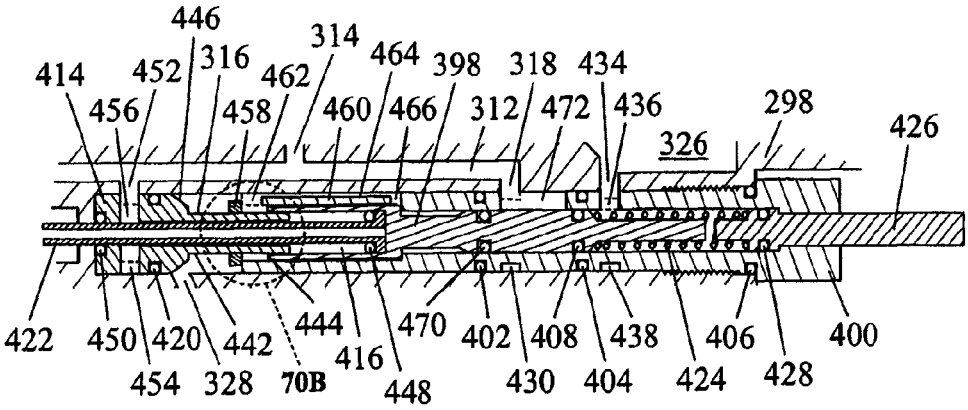
FIG. 69B is a sectional view from the side of a flow control device made according to the present invention incorporating a pneumatic locking feature, a forward-most, uncontained, valve slider seal, and a seal separator made according to the present invention, shown with the valve slider in the rear-most position.
Figure 70A:
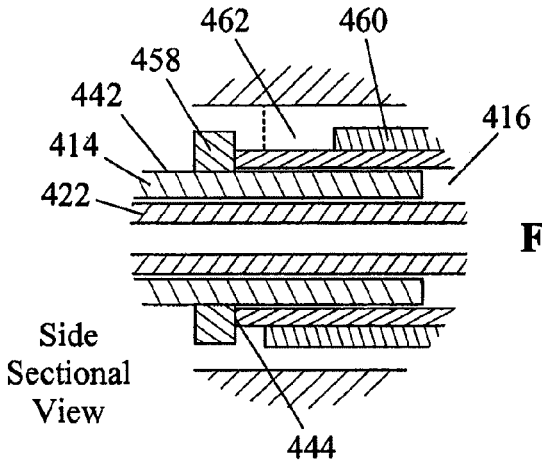
FIG. 70A is a sectional view from the side of the seal separator portion of the separable seal made according to the present invention in the closed position, shown to advantage.
Figure 70B:
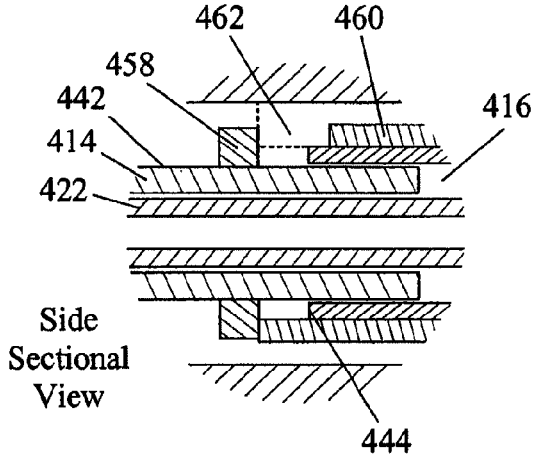
FIG. 70B is a sectional view from the side of the seal separator portion of the separable seal made according to the present invention in the open position, shown to advantage.
Figure 71:
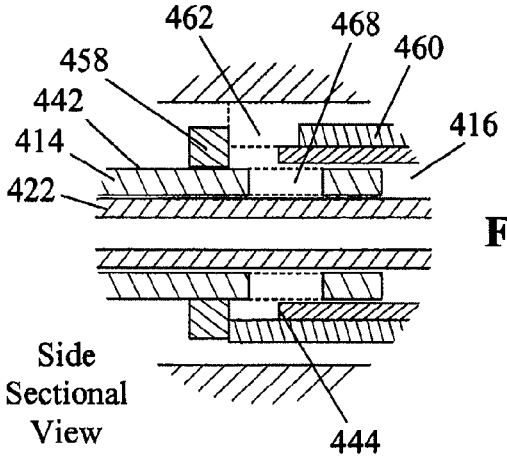
FIG. 71 is a sectional view from the side of the seal separator portion of the separable seal made according to the present invention, shown to advantage, with optional vent holes added to the end of a valve slider stem in the open position.

FIGS. 69A and 69B show another embodiment of a flow control and valving device of the present invention for use in connection with a compressed gas projectile accelerator (gun or marker) such as shown in FIG. 64, with the sliding components in the cocked (forward) and rearmost positions respectively. In this embodiment of a flow control and valving device according to the present invention, gas contained within the valve passage 316, is released through a modified, separable forward-most valve slider seal 458. Here, the forward-most seal 458, preferably an elastic square-ring, forms a seal between the front face 444 of the valve slider 398, and also between the cylindrical outer face of the smaller diameter section of the guide stem 414 (shown in greater detail in FIG. 70A); however, when the valve slider 398 moves rearward (such as under force from modified pushrod 422), the separable seal 458 separates from the front face 444 of the valve slider 398 in part due to mechanical interference with a preferably cylindrical protrusion 460, allowing gas to pass through one or a plurality of holes or, as shown, seal bypass slots 462 in the protrusion 460. The gas passes from the valve passage 316, through these slots 462, into a cavity 416 in the valve slider 398. The gas then flows from the cavity 416, into the gas distribution passage 312 through stem holes 456 and annular grooves 454 and the valve locking passage 452, as explained below. The gas then flows from the gas distribution passage 312, into the upper feed passage 314 and into the bolt, as previously described. Gas also flows through the gas distribution passage 312, into the lower feed passage 318 and through the through-wall slots 472. The gas from the bolt rest point slot 326 flows through the rear passage 434 and holes 436 in the inner bore of the valve passage cap, which pushes o-ring 408 forward until the valve slider 398 is in its forward position, shown in FIG. 69A. The protrusion 460 can optionally be made with either a reduced diameter section to leave a gap between it 460 and the valve passage inner wall or, as shown in FIGS. 69A and 69B, at least one or a plurality of axial slots 464 connecting to at least one or a plurality of vent holes 466 to improve the communication of gas pressure to seat the valve slider middle seal 470, which is preferable a floating seal as previously described. The separable forward-most seal 458 is shown in detail in the closed position in FIG. 70A, with the forward face 444 of the valve slider 398 of this embodiment against the forward-most seal 458, and in the open position in FIG. 70B, with the face 444 of the valve slider 398 moved rearward away from the forward-most seal 458. In FIG. 71 a modified guide stem 414 is shown in detail where at least one or a plurality of holes 468 allow more direct flow of gas into the gap between the inner bore of the guide stem 414 and the pushrod 422, thereby eliminating the need for gas to flow through the gap between the valve slider 398 inner bore and rear end of the guide stem 414.

The valve slider 398 is modified in the embodiment shown in FIGS. 69A and 69B with an additional, preferably o-ring-in-groove type seal 470 adjacent its 398 mid-portion, which forms a seal with the adjacent inner bore of the valve passage cap 400. At least one or a plurality of axial slots 472 through the wall of the valve passage cap 400 take the place of the annular slot 410 in the valve passage cap 400 and shallower slots 432 on the outer surface of the valve passage cap 400 shown in the previous examples in the prior embodiment. The length of the axial slots 472 has been extended compared to the annular slot 410 shown in the previous examples such that the rearmost seal 408 of the valve slider 398 never contacts the forward-most lip of the axial slots 472, thereby eliminating the wear and extrusion associated with travel past the forward lip against a pressure gradient (the annular slot 410 of the previously shown embodiments could equally be extended). When the valve slider 398 is in its 398 rearmost position, the rear valve slider seal 408 prevents communication of gas from the gas distribution passage 312 into the rear passage 434 and bolt rest-point slot 326 as in the previously discussed embodiments.

In the embodiments shown in FIGS. 69A, 69B, 70A, 70B, and 71, rather than the compressed gas flowing rearward to gas feed passage 318 when the valve slider 398 moves rearwardly, the gas is channeled forward to stem holes 456, annular grooves 454, and valve locking passage 456, to gas distribution passage 312. In this embodiment incorporating the separating front seal 458, gas flows through seal bypass slot passage 462, between the gap between guide stem 414 outer and the cavity 416 in the valve slider 398, and further through the gap between the pushrod 422 and the inner wall of the guide stem 414, through flow passages formed by 456, 454, 452, and into the gas distribution passage 312. When the valve slider is in its rearward position, as shown in FIG. 69, seal 470 blocks gas from passing rearwardly. Thus, when the valve slider 398 in this embodiment is in the rearward position, the gas is channeled in essentially the opposite direction from the previous embodiments shown in FIGS. 64-68

Figure 72A:
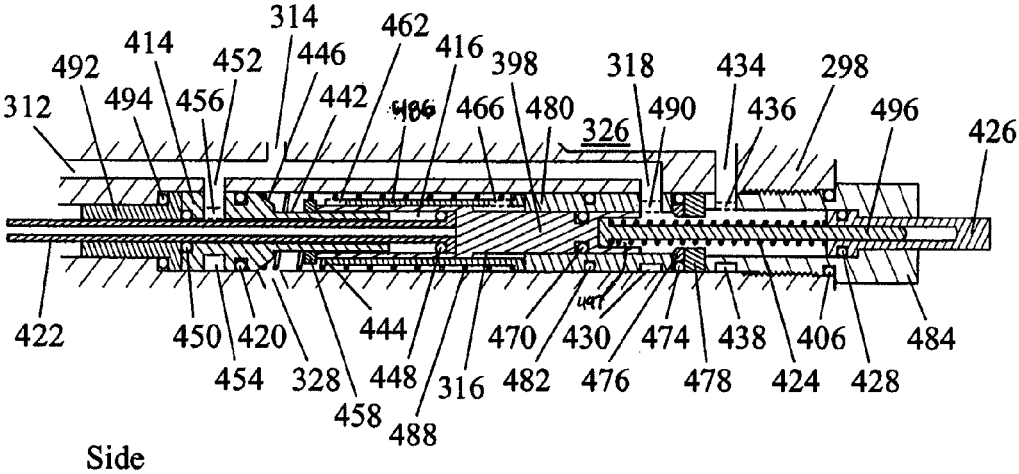
FIG. 72A is a sectional view from the side of a flow control device made according to the present invention incorporating a pneumatic locking feature and a forward-most, uncontained valve slider seal and seal separator made according to the present invention with a face seal replacing the sliding rear-most valve slider seal, shown with the valve slider in the cocked position.
Figure 72B:
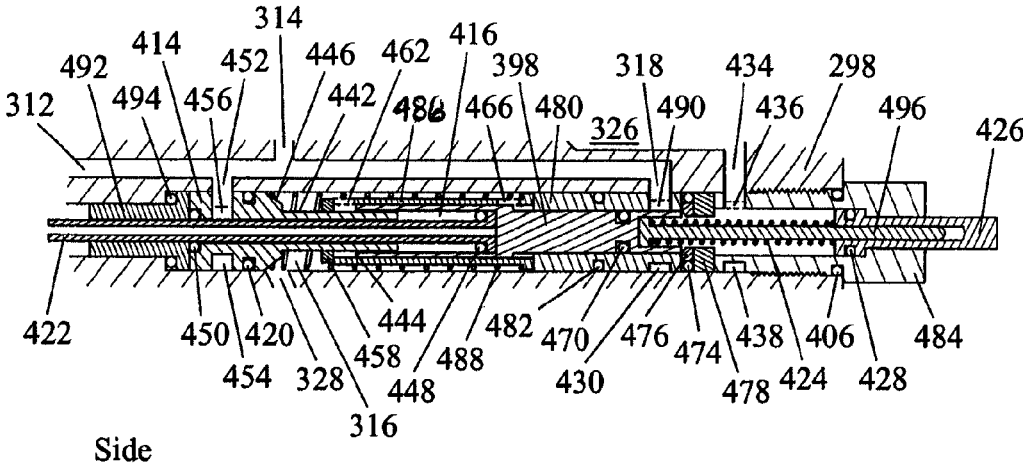
FIG. 72B is a sectional view from the side of a flow control device made according to the present invention incorporating a pneumatic locking feature and a forward-most, uncontained valve slider seal and seal separator made according to the present invention with a face seal replacing the sliding rear-most valve slider seal, shown with the valve slider in the cocked position.

FIGS. 72A and 72B show another embodiment of a flow control and valving device of the present invention for use in connection with a compressed gas projectile accelerator (gun or marker) such as shown in FIG. 64, with the sliding components in the cocked (forward) and rearmost positions respectively. In this embodiment of a flow control and valving device made according to the present invention includes a preferably o-ring type seal 474, annular valve seat 476, and a retention ring 478 that are positioned between a valve slider bushing 480, replacing a portion of the valve passage cap 400 of the previously illustrated embodiments and forming a preferably o-ring-in-groove type seal 482 with the valve passage 316 wall. A truncated valve passage cap 484 is provided against which the valve slider 398 forms a seal when in its 398 rearmost travel position, thereby eliminating the need for the rearmost valve slider sliding seal 408. Accordingly, any breakaway friction contributed by the seal 408 on the initial part (before the pressure on either side of the valve slider rearmost seal 408 equilibrates) of the forward movement of the valve slider 398 when the design set pressure is reached in the dynamic regulation cycle of the gas powered-projectile accelerator of the present invention, is eliminated. The seal separating valve passage cap protrusion 460 of FIGS. 69A and 69B is replaced in part by a separate piece seal separator 486, and certain parts of assembly are maintained in position by a compression spring 488 spanning the gap between the guide stem 414 shoulder 446 and a step in the outer diameter of the seal separator 486. Communication of gas between the lower gas feed passage 318 and valve passage 316 is accomplished via an annular groove 430, as in previously described embodiments (except now located about the circumference of the valve slider bushing 480 taking the place of the equivalent part of the valve passage cap 400 in the previously described embodiments), but connected to the valve passage 316 by at least one or a plurality of mutually intersecting radial holes 490, instead of the inner annular slot 410 and axial slots 432 of the previously described embodiments. To facilitate precise manufacture, rather than directly against the step in the valve passage 316 bore, the forward portion of the guide stem 414 rests against a hollow bushing 492 through which the pushrod 422 extends. The bushing 492 forms a seal 494 with the valve passage 316 wall, preferably by an o-ring type seal captured between a step in the bushing 492 outer diameter and a step in the valve passage 316 bore. A return spring guide 496, moving with and penetrating a cavity 497 made in the rearward portion of the valve slider 398, and slidably moving within the valve counter spring 424 and a hole made partially through the cocking button 426 provides added stability to the valve counter spring 424. The flow of gas in and operation of this embodiment is similar to that described in connection with FIGS. 69A, 69B, 70A, 70B, and 71.

FIGS. 64-72B depict illustrative embodiments of the flow control and valving device of the present invention specifically configured for compatibility with the compressed gas-powered projectile accelerator (gun or marker) of the present invention, but it is to be appreciated that it is equally applicable to numerous other uses for selectively controlling the flow of compressed gas. Whereas the flow control device is connected to passages in the compressed gas-powered projectile accelerator of the present invention to implement the previously described "dynamic regulation" cycle where regulating action of the flow control device is coupled to gas flow around a bolt in a parallel passage, it is to be appreciated that the flow control device of the present invention can equally be employed to statically regulate gas flow in alternate applications, simply by directly connecting the gas distribution passage 312 and rear passage 434, thereby allowing flow into the gas distribution passage 312 to directly communicate pressure into the part of the valve passage 316 rearward of the valve slider 398, resulting in a bias to push the valve slider 398 forward (thereby restricting flow) increasing proportionally with said pressure in the part of the valve passage 316 rearward of the valve slider 398. Further, it is to be appreciated that the separable seal and flow control device of the present invention can be configured in numerous alternate schemes for differing applications without altering the inventive concepts embodied therein, and, in particular, an example of a simple solenoid-driven embodiment is shown to advantage in FIGS. 73A and 73B, with the sliding components in the cocked and rearmost positions respectively, for illustration.

Figure 73A:
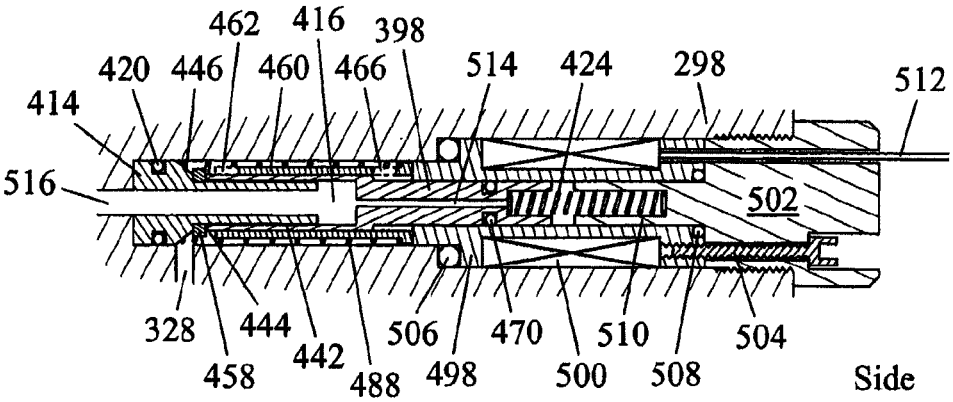
FIG. 73A is a sectional view from the side of a solenoid valve made according to the present invention incorporating a separable, uncontained, forward-most valve slider seal and seal separator made according to the present invention, shown with the valve slider in the closed position.
Figure 73B:
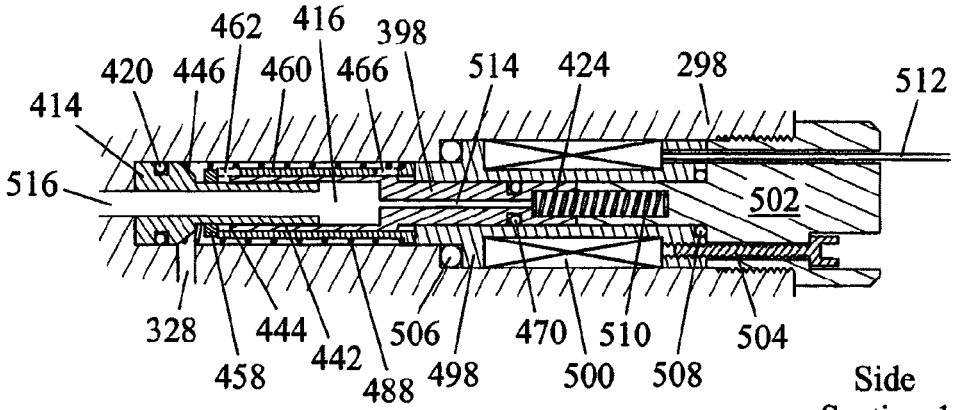
FIG. 73B is a sectional view from the side of a solenoid valve made according to the present invention incorporating a separable, uncontained, forward-most valve slider seal and seal separator made according to the present invention, shown with the valve slider in the closed position.

The embodiment shown in FIGS. 73A and 73B is preferably for use in a "blow forward" style compressed gas gun for use in the sport of paintball, although the flow control device disclosed herein can be used for any suitable application. Blow forward compressed gas gun designs do not use any hammer or in their design. Rather, compressed gas that propels a bolt and/or piston forward, chambering a paintball at the same time. When fired, a gas flow path is opened when the bolt and/or piston is in its forward and firing position, when the piston reaches the end of it's travel a spring pushes it back for another rapid shot. Examples of blow forward style compressed gas guns are the DESERT FOX offered by Indian Creek Designs, Inc., and the AUTOMAG offered by Airgun Designs, Inc. An exemplary blow forward compressed gas gun is shown in U.S. patent application Ser. No. 11/183,548, the entire contents of which is incorporated by reference herein.

In the example embodiment of a flow control and valving device made according to the present invention shown in FIGS. 73A and 73B, a rear portion of the valve slider 398 slidably moves within a non-magnetic coil housing 498 having an inner bore, containing an insulated wire coil 500, which is retained by a magnetic plug 502, to which the housing 498 is fastened with one or a multiplicity of screws 504 for ease of assembly/disassembly. A preferably o-ring type seal 506 is formed between the coil housing 498 and outer or compressed air gun housing 298, and a second preferably o-ring type seal 508 is formed between a step in the bore of the coil housing 498 and a hollow protrusion 510 from the front face of the magnetic plug 502, part-way penetrating the inner bore of the coil housing 498, also serving as a mechanical stop to limit the rearward travel of the valve slider 398. The housing 298, guide stem 414, and valve slider 398 are also magnetic, and when current is applied to the coil 500 via wire leads 512 penetrating the magnetic plug 502, the induced magnetic field will bias the valve slider 398 to move rearward against the force applied by the valve counter spring 424 positioned within hollows in the opposed faces of the valve slider 398 and protrusion 510 from the face of the magnetic plug 502. The valve slider 398 has a channel 514 through its 398 center communicating gas pressure across the valve slider 398 to prevent gas pressure from applying a net force to the valve slider 398. Since magnetic force from the coil 500 acts directly on the valve slider 398 in the example embodiment of FIGS. 73A and 73B, the pushrod 422 shown in previous example embodiments is unnecessary, and the gas outlet 516 is oriented axially in-line with the valve passage 316. The compressed gas flowing through gas outlet 516 will act as other valving arrangements in compressed gas guns of the blow forward type, by moving a bolt and/or piston forward, whereupon the gas is released to fire a chambered projectile, and the bolt and/or piston is reset with a spring.

Co-pending U.S. patent application Ser. No. 11/347,964, "COMPRESSED GAS GUN HAVING REDUCED BREAKAWAY-FRICTION AND HIGH PRESSURE DYNAMIC SEPARABLE SEAL FLOW CONTROL DEVICE," the entire contents of which is incorporated herein by reference, discloses a novel valving system including a spool valve having a reduced breakaway friction, which may be referred to herein as a "Zero Breakaway-Friction Spool Valve" or "ZBF Valve". Such a spool valve could be used for any flow control needs, such as illustrated in U.S. patent application Ser. No. 11/347,964, a compressed gas gun such as a paintball marker (gun) application where gas under pressure valve actuation force translates directly into a light action. Several different embodiments are shown and described in this application, and the various valve arrangements can be used in connection with any embodiment shown herein where gas flow control is used.

FIG. 64 illustrates a compressed gas gun, including a spool valve 398 (also referred to as a "valve slider") according to an embodiment of the present invention. The compressed gas gun includes a housing 298, a breech portion 300, a bolt 340, and a trigger 384. The operation of the gun is described in detail in U.S. patent application Ser. No. 11/347,964. Any of the novel valve configurations of the present invention may be incorporated into the gun shown in FIG. 64, as those in the art would appreciate, and may be used as alternatives to valve slider 398.

FIGS. 65A, 65B and 66 show one embodiment of a flow control and valving device according to the present invention, with certain sliding components (particularly the valve slider 398) in the cocked (forward) and rearmost positions respectively, for use in a compressed gas-powered projectile accelerator (i.e., a compressed gas gun) such as shown in FIG. 64. Compressed gas from any acceptable source (such as a CO2 or NO2 air tank) enters the valve passage 316 through the source gas passage 328 preferably at a location between the forward-most seal 402 of the valve passage 316 cap 402 and the guide stem o-ring 420 contacts the inner wall of the valve passage 316, as shown in FIGS. 7 and 8. It should be noted that the valve slider 398 does not form an air-tight seals 408, 418 with the portions of the housing 298, or walls of the valve passage 316, or the guide stem, adjacent the valve slider 398. That is, gas may flow around the valve slider 398. Gas-tight seals 408, 418 are provided by the various o-rings (i.e., 408, 418) or other seals 408, 418 described in detail herein.

Gas is released to flow from the source gas passage 328 through the flow control device and valving system of the present invention when the valve slider 398 is moved rearward by force translated from the valve spring 372 to the spring cup 368, and to the pushrod 422, when the trigger 384 is operated, and the sear 370 releases the spring cup 368. It is appreciated that any manual, mechanical or gas pressurized means may be employed to apply force to the pushrod 422 of the flow control and valving device of the present invention without altering the inventive concepts embodied herein. For example, while movement of the pushrod 422 is controlled by a spring 372 in FIG. 64, a direct acting mechanical linkage operated by a triggering system could also be used to actuate the pushrod 422. Similarly, a pneumatic system or rod and piston system could be utilized, such as a pushrod activated by a three-way valve as in known paintball markers such as of the "autococking" type, an example of which is shown in U.S. Published patent application Ser. No. 11/150,002, the entire contents of which is incorporated by reference as if fully set forth herein. The pushrod 422 moves rearward upon trigger actuation initiating or beginning a "firing cycle," and thereby moves the valve slider 398 rearward. Thus, valve slider 298 controls operation of the bolt (for example, bolt 340 in FIG. 64) and in turn controls a firing sequence of the gun.

As shown in FIG. 8, when the valve slider 398 rear seal 408 slides past the annular slot 410, a flow passage is opened communicating compressed gas from the source gas passage 328 to the gas distribution passage 312. Gas is communicated from the source gas passage 328 through the valve passage 316 and through the annular slot 410 in the valve passage 316 cap outer surface connected by at least one or a plurality of axially aligned grooves, also in the outer surface of the valve passage cap 400, into a lower gas feed passage 318 in communication with the outer annular slot 410, and into a gas distribution passage 312 in communication with an upper gas feed passage 314. At the same time, with the valve slider 398 positioned in its rearward position as shown in FIG. 65B, the annular slot 410 is sealed off from communication with the rear part of the valve passage cap 400 inner bore, which is connected to the breech 300 through a rear passage intersecting a bolt rest-point slot 326 by at least one or a plurality of holes through the wall of the valve passage cap 400 intersecting a second annular slot 434 around the circumference of the valve passage cap 400. In addition, optionally, at least one or a plurality of radial grooves can be formed in the shoulder step 409 in the outer diameter of the valve slider 398 to facilitate gas flow from the source gas passage 328 into the annular slot 410 in the inner bore of the valve passage cap 400.

Grooves 499 in the slider 398 are preferably formed as a forward (or first) wall 777, a transverse or inner wall 778, and a rearward (or second) wall 779, shown in FIG. 66. The seals 408, 418 of the valve slider 398 are sized smaller than the respective retention grooves, as shown in FIG. 66, and move with, rather than against, pressure when the valve slider 398 moves rearward. Thus, the seals 408, 418, are adapted to "float", forming floating pneumatic seals 408, 418. The floating pneumatic seal design of the present invention offers several advantages, including greatly reduced "breakaway" or "breakout" friction and longer seal life. In the preferred embodiments, the seals 408, 418 form seals between a vertical face (in the example of FIG. 66, one of the rearward wall 779 or the forward wall 777) of their respective retention grooves 499 and a corresponding surface of the guide stem 414 for seal 418 (or another seal contact surface) or the internal bore of the valve passage cap 400 for seal 408, without contacting the other vertical wall or the transverse wall 778 of their retention grooves 499 as shown in greater detail with respect to seal 408 in FIG. 66. The groove 499 and seals 408, 418 can be sized so that the seals 408, 418 contact only one of rearward wall 779 or forward wall 777 and a contact surface (such as stem 414 or inner wall of the channel formed in valve passage cap 400. In this "floating" arrangement, the sealing and/or sliding friction force will only be communicated to the valve slider 398 to greatly reduced extent, if at all. The valve slider 398 does not push the seals 408, 418 when moving rearward, but rather the seals 408, 418 "chase" the valve slider 398 under the action of the gas pressure; thus, the seals 408, 418 contribute little to no resistance to the motion of the valve slider 398 in the rearward direction (as pictured), and the flow control and valving device of the present invention will exhibit a greatly reduced "breakaway-friction." This reduced friction reduces wear on the moving parts of the valve and makes the trigger pull easier.

The groove is formed and sized preferably having a width (measured from the forward wall 777 to the rearward wall 779) that is greater than the diameter of the seal cross-section. The seals 408, 418 are formed and sized so that the seals rest adjacent the opening in the grooves, with a portion adapted to contact a sealing surface outside of the groove (for example, a housing wall) without contacting the transverse or inner wall 778 of the groove 499. This configuration is shown in detail in FIG. 66.

The bolt 340 movement and firing operation of the compressed gas powered gun is described in detail above, and as set forth in detail in U.S. Pat. No. 6,708,685 and U.S. Published Patent Application No. 2004/0065310 (Ser. No. 10/656,307), the entire contents of both of which are incorporated by reference as if fully set forth herein. With the valve slider 398 in its rearward most position, gas will flow from gas distribution passage 312, into the breech 300, and move the bolt 340 rearward. When the enlarged portion 341 of the bolt 340 reaches the bolt rest-point slot 326, gas will flow to the rearward portion of the breech 300, per the operating scheme outlined above, and as set forth in detail in U.S. Pat. No. 6,708,685 and U.S. patent Application No 2004/0065310 (Ser. No. 10/656,307). The valve slider 398 will reset to its forward position when the force of gas returning from the bolt rest-point slot 326 through rear passage 434 into the bore of the valve passage cap 400 and counter spring 424 overcomes any rearward gas and/or spring bias. When the valve slider 398 moves to its forward-most position, gas from the source gas passage 328 is again contained and gas in the gas distribution passage 312 is communicated through the valve passage cap 400 into the bolt rest-point slot 326 and the rear passage.

While shown in the context of a valving system of a compressed gas gun for the purposes of illustration and to demonstrate an example of an application for the valve designs of the present invention, it is appreciated that the ZBF Valve design of the present invention can be used for any valving or flow control regulation needs in any system where valving and/or flow control is required.

Figure 74:
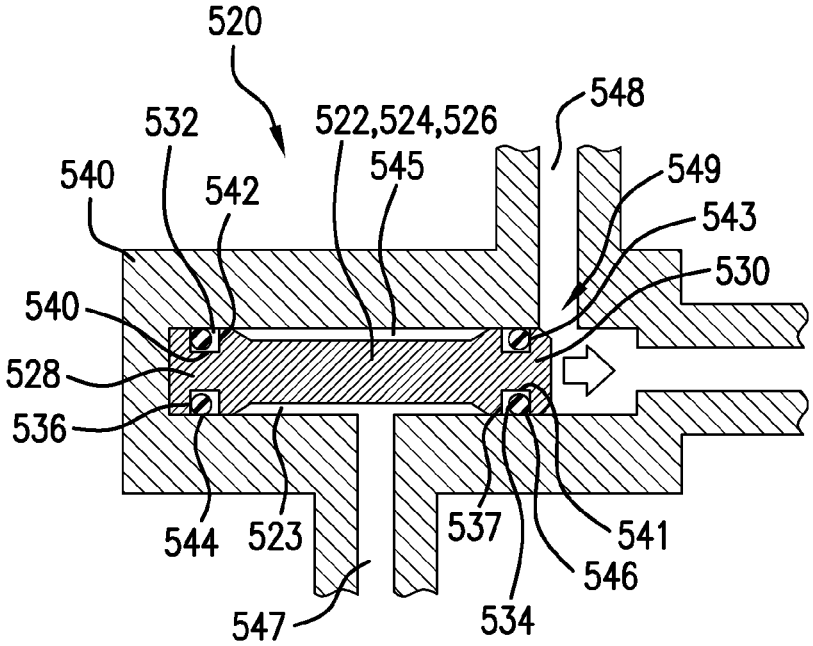
FIG. 74 is a sectional view from the side of a conventional spool valve, further comprising the floating o-ring shown in FIG. 66, in the ready-fire state.
Figure 75:
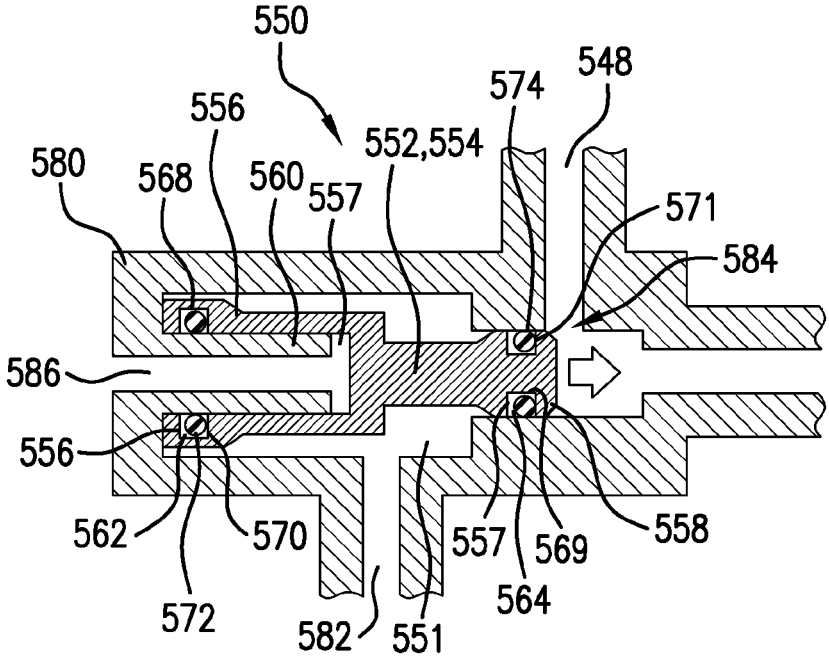
FIG. 75 is a sectional view of a spool valve according to the present invention in the ready-fire state.

A comparison of a valving arrangement incorporating different embodiments of valves is illustrated in FIGS. 74 and 75, where an exemplary spool valve assembly 520 (FIG. 74) may be compared to an embodiment of a valve assembly 550 of the present invention (FIG. 75). It is appreciated that the actuation member or means of actuation of such a valve may be, by way of example and not by way of limitation, piston, a plunger, a spring, gas, gas under pressure, a solenoid valve, an air compressor, or any combination thereof, however, those in the art will appreciate that any valve activation means may be provided. For example, actuation member shown as pushrod 422 operates by spring bias action, biasing the exemplary valve to the rearward position. As previously discussed, it is contemplated that any actuation member or actuation element or system may be used, such as, but not limited to, a mechanical system, a pneumatic system, an electric system, an electro-pneumatic system, a motor, any combination thereof, or any similarly operating arrangements could be used to bias the valve sliders or spools described herein. Any of the previously discussed activation means or mechanisms may be utilized, or any combinations thereof.

Referring generally to FIG. 74, an embodiment of a valve assembly 520 features a spool 522 having a generally barbell shape, positioned for sliding movement within a valve housing 540 in a spool passage 545 including a body 524 having a middle portion 526 of a decreased diameter, and opposite end portions 528, 530 having a diameter preferably larger than the middle portion 526. Each of the end portions 528, 530 include grooves 532, 534 forming first walls 536, 537, transverse walls 540, 541, and second walls 542, 543. Seals 544, 546, such as o-rings, are positioned within the grooves 532, 534. Preferably, the seals 544, 546 are sized as "floating" seals, as discussed above and shown in detail in FIG. 66, where the seals 544, 546 are sized to contact only one of the first 536, 537 or second 542, 543 walls, and a wall 551 of the valve housing 540, but do not contact the other wall or transverse wall 540, 541, as shown in FIGS. 66 and 74.

As gas under pressure enters through the input flow passage 547 and flows around the spool 522 into area 523 of the spool passage 545, the gas exerts a pressure across the spool 522, such as on the left spool seal 544, urging it toward the first wall 536 of the groove 532 located adjacent the first end 528 of the valve body 524. Gas similarly exerts a pressure force on the spool seal 546, urging it toward the second wall 543 of the second groove 534. The gas may be released through the output flow passage 548 once the second end 530 of the spool 522 has passed by the output channel opening 549.

In spool valve assembly 520, most of the breakaway friction can be attributed to the spool seal 544 (such as an o-ring) that moves against the pressure gradient (leftmost in FIG. 74). This is because motion of the spool 522 results in immediate compression and displacement of the left spool seal 544, but pressure is generally relaxed on the right o-ring 546 when the spool initially moves toward the open (rightward) position, e.g., the right o-ring 546 is not pushed by the spool but rather chases it under the action of pressure.

As shown in FIG. 75, an embodiment of a valve assembly 550 of the present invention employs a spool 552 having an open-ended cylindrical cavity 552 at one end, or "socket spool". The socket spool 552 includes a central body portion 554, a left or first end 556 forming a preferably cylindrical "socket" or cavity 557 having an opening for receiving a guide portion 560 of the valve housing 580, and a right or second end 558 having a diameter preferably larger than the central body portion 554. The first end 556 and the second end 558 include grooves 562, 564 forming first walls 566, 567, transverse walls 568, 569, and second walls 570, 571. Seals 572, 574, for example o-rings, are positioned within the grooves 562, 564. Preferably, the seals 572, 574 are sized as floating seals, as discussed above, where the seals are sized to contact only one of the first 566, 567 or second 570, 571 walls and a wall 581 of the valve housing 580 at a given time.

Gas under pressure enters through the input flow passage 582 and flows to the area 551 created between the valve housing 580 and the spool 552. Gas in the area 551 exerts a pressure force across the spool 552 and seal 574. In the state shown in FIG. 75, the left spool seal 572 is positioned as pictured adjacent the second wall 570 of the groove 562 located on the first end 556 of the socket spool 552. Gas exerts a pressure on the spool seal 574, urging it against the second wall 571 of the second groove 564. The pressurized gas may be released through the output channel opening 548 once the spool seal 574 has passed the by the output channel opening 584.

The arrangement of the socket spool 552 is such that the left (as pictured in FIG. 75) or first seal 572 is an inner or "inverted" seal formed in an inner groove 562, that is, the groove and seal are in an orientation facing the inside of the socket spool 552. The seal 572 is thus oriented differently than the right or second seal 574 shown in FIG. 75, such that it is formed on the guide portion 560 of the valve housing 580 adjacent one end 556 (as pictured, the left end) of the socket spool 552 to slide along or about the guide 560 projecting from the housing 580, thereby maintaining a pressure balance (pressure forces do not push the spool 552 in either direction but are maintained as balanced across the socket spool 552). Moreover, the arrangement is configured such that both seals 572, 574 chase the socket spool 552 when moving toward the opening position (as pictured in FIG. 75, to the right), reducing breakaway friction. Both seals 572, 574 chase the spool 552 on the open stroke of the valve assembly 550 and contribute little breakaway friction. The valve 550 may be actuated by any suitable means, such as a pushrod inserted into the opening 586 formed by the guide portion 560.

This chasing action (seals chasing spool), as well the use of o-rings seals 572, 574 that are designed to "float" (their respective grooves 562, 564 are over-sized such that during operation they contact only a single face of each of the valve housing and one of the walls 570, 571 of a given groove 562, 564 at a given time), results in greatly reduced breakaway friction, thus lowering the force required to open the valve 550. While friction may be increased on the closing stroke, in most applications, pressure within the valve is reduced during closing, and closing friction is therefore inherently low compared to opening. Additionally, as in the application for which the valve was originally developed, commonly larger actuation forces (such as gas under pressure) are available during closing, making the trade-off favorable.

In another embodiment of a valve according to the present invention, a separable seal valve assembly, that is, an assembly where one of the seals is separable from the spool, is also provided. While the ZBF Valve's basic configuration shown and described in FIG. 75 allows movement of a spool valve when exposed to high pressures with low actuating force, in many practical applications other issues must be addressed in order to be resolved in order to achieve extended seal life. At high pressure, the "intermittent" seal (that is, the seal that passes a vent, bore, opening or channel to open the valve, for example seal 574 in FIG. 75) is susceptible to damage by pressure-induced extrusion into the vent. Conventionally, operation at up to moderately high pressures can be achieved using special seal shapes and materials, but the ZBF Valve concept of the present invention provides a fundamental solution that allows operation of a valve at high pressures using only commercial "off-the-shelf" rubber o-ring and square-ring type seals as are well known in the art. In place of a fully captured seal 572 at the lip of the spool socket 556 as shown in FIG. 75, an un-captured or "free" moveable square ring 680 can be employed, as illustrated in FIGS. 76 and 77.

In the embodiment shown in FIGS. 76-79, the valve 600 includes a generally cylindrical spool 602 preferably including a central body portion 604, a left (as pictured) or first end 606, and a right (as pictured) or second end 608. The central body portion 604 preferably tapers adjacent its ends. The spool 602 is slidable within a spool passage 603, preferably of varying width. The valve housing 650 includes gas passages preferably comprising an input or first flow passage 652, a balancing or transverse passage 654 and an output flow passage 656. The passage 652, 654, 656 are in selective communication. The valve housing 650 may include housing inserts 660, 662 having channels 664, 666 running through each, or such inserts may be formed integrally with the housing 650. Insert 662 may be formed as a cap that mates with a threaded portion of the valve housing 650. Various seals 667, 668, 669, 670, 671 such as o-ring type seals, may be included throughout the valve housing 650 to control the passage of gas throughout the valve housing 650. For example, seals 667, 669 are used to form a seal between the housing insert 660 and the valve housing 650. Likewise, seals 668 and 670 are utilized to seal the second housing insert 662 with respect to the valve housing 650.

The first end 606 of the spool 602 forms a generally cylindrical cavity or spool socket 610 configured to receive a valve housing insert 660 and/or pushrod 682, as discussed below. In the preferred embodiment, the spook socket 610 has a diameter larger than the central body portion 604, as shown in FIGS. 76 and 77. Preferably adjacent the second end 608 is an elongate stem portion 612 passing through a channel 672 in the valve housing 650, such as channel 666 formed in valve insert or cap 662. In the preferred embodiment, the elongate stem portion 612 has a diameter smaller than the diameter of the central body portion 604, as shown in FIGS. 76 and 77.

Figure 76:
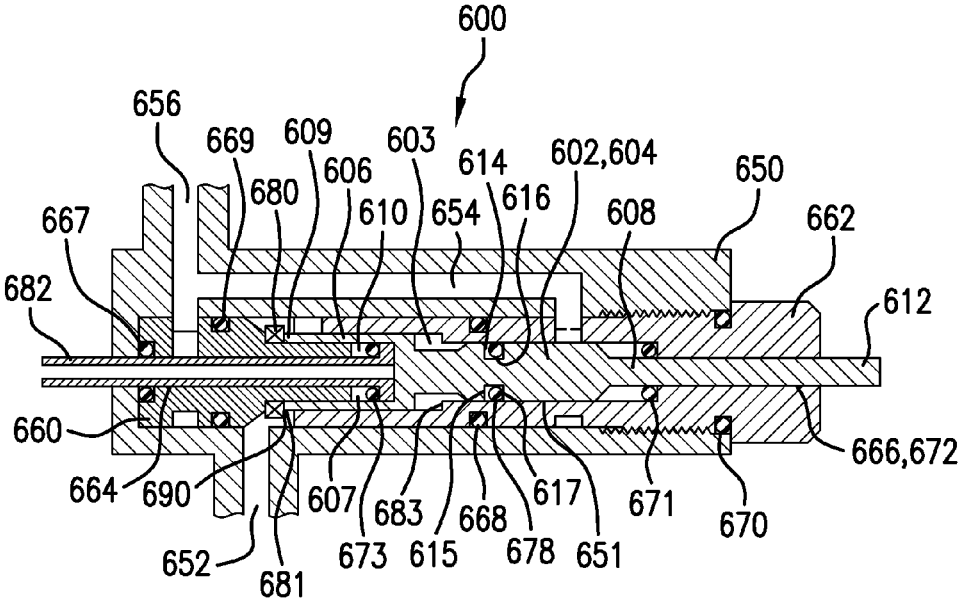
FIG. 76 is a sectional view of a spool valve according to the present invention in the closed state featuring a square-ring seal in place of a fully-captured seal.
Figure 77:
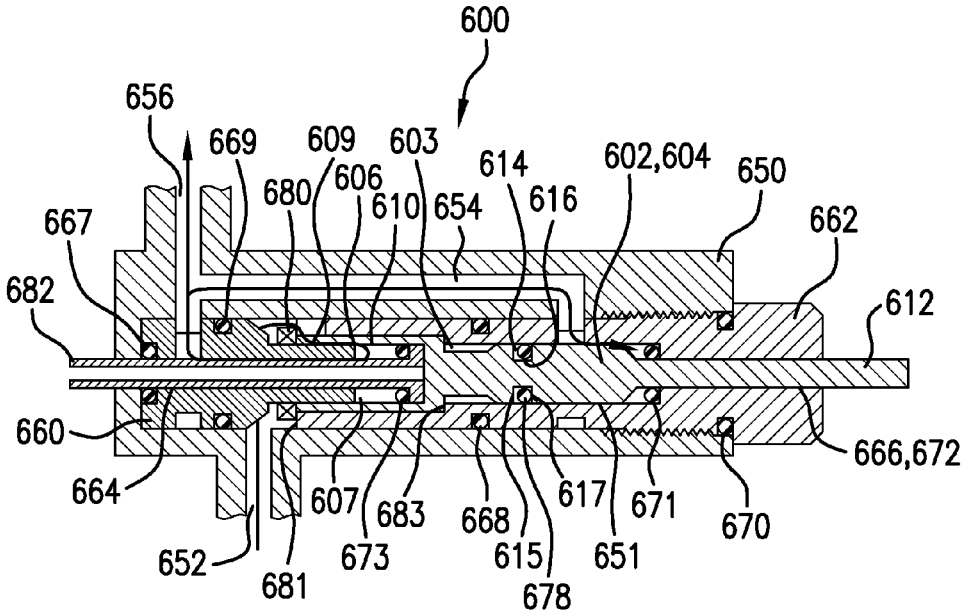
FIG. 77 is a sectional view of a spool valve according to FIG. 76 in the open state featuring a square-ring seal in place of a fully-captured seal.

As shown in FIGS. 76 and 77, central body portion 604 includes a groove 614 having a first wall 615, a transverse wall 616 and a second wall 617. The groove 614 may be positioned as shown in FIGS. 76 and 77, although it may be positioned in other locations along the length of the central body portion 604, preferably toward the first end 606 and to the left (as pictured) of where the opening of the transverse passage 654 communicates with spool passage 603. Preferably, a seal 678 is sized as a floating seal, as discussed in detail herein, where the seal is sized to contact only one of the first 615 or second 617 wall and a contact surface wall 651 of the valve housing 650 (and not contact the transverse wall 616) during operation of the spool.

The first end 606 of the spool 602 includes a spool socket 610 having an opened bore, or channel 607 which is preferably cylindrical. In the embodiment shown in FIGS. 76 and 77, the opening 607 receives a portion of an actuation member which in this example is shown as a pushrod 682 configured to selectively bias the spool 602 to the right to open the valve assembly 600. The first end 606 of the spool 602 has a spool socket lip 609 formed by the left facing wall (as pictured) of the opening 607. The pushrod 682 controls movement of the spool 602, such as by providing a biasing force to move the spool 602 to the right, as pictured.

Figure 78:
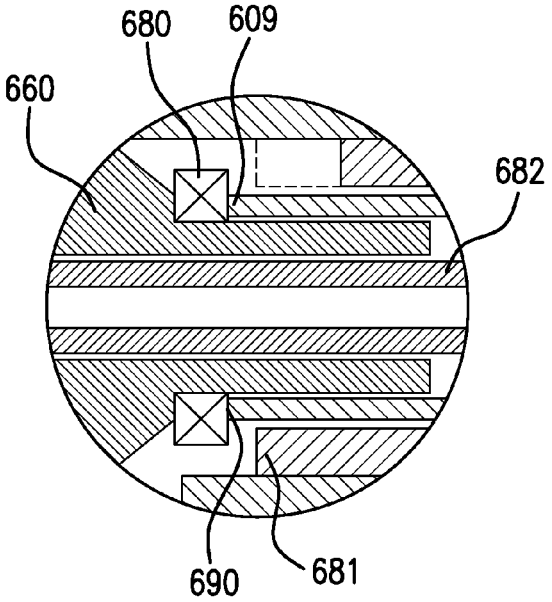
FIG. 78 is a close-up sectional view of a spool valve and square ring seal according to the present invention in the closed state.
Figure 79:
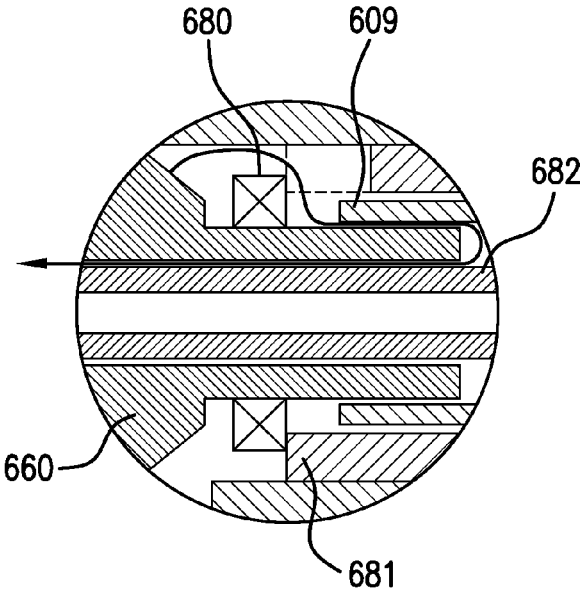
FIG. 79 is a close-up sectional view of a spool valve and square ring seal according to the present invention in the open state.

FIGS. 78 and 79 show a detailed view of the square ring 680 and spool socket lip 609 of the valve 600 shown in FIGS. 76 and 77. When gas under pressure enters the spool passage 603 through input flow passage 652, the spool seal 678 of the central body portion 604 in the embodiment of FIGS. 76-79 and the square ring seal 680, initially chase the spool 602 under the action of gas pressure force. The contact seal between the square ring seal 680 and the spool socket lip 609 may be referred to herein as the socket lip seal 690. As the spool 602 moves to the right (as pictured), the socket lip seal 690 between the square ring 680 and the socket spool lip 609 are separated by interference with a slotted face 681 or shoulder of the valve housing 650 positioned to contact the square seal 680 in the spool passage 607. The square ring 680 is held in place when contacting the slotted face 681, while the spool 602 slides further to the right (as pictured), moving until contacting a decreased width portion 683 or shoulder of the valve housing 650, thereby opening the valve assembly 600 by separating the socket lip seal 690. Since the socket lip seal 690 is not an intermittent seal in that it does not need to move past a vent, bore, hole or channel opening on either the opening or closing stroke of the spool 602, damage to the square ring seal 680 by abrasion/extrusion is minimal, facilitating long seal life. The force required to open the socket lip seal 690 between the socket spool lip 609 and the square ring 680 can be adjusted by altering the location and/or width of the slots in the separator face 681. Effective separation of the socket lip seal 690 between the socket spool lip 609 and the square ring 680 can be achieved by separating the socket lip seal 690 at one or more small discrete locations about the circumference of the socket spool lip 609, rather than the entire socket spool lip 609 simultaneously (once the socket lip seal 690 is broken in any single contact point, the remainder of the socket lip seal rapidly detaches).

The arrows of FIGS. 76-79 illustrate the flow of gas through the valve assembly 600 in operation. The valve 600 shown in FIGS. 76-79 comprises a one-way pressure balanced embodiment which, in operation, communicates gas thought the balancing or transverse flow passage 654 to an area 691 adjacent the face or end 608 of the spool opposite the socket 610. Pressurized gas enters the area 692 located behind the square ring 680 through the input passage 652. In this embodiment, a pushrod 682 extends into the opening of the spool socket 610 and is used to actuate or displace the spool 602 toward the rear (right) end of the valve body 650. A seal 673, such as an o-ring may be provided between the spool socket 610 and the pushrod 682 to prevent the passage of gas therebetween. The square ring 680 chases the lip 609 of the spool under the pressure exerted by the gas. Once the socket lip seal 690 is broken by the separator face 681 of the valve body 650, gas flows into the cavity 607 of the spool 602. Gas is then permitted to flow into the space created between the pushrod 682 and the valve housing insert 660, into the transverse flow passage 654, and into output flow passage 656. As shown in FIG. 77, gas from the transverse flow passage 654 communicates with the first end 608 of the spool 602, balancing the force acting on the spool 602. Ambient pressure may be communicated through the center of the pushrod 682 to make use of pressure forces to maintain continuous contact between the pushrod and the socket spool. In an alternate embodiment, the pushrod may be affixed to or formed integrally with the socket spool. It should be noted that this arrangement may be activated by any number of known means, and is not limited to the specific pushrod configuration described.

In the one-way valve embodiment shown in FIGS. 76-79, the pushrod 682, nested within the spool socket 610, may extend through a seal 667 on the left of the valve housing insert 660, and the spool 602 may include the elongate extended portion 612 to protrude through a seal 671 on the right of the spool 602 to facilitate movement and/or application of actuation/de-actuation forces to the spool 602.

It is to be appreciated that the valve assemblies employing the ZBF Valve invention may be applied to a wide range of applications and valve configurations. For example, those in the art will appreciate that the valve assemblies of the present invention can be used for any valving application to control of the flow of gas under pressure or another fluid.

Figure 80:
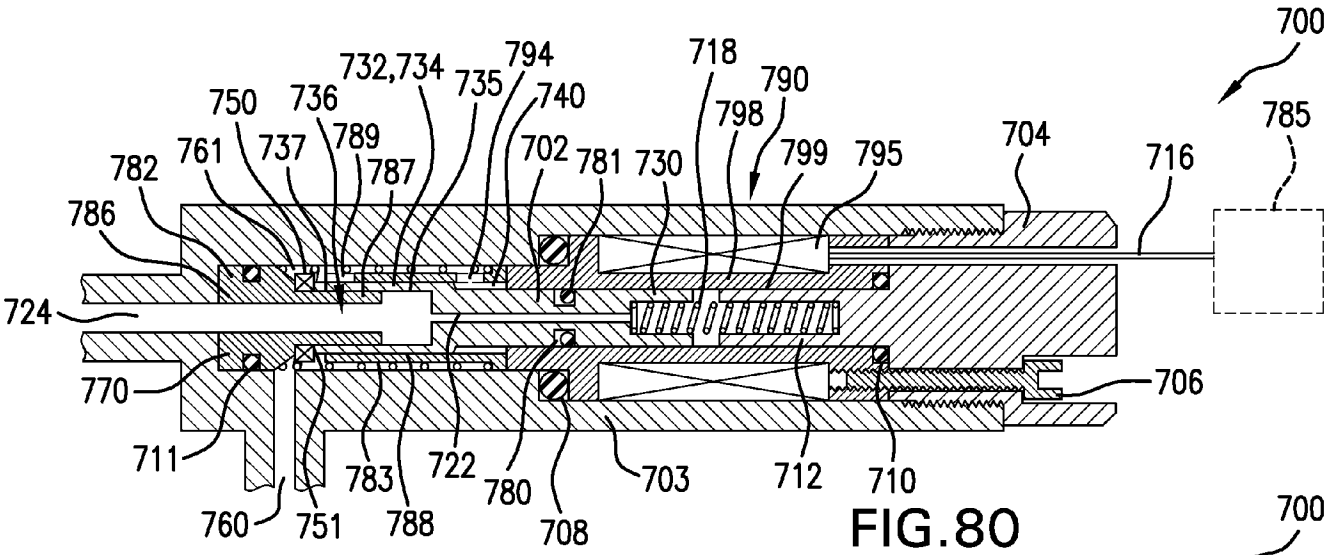
FIG. 80 is a sectional view of a solenoid-actuated spool valve according to the present invention in the closed position.
Figure 81:
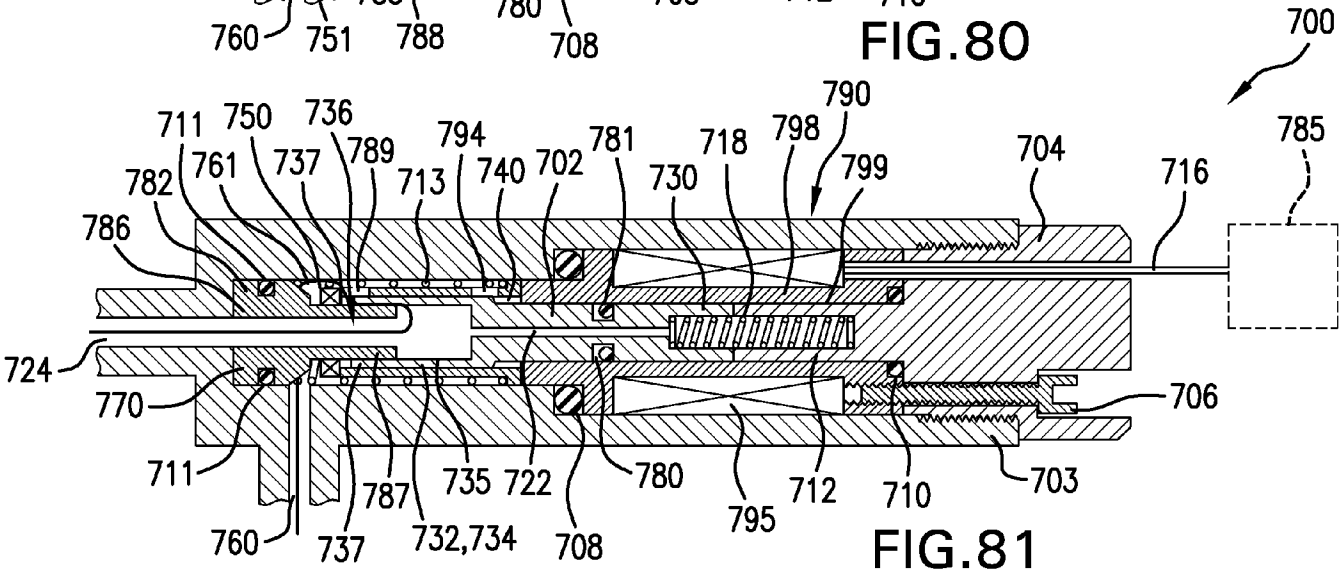
FIG. 81 is a sectional view of a solenoid-actuated spool valve according to the present invention in the open position.

Another embodiment features a solenoid-actuated assembly of a pressure-balanced one-way ZBF Valve, shown in FIGS. 80 and 81. The valve assembly 700 functions in a similar fashion to that described above with respect to FIGS. 76-79, however, a solenoid 790 is utilized to activate the valve slider (spool) 702, rather than a pushrod arrangement as discussed previously herein.

Valve slider 702 is moveable within a valve passage 740, and includes a rear portion 730 and a socket portion 732. The rear portion 730 includes a preferably cylindrical opening 733 at its rear end, configured to receive a biasing member such as a spring 718. The socket portion 732 includes a wall 734 forming a cylindrical bore 735 with an opening 736 at its forward end 737. The forward end 737 of the socket portion 732 receives at least a portion of housing insert 770. The rear portion 730 further includes a groove 780 with a floating seal o-ring 781, the arrangement of which is identical to that described above with respect to the embodiment of FIGS. 76 and 77, for reduced breakaway friction.

As shown in FIGS. 80 and 81, a rear portion 730 of the valve slider 702 slidably moves within a non-magnetic coil housing 798 having an inner bore 799 therethrough, containing an insulated wire coil 795, which is retained by a magnetic plug 704, threadably fastened to the housing 798 and may be attached with one or more screws 706 which facilitate easy assembly and disassembly of the unit. Preferably, an o-ring type seal 708 is formed between the coil housing 798 and outer or compressed air gun housing 703, and a second preferably o-ring type seal 710 is formed between a step in the bore of the coil housing 798 and a hollow protrusion 712 from the front face of the magnetic plug 704. The plug 704 partially penetrates the inner bore 799 of the coil housing 798 and serves as a mechanical stop to limit the rearward travel of the valve slider 702. The housing 703, guide stem 714, and valve slider 702 are also preferably magnetic. A source of electrical power, such as a battery 785 shown schematically, selectively supplies current through wire leads 716, such as through actuation of a trigger, button, or other actuating element. When current from the power source is applied to the coil 780 via wire leads 716 penetrating the magnetic plug 704, the induced magnetic field will bias the valve slider 702 to move rearward (to the right as pictured) against the force applied by the valve counter spring 718 positioned within the opposed faces of the valve slider 702 and protrusion 712 from the face of the magnetic plug 704. The valve slider 702 has a channel 722 through its center communicating gas pressure across the valve slider 702 to prevent gas pressure from applying a net force to the valve slider 702.

As discussed in connection with the embodiments shown in FIGS. 76-79, the square ring 750 is positioned adjacent the lip 751 of the socket portion 732. The interaction and opening of a gas flow passage is described in detail herein in connection with FIGS. 76-79. Gas under pressure entering the valve passage initially through input flow passage 760 will collect in the area 761 adjacent the forward portion of the square ring 760. A seal is created between the square ring 750 and the lip 751 of the socket portion 732.

A housing insert 782 and valve passage insert 783 are positioned in the forward portion of the valve passage 740. Housing insert 782 includes a passage 786 therethrough, and has an extension portion 787 extending into the cavity formed by the socket portion 732 of the valve slider 702. A seal 711, such as an o-ring, may be used to provide a seal between the housing insert 782 and the valve housing 703. The square ring 750 is positioned about and slidable along the extension portion 787 as shown in FIGS. 80 and 81. Valve passage insert 783 is preferably cylindrical with walls defining a passage 788 running therethrough for receiving a portion of the valve slider 702. Valve passage insert 783 includes a least one portion forming a slot 789 extending forward adjacent the square ring 750, shown at the lower portion of FIG. 81. A spring 713 may be positioned within the valve passage 740 between the housing insert 782 and the valve passage insert 783, ensuring each maintains their respective orientations in the valve passage 740.

Upon actuation of the coil, valve slider 702 is moved by magnetic force rearward against the bias of spring 718. The square ring 750 chases the valve slider 702, until the square ring 750 contacts the slot 789 of the valve passage insert 783. This breaks the seal between the square ring 750 and the lip 751 or the valve slider 702. Gas flows as shown in FIG. 81, down passage 724.

Since magnetic force from the coil 795 acts directly to move the valve slider 702 in the example embodiment of FIGS. 80 and 81, the pushrod shown in previous example embodiments is unnecessary, and the gas outlet 724 is oriented axially in-line with the valve passage 740. The compressed gas flowing through gas outlet 724 may be used to act as other valving arrangements in compressed gas guns of, for example, the blow forward type, by moving a bolt and/or piston forward, whereupon the gas is released to fire a chambered projectile, and the bolt and/or piston is reset with pneumatic forces or a spring. The interaction of the square sealing ring 750, the valve slider 702, and valve passage insert 783 all remain similar to that described above with respect to the embodiments shown in FIGS. 76-79.

The example embodiment of FIGS. 80 and 81 also provides a pressure balance across the valve slider 702. In the closed position, as shown in FIG. 80, gas may flow through opening 794 in the valve passage insert 783 to communicate with a portion of the valve slider 702 adjacent the opening 794. This provides for balanced pressure during valve operation.

Figure 82:
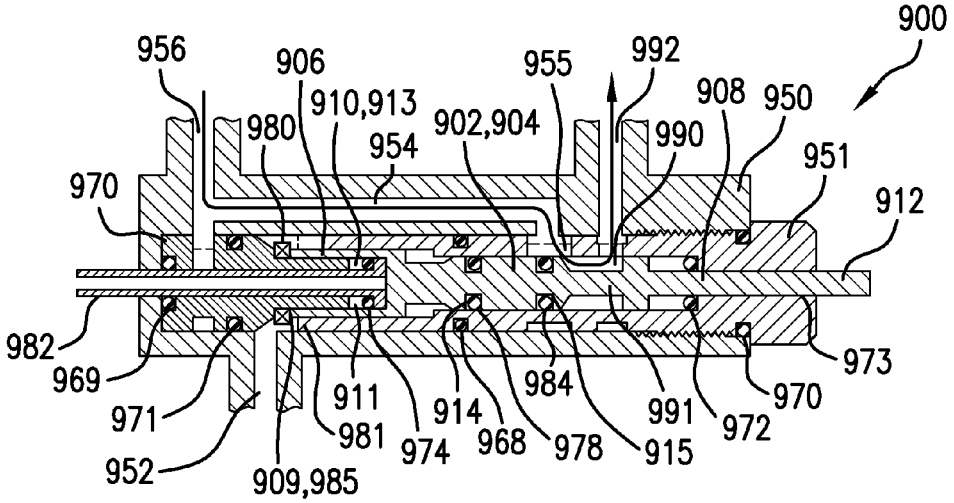
FIG. 82 is a sectional view of a two-way spool valve according to the present invention in the closed position.
Figure 83:
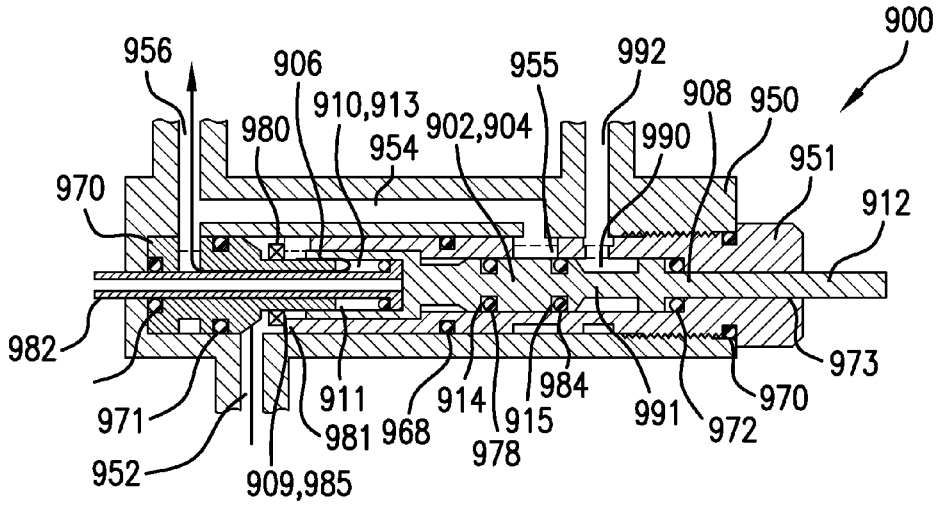
FIG. 83 is a sectional view of a two-way spool valve according to the present invention in the open position.

In yet another embodiment, a ZBF Valve arrangement can be used in a 2-way valving arrangement, such as the shown in FIGS. 82 and 83. The valve assembly 900 includes a generally cylindrical spool 902 preferably including a central body portion 904, a first end 906, and a second end 908. The valve housing 950 includes an input passage 952, a transverse passage 954, an alternating passage 956, and an output passage 992. Various seals 968, 969, 970, 971, 972 such as o-rings may be included throughout the valve housing 950 to prevent or control the passage of gas. For example, seals 971, 969 are used to form a seal between the housing insert 970 and the valve housing 950. Likewise, seals 968 and 970 are utilized to seal the second housing insert 662 with respect to the valve housing 650.

The first end 906 of the spool 902 forms a spool socket 910 configured to receive, for example, a pushrod 982 and a portion of the valve insert 970. A seal 974, such as an o-ring may be provided between the spool socket 910 and the pushrod 982 to prevent the passage of gas therebetween. The spool socket 910 is generally formed having a wall 911 surrounding an open bore 913. The second end of the spool 908 includes an elongated stem portion 912 passing through a channel 973 on a second valve housing insert 951. The square ring seal 980, spool socket lip 909, and separator face 981 all function the same as disclosed above with respect to the previous embodiment shown in FIGS. 76 and 77.

The central body portion 904 of the spool 902 features two sealing elements 978, 984, arranged in grooves 914, 915 respectively. These sealing elements 978, 984 and grooves 914, 915 are of the floating seal arrangement described in detail herein, such that the sealing elements (e.g., o-rings) chase the spool 902 during actuation.

In a first or closed position, as shown in FIG. 82, gas under pressure may enter the valve housing 950 through the alternating passage 956 and flow into the transverse passage 954. From the transverse passage 954, the pressurized gas passes through an opening 955 in the valve housing 950 to a rear area 990 formed adjacent a decreased diameter portion 991 adjacent the second end 908 of the spool 902, and out through exhaust passage 992. Although referred to as a "closed" position, it is apparent that a flow passage is opened between passage 956 and passage 992.

In a second or open position, whereby the spool 902 is moved rearward (to the right as pictured) such as by actuation member shown as pushrod 982, shown in FIG. 83, pressurized gas enters the area located behind the square ring seal 980 through the input passage 952. In this embodiment, a pushrod 982 extends into the spool socket 910 and is used to displace the spool 902 toward the rear (right) end of the gun. The square ring seal 980 chases the lip 909 of the spool under the pressure exerted by the gas. Seals 978, 984 also chase the spool 902. Once the socket lip seal 985 is broken by the separator face 981 of the valve body 950, gas flows into the area 910 of the spool socket 910, and may assist in urging the spool 902 to the right. Gas flows between the pushrod 982 and the valve insert 970 and from the valve body 950 through the alternating passage 956. The displacement of the spool 902 causes the seal 984 to move to a position where the seal 984 prevents the further flow of gas into the area 990.

Regulating ZBF Spool Valve

Figure 84:
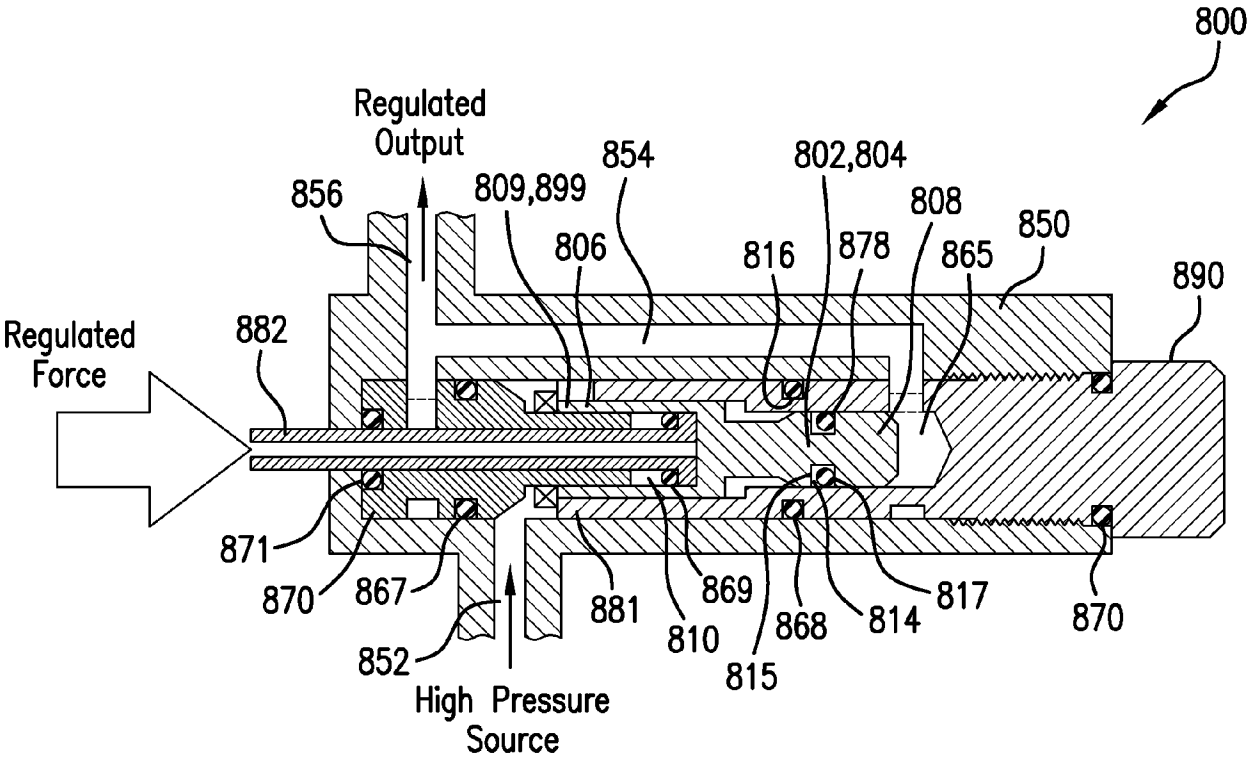
FIG. 84 is a sectional view of a self-regulating spool valve according to the present invention in the closed position.

The ZBF spool concept very naturally adapts to pressure regulation, as illustrated in FIG. 84. The valve 800 includes a generally cylindrical spool 802 preferably arranged including a central body portion 804, a left (as pictured) or first end 806, and a right (as pictured) or second end 808. The valve housing 850 may include gas passages, specifically an input passage 852, a transverse passage 854 and an output passage 856. Various seals 867, 869, 868, 870, 871 such as o-ring type seals, may be included throughout the valve housing 850 to prevent or control the passage of gas. For example, seals 871, 867 are used to form a seal between the housing insert 870 and the valve housing 850. Likewise, seals 868 and 870 are utilized to seal the second housing insert 890 with respect to the valve housing 850.

The first end 806 of the spool 802 forms a generally cylindrical open cavity or spool socket 810 configured to receive a valve housing portion 870 and/or pushrod 882, as discussed below. A seal 869, such as an o-ring may be provided between the spool socket 810 and the pushrod 882. The central body portion 804 of the spool 802 includes a groove 814 having a first wall 815, a transverse wall 816 and a second wall 817. The groove 814 is preferably positioned as shown in FIG. 84, although it may be positioned in other positions along the length of the central body portion 604. Preferably, a seal 878 is sized as a floating seal, as discussed above with respect to each of the previous embodiments of FIGS. 76-83, where the seal 878 is sized to contact only one of the first 815 or second 817 wall and a wall 851 of the valve housing 850.

The spool socket 810 receives a portion of the valve insert 870 and an actuation member 882, such as a pushrod. The first end 804 of the spool 802 has a spool socket lip 809. A square ring seal 880 and spool socket lip 809 of the valve 800 shown in FIG. 84 form the socket lip seal 899. As described above with respect to FIGS. 76-79, the square ring seal 880 initially chases the spool 802 under the force of the pressurized gas. As the spool 802 moves to the right (as pictured), the square ring 880 and the socket spool lip 809 are separated by the interference with a slotted face 881 or shoulder of the valve housing 850 positioned adjacent the square seal 880 in the spool socket 810. The square ring 880 is held in place, while the spool 802 slides further to the right (as pictured), thereby opening the socket lip seal 899. Because the socket lip seal 899 does not need to move past a hole or channel opening on either the opening or closing stroke of the spool 802, damage to the square ring seal 880 by abrasion or extrusion is eliminated, vastly improving seal life. The force required to open the socket lip seal 899 between the socket spool lip 809 and the square ring 880 can be adjusted by altering the width of the slots in the separator face 881. Effective separation of the socket lip seal between the socket spool lip 809 and the square ring 880 can be achieved by separating the socket lip seal 899 at one or more small discrete locations about the circumference of the socket spool lip 809, rather than the entire socket spool lip 809 simultaneously.

As described about with reject to FIGS. 76 and 77, pressure may be communicated through the transverse passage 854 to an area 865 adjacent the second end or right side (as pictured) of the spool 808 once the socket lip seal 899 has been broken and the spool has moved to an open position. In the embodiment shown in FIG. 84, the right side of the spool 802 provides an effective surface area that unbalances the pressure forces across the spool 802. Gas under pressure acting upon the spool 802 via area 865 will provide a net biasing force to the left (as pictured), if the effective surface area of the portion of the spool 802 communicating with area 865 is greater than the force on the effective surface area of the spool 802 biasing the spool 802 to the right. The arrangement of the valve assembly 800 and the action of fluid under pressure on the difference in effective surface areas of the spool 802 produces a biasing force for the spool 802 to move toward the closed position (to the left in FIG. 84) against a regulating force, applied by, for example, a spring biasing the pushrod 882. A pneumatic force may also be applied to the pushrod or other actuating member or element. Adjusting the regulating force applied to the spool 802 will necessarily modify or regulate the operating pressure of the valve assembly 800. Different levels of force may be necessary to move the spool 802 to the closed position, based upon the extent of the regulating force. Again, the spool lip seal 899 is subjected to no significant abrasion or extrusion, allowing regulation of high pressure sources with ordinary ring seals, which are readily capable of observation and inspection and replaceable.

It should be noted that any of the arrangements shown in FIGS. 75-88 could be used to control the flow of compressed gas in, for example, a paintball marker (gun). Some examples of paintball marker guns are those offered under the brand names 32 DEGREES™, EMPIRE™, DIABLO™, INVERT MINI®, and yet others are shown and described in U.S. Pat. Nos. 6,708,685, 4,936,282, 5,497,758, and U.S. application Ser. Nos. 11/183,548, 11/180,506, 11/150,002, 11/064,693, 10/313,465, 10/090,810, the entire contents of which are all incorporated fully herein by reference herein. These marker guns utilize various firing arrangements including, but not limited to, pushrods and solenoid valves in order to impart a force on the firing or gas flow control valves. It is envisioned that any suitable means to impart such a force on the spool could be used with the ZBP Valve of the present invention, thus creating a versatile unit with broad applicability.

The designs of the ZBF Valve have favorable applications in, for example, the "blow forward" style of compressed gas gun designs that do not use any hammer, pushrod or poppet valve in their designs. Examples of such guns include the FREESTYLE™, Invert MINI®, and AUTOMAG™ guns which are known in the art. When such guns are fired, a gas flow path is opened when the bolt and/or piston is in its forward or firing position, and when the bolt and/or piston reaches the end of it's travel, pneumatic forces or a spring push the bolt and/or piston back to a ready-to-fire position for another rapid shot.

By way of example, U.S. Pat. Nos. 5,280,778 and 5,704,342, the entire contents of which are incorporated herein by reference, disclose blow forward types guns for use in the sport of paintball. Those patents teach use of an on-off valve member, used to control the flow of compressed gas to control bolt operation and a firing operation of the disclosed guns. A ZBF Valve embodiment described herein could be used as a replacement for the on-off valve member, providing a valving alternative with lower breakaway friction for improved operation of the gun. Any seals shown in U.S. Pat. Nos. 5,280,778 and 5,704,342, such as seals contacting or on the bolts of the guns, or any other moving parts, could be modified according to the teachings of the present invention to produce movement of moving parts with lower breakaway friction.

Similarly, U.S. Pat. Nos. 6,601,780 and 6,925,997, the entire contents of which are incorporated herein by reference, disclose blow forward types guns for use in the sport of paintball. Those patents teach use of a solenoid valve including stopper, used to control the flow of compressed gas to control bolt operation and a firing operation of the disclosed guns. A ZBF Valve embodiment described herein could be used as a replacement for the valve and/or stopper, providing a valving alternative with lower breakaway friction for improved operation of the gun. Any seals shown in U.S. Pat. Nos. 6,601,780 and 6,925,997, such as seals contacting or on the bolts of the guns, or any other moving parts, could be modified according to the teachings of the present invention to produce movement of moving parts with lower breakaway friction.

Similarly, U.S. Pat. No. 5,613,483, the entire contents of which is incorporated herein by reference, discloses a blow forward type gun for use in the sport of paintball. The patent teaches use of a trigger actuated spool valve, used to control the flow of compressed gas to control bolt operation and a firing operation of the disclosed gun. A ZBF Valve embodiment described herein could be used as a replacement for the trigger actuated spool valve, providing a valving alternative with lower breakaway friction for improved operation of the gun. Any seals shown in U.S. Pat. No. 5,613,483, such as seals contacting or on the piston rod or bolt of the guns, or any other moving parts, could be modified according to the teachings of the present invention to produce movement of moving parts with lower breakaway friction.

Similarly, U.S. Pat. No. 7,395,819, the entire contents of which is incorporated herein by reference, discloses a blow forward type gun for use in the sport of paintball. The patent teaches use of a trigger actuated solenoid valve, used to control the flow of compressed gas to control bolt operation and a firing operation of the disclosed gun. A ZBF Valve embodiment described herein could be used as a replacement for the solenoid valve, providing a valving alternative with lower breakaway friction for improved operation of the gun. Any seals shown in U.S. Pat. No. 7,395,819, such as seals contacting or on the piston rod or bolt of the guns, or any other moving parts, could be modified according to the teachings of the present invention to produce movement of moving parts with lower breakaway friction.

The ZBF Valve as described in the above embodiments offers numerous advantages over known arrangements in the prior art. Foremost, the seal arrangement offers improved reliability despite using only commercial off-the-self seals, such as standard o-rings. Because the internal seals do not pass over holes or orifices, abrasion and other wear is reduced, extending seal life. Moreover, because these seals generally chase the spool, rather than being pushed thereby, lower internal friction is achieved within the valve, resulting in reduced actuation forces required for operation.

The valve arrangement of the present invention consists of only a few simple components and is therefore cost effective, as well as easily disassembly, facilitating quick and efficient inspection and replacement of its components. Its simplicity does not affect its versatility however, as noted above, the valve can be configured to regulate pressure, specifically, a pressure-feedback arrangement can be achieved to de-actuate the valve.

While described in detail herein in connection with pressurized gas, it is apparent that the valve arrangements of the present invention may be used to regulate the flow of any fluid.

While the preferred embodiments of the invention have been described in detail above, the invention is not limited to the specific embodiments described which should be considered as merely exemplary. Further modifications and extensions of the present invention may be developed and all such modifications are deemed to be within the scope of the present invention as defined by the appended claims.

What is claimed is:

1. A compressed gas gun including a breech and a flow control device for controlling the flow of compressed gas in the gun, the flow control device comprising:

a housing for receiving compressed gas, the housing having a passage therethrough, the housing having a first end and a second end;

a first seal positioned adjacent the first end of the passage, the seal having at least a portion facing toward the second end of the passage;

a valve body slidable within the passage from a first position adjacent the first end of the passage to a second position adjacent the second end of the passage, the valve body having a first end and a second end, the valve body having a channel extending longitudinally therethrough, the valve body including a hollow cylindrical protrusion adjacent the first end of the valve body extending toward the first end of the passage, the valve body including an annular groove positioned adjacent a wall of the housing;

a second seal positioned within the groove;

wherein at least a portion of the hollow cylindrical protrusion contacts at least a portion of the second seal facing toward the second end of the passage when the valve body is in the first position, and wherein the hollow cylindrical protrusion moves away from the first seal when the valve body is in the second position, and wherein movement of the valve body in relation to the first seal regulates a flow of compressed within the housing.

2. The compressed gas gun of claim 1, wherein the annular groove has a forward wall, a rear wall and a transverse wall between the forward wall and the rear wall; and wherein the second seal being a smaller dimension than the annular groove, the second seal sized to contact one of the forward wall and rear wall of the first annular groove without contacting the other of the forward wall and the rear wall of the first annular groove.

3. The compressed gas gun of claim 1, wherein the first seal comprises an elastic square-ring.

4. The compressed gas gun of claim 1, wherein the compressed gas gun further comprises a bolt, and wherein movement of the valve body in relation to the first seal permits compressed gas received within the housing to move the bolt.

5. The compressed gas gun of claim 1, wherein a spring is provided in the housing for biasing the valve body toward the first position.

6. The compressed gas gun of claim 1, further comprising an electromagnetic element positioned adjacent the second end of the passage and configured to control movement of the valve body between a first position and a second position when actuated.

7. The compressed gas gun of claim 6, wherein at least a portion of the valve body is magnetically attractable.

* * * * *